United States Patent [19]

Berry et al.

[11] 4,324,034

[45] Apr. 13, 1982

[54] METHOD AND APPARATUS FOR GAPPING AND REINFORCING SLIDE FASTENER STRINGERS

[75] Inventors: Grant E. Berry, Cochranton; Wayne A. Becker, Meadville; Karl E. Bahr, Meadville; George J. Scagnelli, Meadville; Frank J. Molnar, Meadville; Ronald K. McDonald, Jamestown; Harry F. Manning, Meadville, all of Pa.

[73] Assignee: Talon, Inc., Meadville, Pa.

[21] Appl. No.: 108,251

[22] Filed: Dec. 27, 1979

[51] Int. Cl.[3] ..... B21D 53/52

[52] U.S. Cl. ..... 29/410

[58] Field of Search ..... 29/408–410, 29/766

[56] References Cited

U.S. PATENT DOCUMENTS

| | | | |
|---|---|---|---|
| 3,631,581 | 1/1972 | Moertel | 29/408 |
| 3,763,546 | 10/1973 | Perlman | 29/408 |
| 3,787,952 | 1/1974 | Moertel et al. | 29/408 |
| 4,019,240 | 4/1977 | MacFee | 29/408 |
| 4,241,489 | 12/1980 | Manning | 29/408 |

FOREIGN PATENT DOCUMENTS

| | | | |
|---|---|---|---|
| 948794 | 2/1964 | United Kingdom | 29/408 |
| 983289 | 2/1965 | United Kingdom | 29/408 |

*Primary Examiner*—James G. Smith

*Attorney, Agent, or Firm*—O'Brien & Marks

[57] ABSTRACT

Protruding head portions of coupling elements are removed from a selected section of a slide stringer, and a reinforcing tape is applied to the selected section by means including a movable holder for clamping the stringer on opposite sides of the selected section. The holder is restricted to movement along track means for guiding and aligning the holder with two or more stations, such as a gapping station, a reinforcing tape applying station and a trimming station.

14 Claims, 47 Drawing Figures

FIG. 1
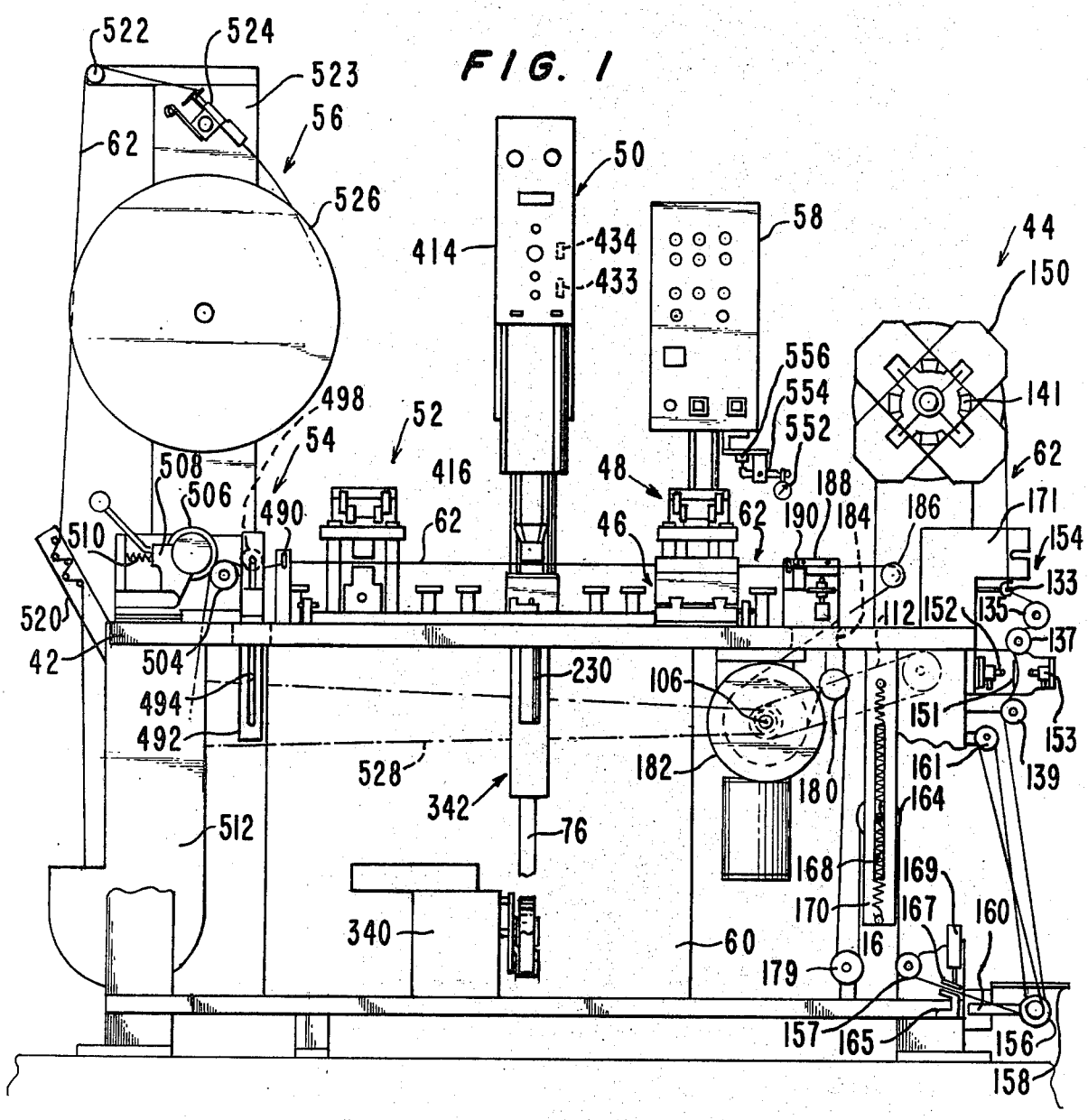
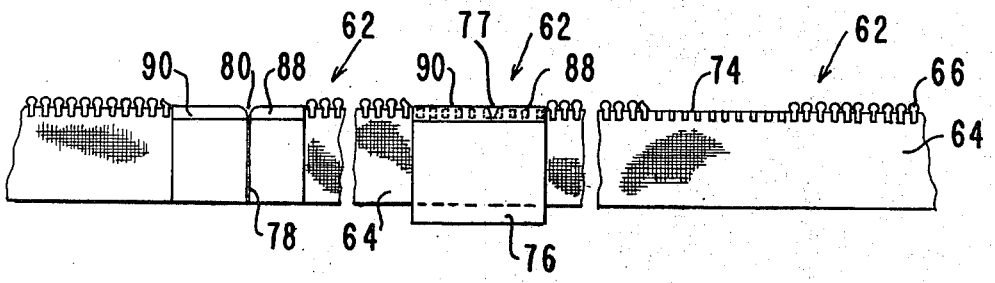
FIG. 4 FIG. 3 FIG. 2

FIG. 14
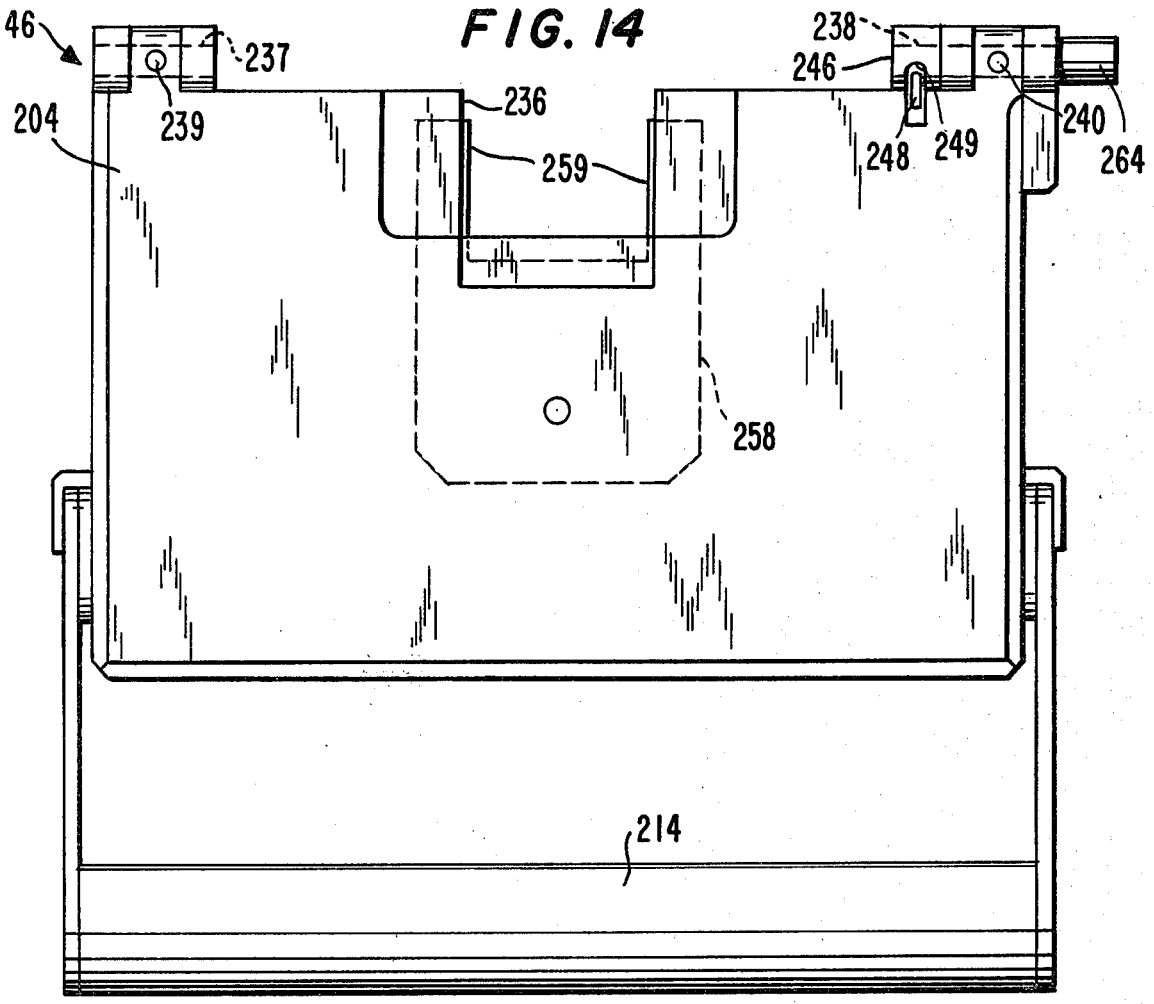
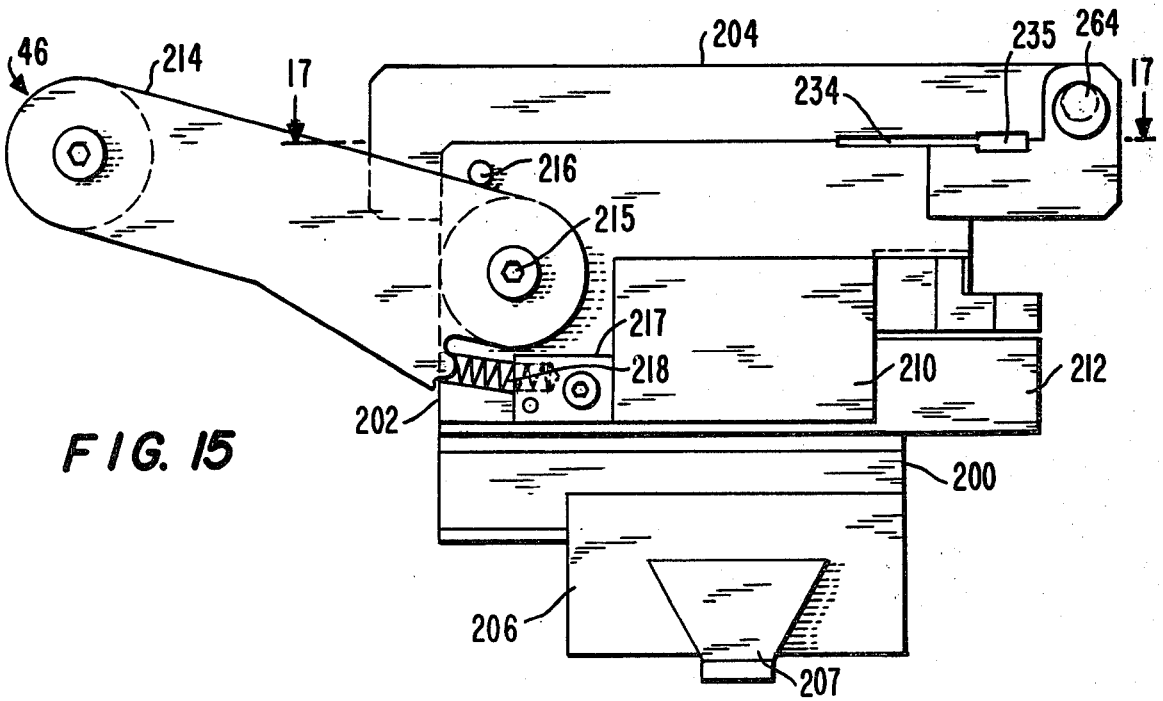
FIG. 15

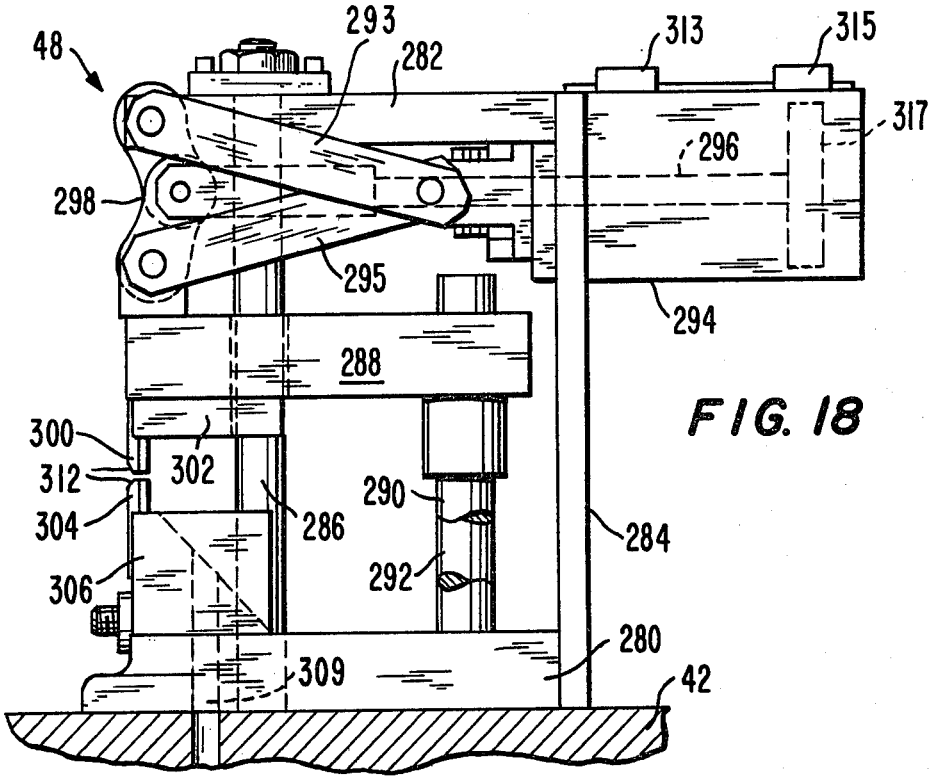
FIG. 18
FIG. 19
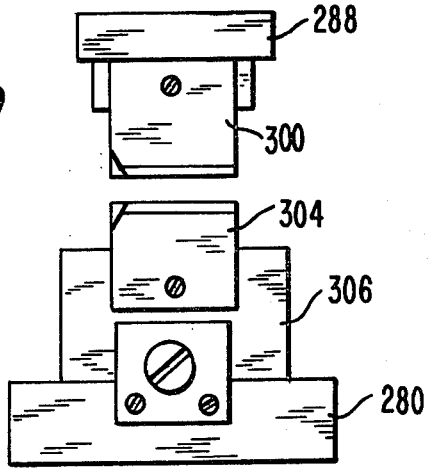
FIG. 20
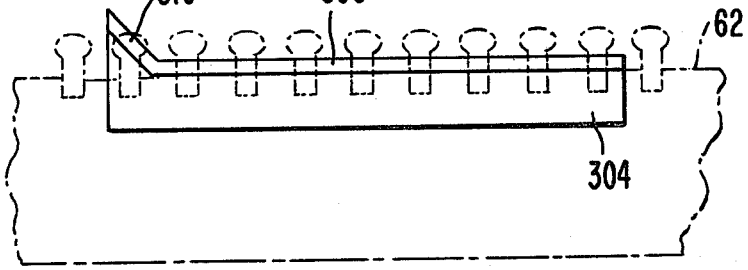

TO FIG. 37
878
908
TIMER
904
906
894
ANALOGUE MULTIPLEXER
836
834
832
FROM FIG. 35
838
896
898
900
902
732
TO FIGS. 35 & 37
750
734
PROGRAM COUNTER
R
EPROM
772
722
724
726
728
730
736
738
720
MPU
W/R
CLOCK
JMP
R
RR
DATA 770
814
740
772
774
DUAL DECODER
776
778
780
782
784
786
788
790
792
794
796
798
800
802
804
806
808
810
812
+5V

INPUT SELECTOR
INPUT SELECTOR
INPUT SELECTOR
INPUT SELECTOR
FROM FIG. 36
FROM FIG. 43
FROM FIG. 38
FROM FIG. 42
TO FIG. 38
24 V
814
760
886
821
822
823
824
825
826
827
820
828
829
888
708
878
275
336
678
315
313
277
438
434
880
278
484
464
462
887
706
889
710
890
273
271
882
750
784
762
786
770
764
788
766
740
790

157
1020
500
M
514
T
MOTOR CONTROLLER
240 V. A. C.
1026
24 V.
680
686

516
PULSE GEN.
+15 V.
1028
1022
1030
1024
24 V.
-15 V.
1032
SENSE LENGTH FIG. 41
1034
1036
1038
OTHER CONTROL FIG. 44
BATCH COUNT FIG. 42
LOGIC CONTROL FIG. 43
704
706
710
708
695
702
700
714
715
713
712
FROM FIG. 38
TO FIG. 37
FROM FIG. 33
FROM FIG. 38
FROM FIG. 45
TO FIG. 45

1104
1118
1056
+15V
1144
+15V
1262
1272
1162
1394
1128
1082
1142
1264
1160
1164
1166
1158
1126
1114
1106
1108
1112
1116
1088
1080
1110
1118
+15V
1330
1336
1332
1326
1078
1298
1306
1320
1304
1100
1296
1328
+15V
1300
1290
1076
1324
1302
1322
1102
1335
1074
1094
1333
1282
1292
1092
1390
1096
+15V
1294
1280
1072
1316
1392
1393
1288
1098
1303
1278
1334
1276
1090
1070
+15V
1284
1285
1084
1068
1310
1286
1275
710
1312
1314
695
1274
+15V
1086
708
715
702
700
1308
1066
714
TO FIG. 37
FROM FIG. 33
TO FIG. 45
FROM FIG. 38
FROM FIG. 45

METHOD AND APPARATUS FOR GAPPING AND REINFORCING SLIDE FASTENER STRINGERS

TECHNICAL FIELD

The invention relates to methods and apparatus for gapping and reinforcing single stringers for forming slide fasteners.

BACKGROUND ART

A one stringer separable fastener, such as that disclosed in U.S. Pat. No. 2,784,473, has a single folded stringer with upper and lower sliders mounted thereon. The lower slider is stopped at a lower position by an enlargement on a bar member on one end of the single stringer to thus serve as a box or retainer member on the bottom of the slide fastener. A pin member is mounted on the other end of the single stringer for insertion through the upper and lower sliders to form a separable slide fastener. The upper end of the fastener is defined by the fold.

In another prior art one stringer separable fastener, it has been proposed to form the pin member by severing the head portions of the coupling elements and securing a thermoplastic tape on both sides of the stringer tape so that the thermoplastic tape extends around the remaining portions of the coupling elements to thus form a pin member. This particular one stringer separable fastener has been proposed for incorporation in a sleeping bag.

Examples of the employment of slide fasteners in sleeping bag arrangements are found in U.S. Pat. No. 3,510,889 and No. 3,639,931.

The prior art also contains many apparatuses for gapping or removing the coupling elements from the tapes of slide fasteners in a continuous stringer or pair of stringers of the slide fastener. One such apparatus, as illustrated in U.S. Pat. No. 4,019,240, utilizes a variable distance from a sensor to the gapping mechanism to determine the length of chain between gaps, i.e., the sensor senses the previous gap to stop the pulling of the slide fastener chain through the gapping station and to initiate a subsequent gapping cycle. In another prior art arrangement, a counting circuit operated by a pulse generator on a shaft driving a slide fastener chain pulling wheel is utilized to measure the length of slide fastener chain between operations of the gapping apparatus.

The prior art further contains methods and apparatus where multiple operations are performed on a slide fastener chain at different stations, for example, U.S. Pat. No. 2,885,774, No. 3,263,238, No. 3,570,104 and No. 3,765,348. However, these methods and apparatus have one or more deficiencies such as being unduly complex or expensive, being relatively slow due to the need for precise positioning of the slide fastener chain at various stations, being too large, etc.

SUMMARY OF THE INVENTION

The invention is summarized in a method of gapping and reinforcing a selected section of a slide fastener stringer including the steps of aligning the selected section relative to a holder; gripping, by means of the holder, the slide fastener stringer on opposite ends of the selected section leaving the selected section exposed; producing relative movement between the holder and a fastener element gapping mechanism to produce alignment of the selected section with the gapping mechanism; operating the gapping mechanism after the first producing movement step to remove head portions of slide fastener elements in the selected section; producing relative movement between the holder and a reinforcing tape segment applying mechanism to produce alignment of the selected section with the reinforcing tape segment applying mechanism; and operating the reinforcement tape segment applying mechanism after the second producing movement step to secure a segment of reinforcing tape on the selected section of slide fastener stringer.

An object of the invention is to remove portions of fastening elements in a selected section of a single slide fastener stringer and to apply a reinforcing tape segment to the selected section with a simplified and fast operating procedure.

Another object of the invention is to employ a holder for holding a selected section of slide fastener stringer so that it can be easily aligned and moved to at least two stations such as gap-forming and tape-applying stations in the formation of a gapped and reinforced portion on a slide fastener stringer.

It is also an object of the invention to reduce multiple sensing devices and conveying mechanisms for sensing previous gaps and conveying a slide fastener stringer to separate stations.

One advantage of the invention is that the employment of operator time in operating a slide fastener end forming apparatus is reduced for the critical positioning step.

One feature of the invention is that a section of slide fastener is positioned only once in a holder, and thereafter the relatively easily moved holder is utilized to convey and align the secured section at successive stations.

Other objects, advantages and features of the invention will be apparent from the following description of the preferred embodiment taken in conjunction with the accompanying drawings.

BRIEF DESCRIPTION OF THE DRAWINGS

FIG. 1 is a front elevation view of an apparatus for gapping and reinforcing a slide fastener stringer in accordance with the invention.

FIG. 2 is a plan view of a section of slide fastener stringer after a gapping step in operation of the apparatus of FIG. 1.

FIG. 3 is a view similar to FIG. 2 but after a later tape segment applying step.

FIG. 4 is a view similar to FIG. 2 but after a final trimming step.

FIG. 14 is a top plan view of a movable stringer holder and gripping mechanism of the apparatus of FIG. 1.

FIG. 15 is a side elevational view taken from the right side of the movable holder and gripping mechanism of FIG. 14.

FIG. 18 is a side elevational view from the right side of a gapping mechanism of the apparatus of FIG. 1.

FIG. 19 is a front view of a portion of the gapping mechanism of FIG. 18.

FIG. 20 is a plan view of a cutting die in the gapping mechanism of FIG. 18.

DESCRIPTION OF THE PREFERRED EMBODIMENT

Figure 8:
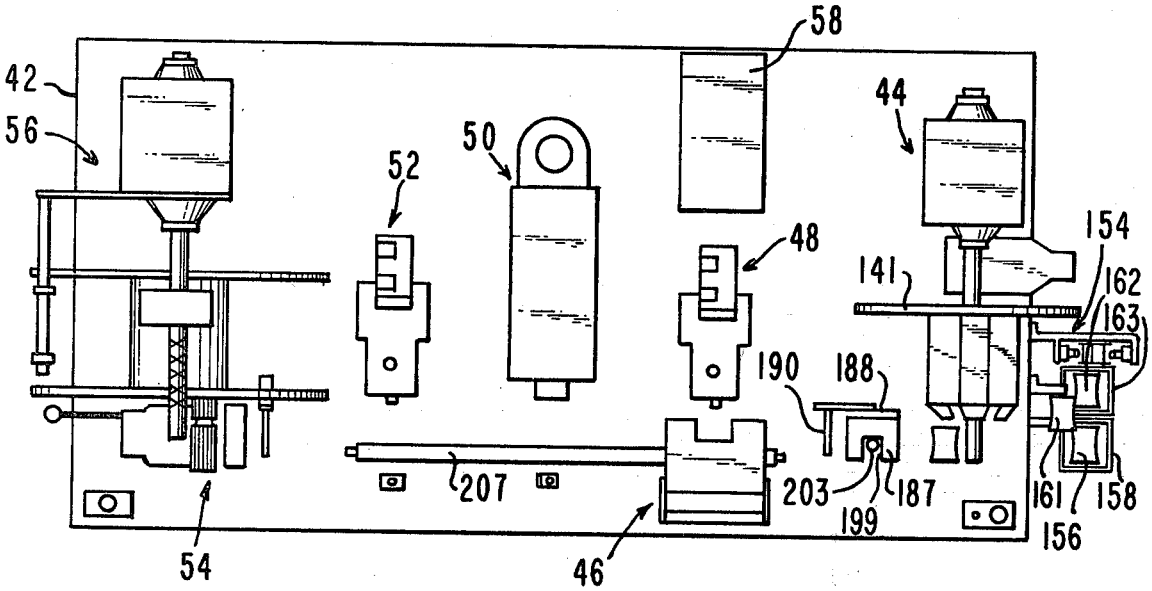
FIG. 8 is a top plan view of the apparatus of FIG. 1.

As illustrated in FIGS. 1 and 8, an apparatus for practicing an embodiment of the invention includes a table or frame 42 on which are mounted (1) a dereeling or feeding mechanism indicated generally at 44 at the right end of the table 42, (2) a sliding holder or stringer-gripper member or mechanism indicated generally at 46 and positioned to the left of the feeding mechanism 44, (3) an element cutter or gapping mechanism indicated generally at 48 behind the sliding holder block 46, (4) a tape welding mechanism indicated generally at 50 to the left of the gapping mechanism 48, (5) a trimming mechanism indicated generally at 52 to the left of the welder 50, (6) a stringer length pulling mechanism indicated generally at 54 on the left front corner of the table 42, and (7) a reeling or take-up mechanism indicated generally at 56 positioned behind and above the pulling mechanism 54. Electrical control circuitry for the apparatus is contained within a box 58 supported by a post above the rear of the table 42 and within a box 60 below the rear of the table.

Figure 5:
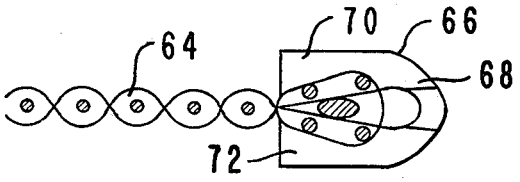
FIG. 5 is a cross section view of a portion of the slide fastener stringer of FIG. 2 prior to the gapping step.

The apparatus operates on a single continuous slide fastener stringer illustrated generally at 62 in FIGS. 2, 3 and 4 and which includes a carrier tape 64 and a row of coupling elements 66 mounted on one longitudinal edge of the tape 64. As shown in FIG. 5 the coupling elements 66 each include a head portion 68 and a pair of heel or leg portions 70 and 72 secured to the tape 64 at the inner longitudinal edge thereto. The particularly illustrated coupling elements 66 have their leg portions molded on respective pairs of connecting filaments around which a weft thread of the tape 64 is woven to secure the coupling elements 66 to the tape 64.

Figure 6:
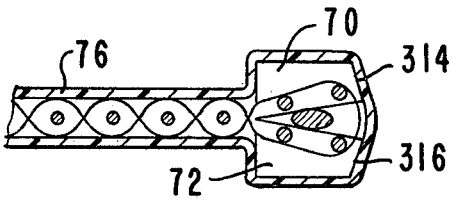
FIG. 6 is a cross section view of the same slide fastener stringer portion of FIG. 5 but after the tape segment applying step as shown in FIG. 3.

During operation of the apparatus of FIG. 1, the stringer 62 is first secured within the holder 46. Then the holder 46 is pushed back into the gapping station 48 in alignment with the gapping mechanism. Operation of the gapping mechanism cuts off the head portions 68 of the coupling elements 66 in a selected section of the stringer 62 leaving the heel portions 70 and 72 (FIG. 6) to form a gap 74 (FIG. 2) in the head portions of the row of coupling elements. The holder 46 is then advanced to the welding station 50 folding a segment 76 of thermoplastic reinforcing tape over both sides of the gapped section of the stringer 62. Operation of the welding mechanism 50 bonds the thermoplastic tape 76 to the opposite sides of the stringer tape 64 and also forms a bifurcated crease or groove 77 as illustrated in FIG. 3 to form a notch-like section between bead-like portions 88 and 90 formed by the remaining heel portions of the coupling elements. After welding, the holder 46 is advanced to the trimming station 52 where operation of the trimming apparatus or mechanism trims portions of the segment 76 of the tape from the outer longitudinal edge of the tape 64 opposite to the elements 66 as well as producing a score line 78 across the stringer 62 as illustrated in FIG. 4 and cutting the notch-like section 77 out to form a notch 80 at the upper edge of the score line 78 in the inner edge of the tape 64. The holder 46 is returned to its home position as shown in FIGS. 1 and 8 where the stringer 62 is released. The stringer length pulling mechanism 54 is operated to pull a predetermined length of stringer past the holder 46 whereupon the holder 46 is again operated to grip the stringer 62 and the gapping and reinforcing cycle is repeated.

Figure 7:
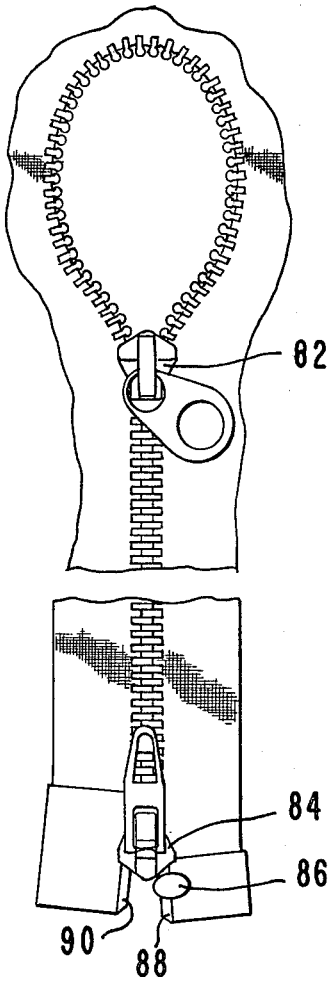
FIG. 7 is a plan view of a single stringer slide fastener illustrating one application of a gapped and reinforced stringer manufactured by the apparatus of FIG. 1.

The score line 78 formed in the stringer section renders the chain readily cuttable into lengths of single slide fastener chain which may be folded and have a pair of sliders 82 and 84 applied thereon together with a stop 86 to secure the sliders on the slide fastener as shown in FIG. 7. The beads 88 and 90 formed by the covered heel portions of the fastening elements at the reinforced ends of the section of slide fastener form respective pin members which cooperate in a conventional manner to form a separable end on the slide fastener.

Dereeling or Feeding

Figure 10:
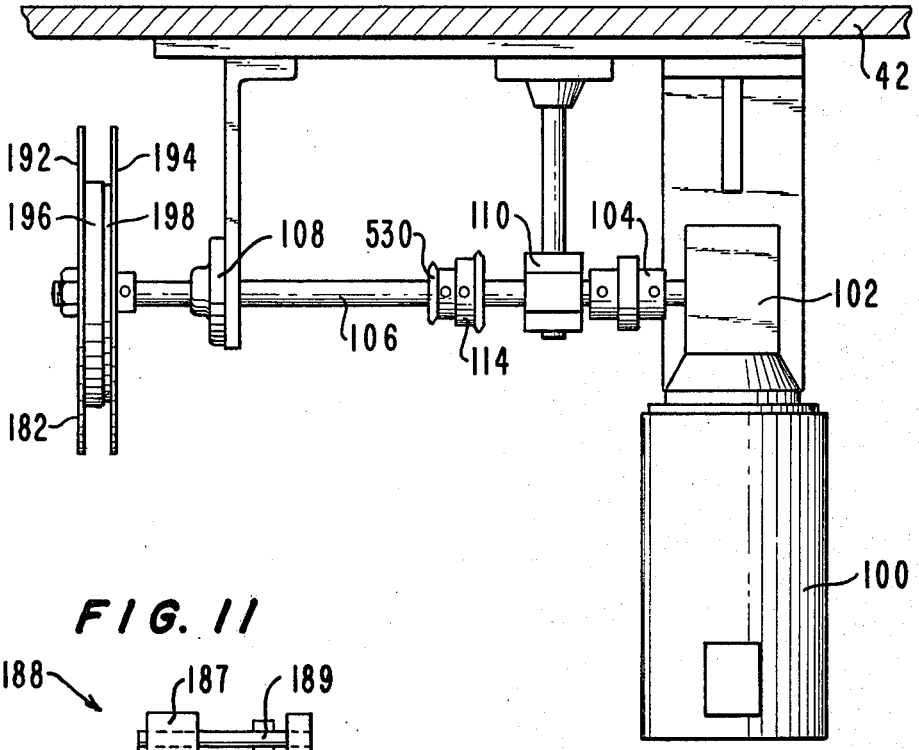
FIG. 10 is a cross sectional elevation view taken from the right side of a portion of a drive mechanism for advancing and retracting a slide fastener stringer.

As shown in FIG. 10, an electric motor 100 suitably mounted on the bottom of the table top 42, and shown in the overall control circuit of FIG. 33 which is described hereinafter, is coupled by a right angle gear box 102 and a coupling 104 to a rotatable shaft 106 supported by bearings 108 and 110 on the underside of the table 42. A chain 112, FIG. 1, meshes with a gear 114 fixedly mounted on the shaft 106 and with a gear 116, FIG. 13, fixedly mounted on a shaft 118 supported by bearings 120 and 122 on the bottom of the right end of the table 42. The shaft 118 is coupled to the input of an electomagnetic clutch 126 by means of a gear 128 mounted on the shaft 118 and a chain 130. The clutch 126 drives a shaft 132 mounted by bearings 134 and 136 in a support 138 mounted on the right end of the table 42. A gear 140 fixed on the shaft 132 meshes with a gear 142 fixed on a shaft 144 rotatable mounted by bearings 146 and 148 on the support 138 and extending to the front of the support 138 and having a holder 141 with an arbor 143, which has an octogonal cross-section for supporting a paperboard reel 150 (FIG. 1) thereon. The holder 141 has hinged flaps 145 which can be pivoted by means of links 147 connected to a collar 149 slidable on the shaft 144 for holding the reel 150 on the arbor 143. The reel 150 is urged in a reverse direction, i.e., to wind the stringer 62 on the reel 150 rather than to unwind the stringer. The magnetic clutch 126 is operated by a reel control circuit 149, shown in FIGS. 33 and 45 and described hereinafter, to apply a select amount of reverse driving tension or to release this tension at selected periods in the cycle of operation of the apparatus.

A detector indicated generally at 154 in FIG. 1, for sensing the end of the stringer 62 on the reel 150, is mounted on the right end of the table top 42 and has a pigtail 133 for directing the stringer onto a roller 135. A pair of spaced rollers 137 and 139 are mounted above and below, respectively, a guide shield 151 for guiding the stringer 62 over the guide shield. A light source 152 is mounted on one side of the guide shield, and a light detector 153 is mounted on the opposite side in alignment with a 0.76 mm (0.03 inch) hole (not shown) through the guide shield. The source 152 and detector 153 are conventional devices operated by a light sensing circuit unit 159, FIG. 45, which operates contacts 155 in the reel control circuit 149 of FIGS. 33 and 45 to sense the absense of the stringer 62 over the hole in the guide 151. The size of the hole in the guide shield 151 is selected to decrease the sensitivity of the detector 153.

A roller 162 and a guide member 163, FIGS. 1 and 8, are mounted on the end of a downwardly spring-biased arm (not shown) which is pivotally mounted on the lower portion of the right side of the frame 42 for guiding the stringer 62 from the detector 154. From the roller 162, the stringer 62 passes up over a guide roller 161 mounted on the right side of the frame 42 adjacent the upper portion thereof and then down through a guide 158 and over a roller 156 mounted on a spring biased arm 160 in front of the substantially similar guide 163 and roller 162.

A clamp arrangement including a stationary member 165 and a movable member 167 mounted on a piston rod of an air cylinder 169 is positioned between the roller 156 and a roller 157 for clamping the stringer 62 when an end is sensed in order to hold the stringer 62 to permit a new reel to be loaded onto the holder 141 and spliced to the end of the held stringer. Conveniently, a conventional heat splicer 171 is mounted on the right end of the table for splicing the new stringer to the old stringer by thermobonding a strip of heatsealable thermoplastic tape wrapped around abutting ends of the new and old stringers.

Figure 13:
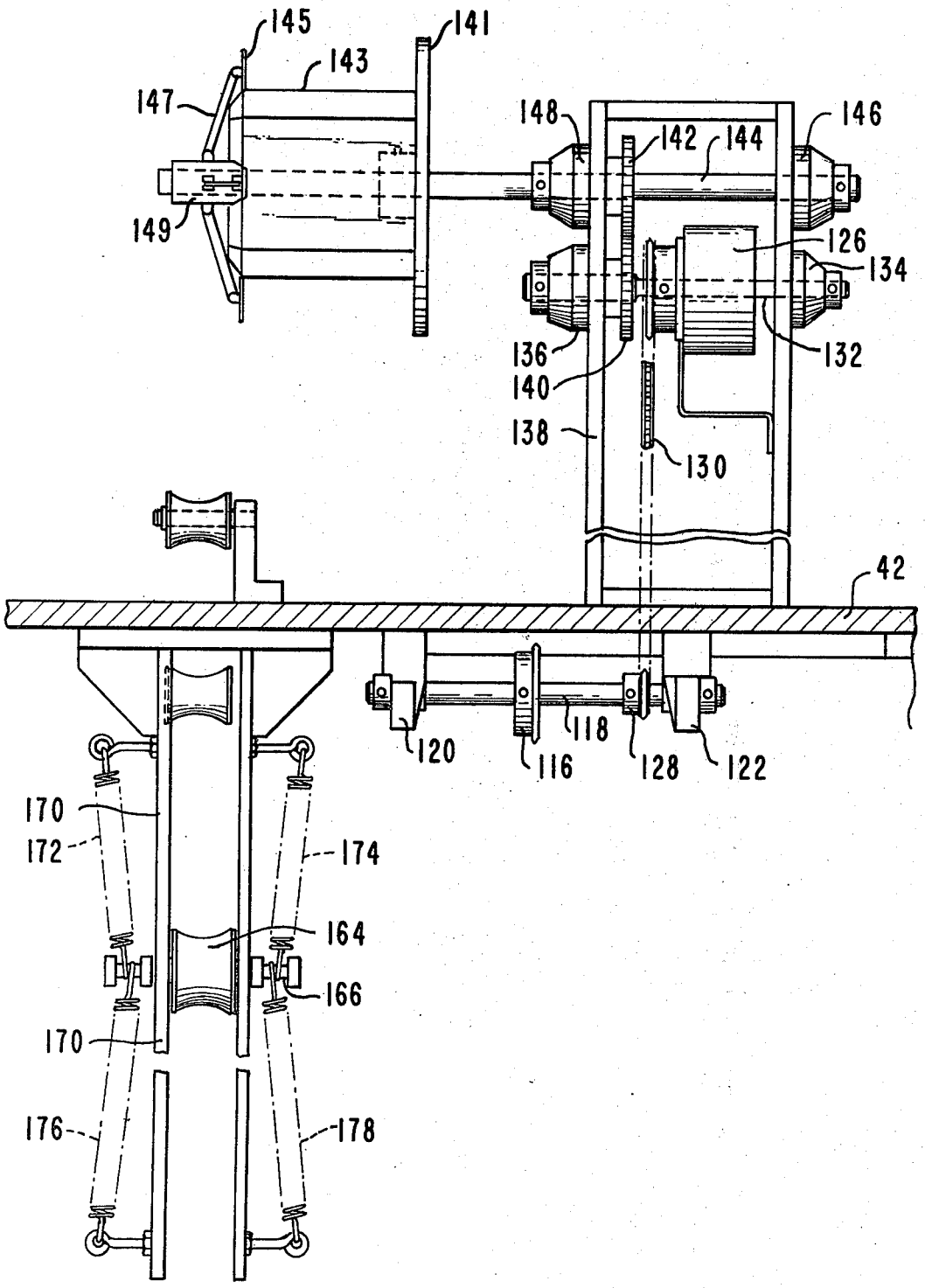
FIG. 13 is an elevation view taken from the right side of a stringer feeding and backward tensioning mechanism of the apparatus of FIG. 1.

The roller 157 is positioned to direct the stringer 62 to a guide roller 164 shown in FIGS. 1 and 13 and which is mounted on a shaft 166 extending through slots 168 in a guide 170 mounted underneath the table 42. Tension springs 172 and 174 extend between the opposite ends of the shaft 166 and eyebolts mounted on the upper portion of the support 170 while tension springs 176 and 178 extend between the opposite ends of the shaft 166 and eyebolts mounted on the lower portion of the support 170 for urging the shaft 166 to a central position in the slots 168. The tensions of the springs 172, 174, 176 and 178 are selected to avoid large tensional forces on the stringer 62 due to inertia of the reel 150 during pulling of the stringer 62 from the feeding and dereeling station.

From the spring biased roller 164, the stringer 62 passes under a guide roller 179 mounted on the base or bottom of the frame 42, over a guide roller 180 mounted just underneath the table top 42, around a wheel 182 mounted on the forward end of the drive shaft 106, through an opening 184 in the table top 42, over a guide roller 186 mounted on top of the table top 142, through a splice detector 188, and through a fixed guide 190 mounted on an extension from the splice detector 188. As shown in FIG. 10, the wheel 182 is formed from a pair of discs 192 and 194 with a friction member of roughened aluminum 196 secured therebetween. The friction member 196 has a groove 198 formed in the rear side thereof for receiving the coupling elements of the stringer 62.

Figure 11:
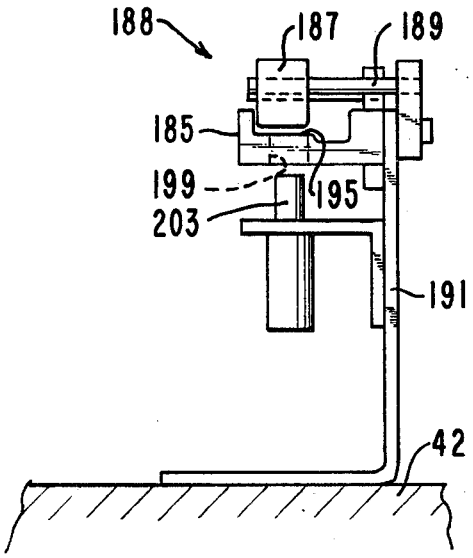
FIG. 11 is a side view of a stringer splice sensing mechanism of the apparatus of FIG. 1.
Figure 38:
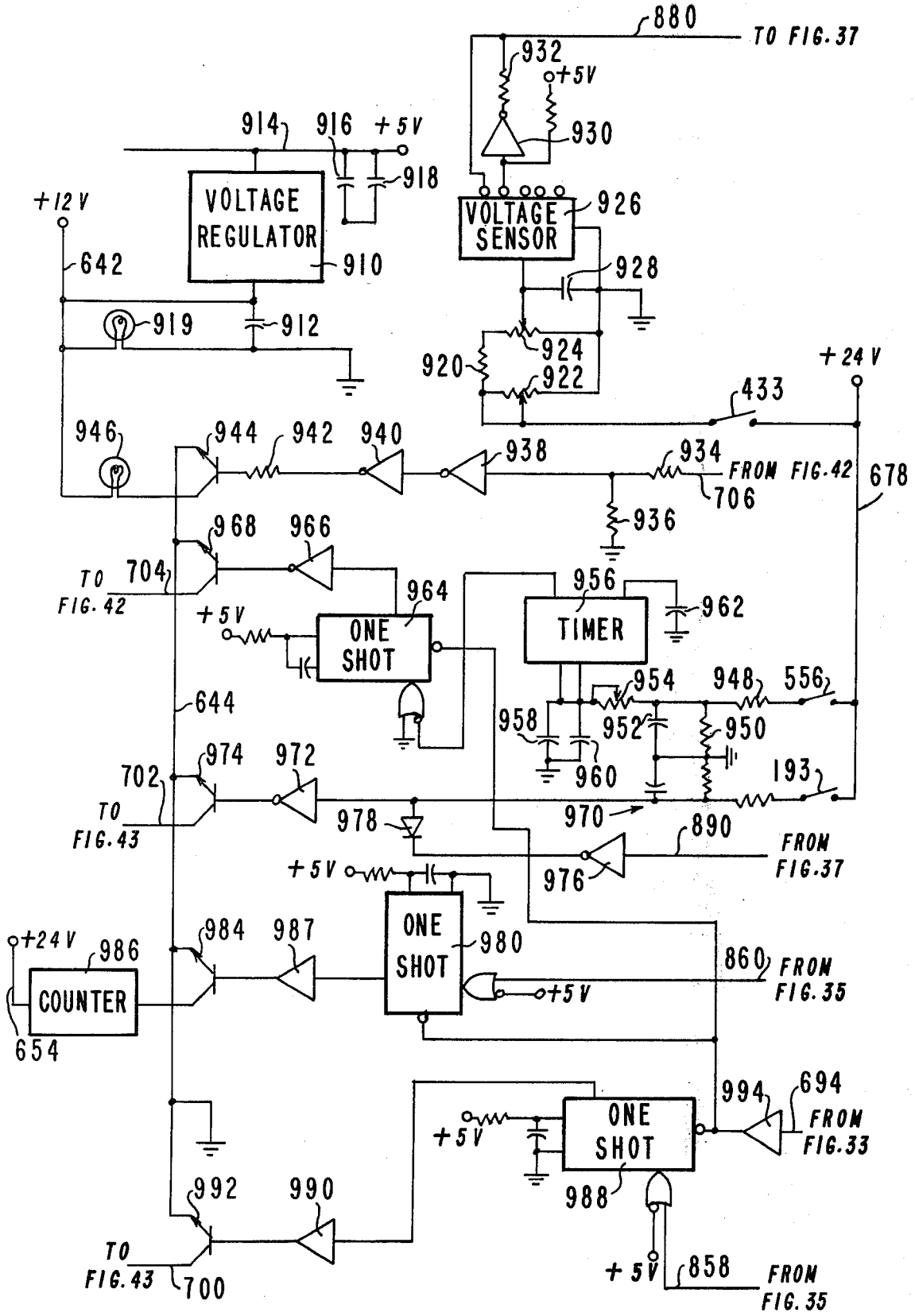
FIG. 38 is a detailed electrical diagram of some other control circuits used in the system control circuitry of FIG. 34.
Figure 46:
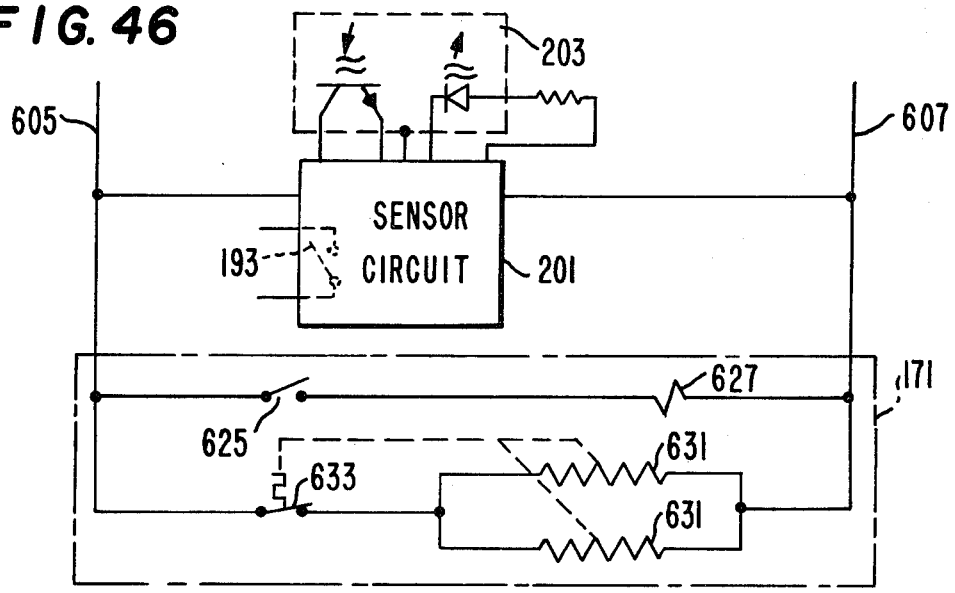
FIG. 46 is a detailed electrical diagram of an additional circuit portion of the control circuitry of FIG. 33.

The splice detector 188, shown in FIG. 11, has a plate member 185 and a light sensing device 203 mounted by a support 191 on the table top 42. A channel 195 is formed in of the plate member 185 for receiving the stringer 62. A guide arm 187, pivoted at one end on a pin 189 suitably mounted on the support 191 for allowing easy insertion of the stringer, is biased by gravity to engage the other end of the arm 187 on an adjustable detent to flatten the stringer tape in the channel as the stringer tape in the channel is pulled therethrough. An opening 199 is formed through the plate 185 in alignment with the device 203 so that the tape of the stringer 62 is exposed for reflecting light from the device 203. As shown in FIG. 46, the device 203 is operated by a circuit unit 201 operating contacts 193 which are also shown in FIG. 38 as a part of a system control circuit 197 in FIGS. 33 and 34. When a splice (made by tape joining two stringer ends together) passes above the device 203, the circuit unit 201 operates the contacts 193 to indicate the presence of a splice in the detector 188.

In operation of the dereeling station 44, a portion of the stringer 62 is pulled from the reel 150 during movement of the holder 46 to the left as viewed in FIGS. 1 and 8 as well as during operation of the pulling station 54. A portion of the stringer 62 is retracted back into the reel 150 during return movement of the holder 46, i.e., to the right as viewed in FIGS. 1 and 8.

During pulling or forward movement of the stringer 62, the stringer 62 around the wheel 182 is tightened against the friction wheel 196 which results in gripping of the stringer to overcome backward tension from inertia of the reel 150 as well as reverse torque from the magnetic clutch 126 for the reel 150; the clutch 126 is released during operation of the pulling mechanism 54. During backward movement of the stringer 62, the stringer around wheel 182 becomes relatively loose and thus is freely pulled backward onto the reel 150 by reverse rotation of the reel 150 produced by the reverse torque through clutch 126. Further during pullback of the holder 46, slack in the stringer 62 resulting from inertia of the reel 150 and holder 141 is taken up by the spring biased arms 160 moving the rollers 156 and 162 downward. The spring biased arms 160 are selected to apply less force than the backward tension applied by the reel 150 through clutch 26 so that roller 156 is normally raised. Excessive tension on the stringer 62 from sudden acceleration and deceleration is prevented by the spring biased roller 164.

In the event an end of the stringer 62 from the the reel 150 is detected by the end of reel detector 154 during a pulling operation by the pulling mechanism 54, the pulling mechanism 54 is stopped and the air cylinder 169 is operated to grip the stringer 62 between clamp members 165 and 167. This prevents the stringer from being pulled or falling from the rollers to the left of the clamp members.

Slidable Holder 46

As shown in FIGS. 14, 15, 16 and 17, the movable holder or clamp 46 has a lower carriage 200, an upper carriage 202 and a cover 204. The lower carriage 200 has a pair of bearing members 205, and 206 slidably supporting holder 46 on a dove tail track 207, see FIGS. 8 and 9, mounted on the table top 42 in front of the stations 48, 50 and 52. The upper carriage 202 has a pair of bearing members 209 and 210 slidably supporting the upper carriage 202 on respective dove tail tracks 211 and 212 mounted on the lower carriage 200 transversely or perpendicular to the track 207. Each of the bearing members 207, 208, 209 and 210 employ conventional means, such as recirculating ball bearing (not shown), to provide accurate and low friction movement of the lower and upper carriages on the dove tail tracks. A handle 214 extends in front of the upper carriage 202 for being grabbed by an operator to aid in moving the holder in longitudinal movement along track 207 and transverse movement toward and from each of the stations 48, 50 and 52. The handle 214 is mounted on the upper carriage 202 by pivots 215 for pivotal movement limited by members 216, and 217 mounted on the upper carriage 202. A compression spring 218 extends between the member 217 and a spring retaining projection on the handle 214 for biasing the handle 214 to a raised position.

Figure 9:
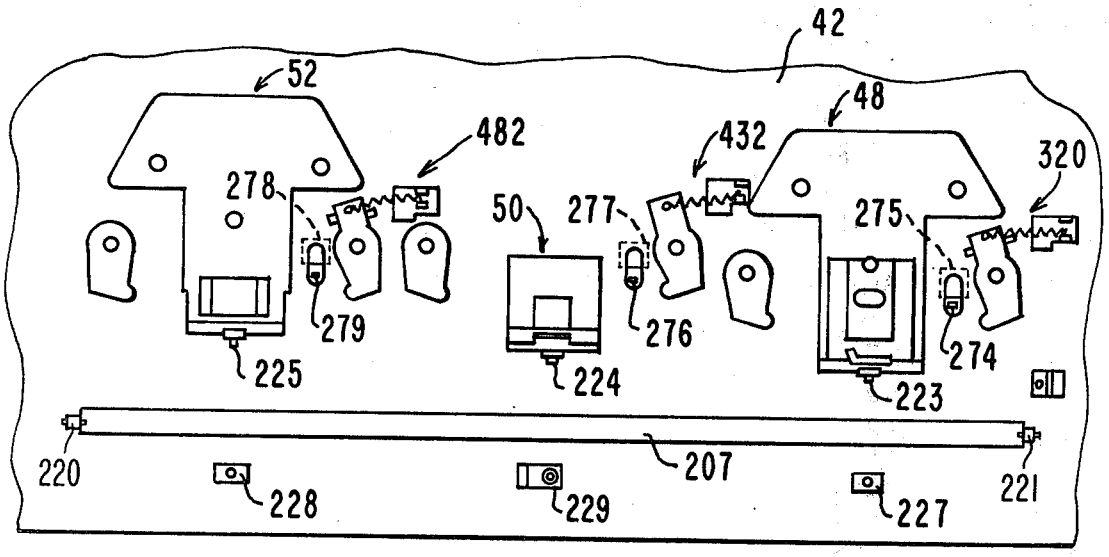
FIG. 9 is an enlarged top plan view of a portion of the apparatus of FIG. 8.

Stops are provided for limiting the longitudinal and transverse movement of the holder 46 including adjustable stops 220 and 221 mounted on the ends of the track 207 for engaging the opposite sides of the lower carriage 200 to limit movement to the lower carriage 200 along the track 207. The upper carriage 202 has a member 222 extending downward into a U-shaped cutout (not shown) open to the rear in the lower carriage 200 for engaging the lower carriage 200 to limit movement of the upper carriage 202 on the tracks 211 and 212 toward the front of the apparatus. Adjustable stops 223, 224, and 225, FIG. 9, are mounted on the respective gapping mechanism 48, the reinforcing tape applying mechanism 50 and the trimming mechanism 52 for engaging a lower extending portion of the upper carriage 202 to limit movement of the upper carriage toward the rear in each of the stations; see the stop 223 and the portion of the carriage 202 in FIG. 21. Detents 227 and 228, FIG. 9, with respective upward extending spring biased balls, are mounted in front of the respective stations 48 and 52 for cooperating with a notch 226 in the bottom of a member 231 mounted on the front of the lower carriage 200 to provide a releasable retaining means by which the holder 46 can be accurately positioned and: retained in front of the respective station 48 or 52. A member 229 has a positive stop and a spring-biased rod protruding upward therefrom and is mounted on a piston rod of an air cylinder 230, FIG. 1, for movement to a raised position from an opening in the table top in front of the reinforcing tape applying station 50. A bore 233 in the bottom of the member 231 is provided to cooperate with the spring biased rod to lock the lower carriage 200 in front of the station 50 while the positive stop engages the member 231 to prevent movement of the holder 46 past the station 50. Spring biased ball retaining members 232 are mounted in the lower carriage 200 for engaging notches (not shown) in the upper carriage 202 to retain the upper carriage in a retracted position, i.e., a position with the upper carriage pulled toward the front of the apparatus away from the respective station 48, 50 or 52.

Figure 17:
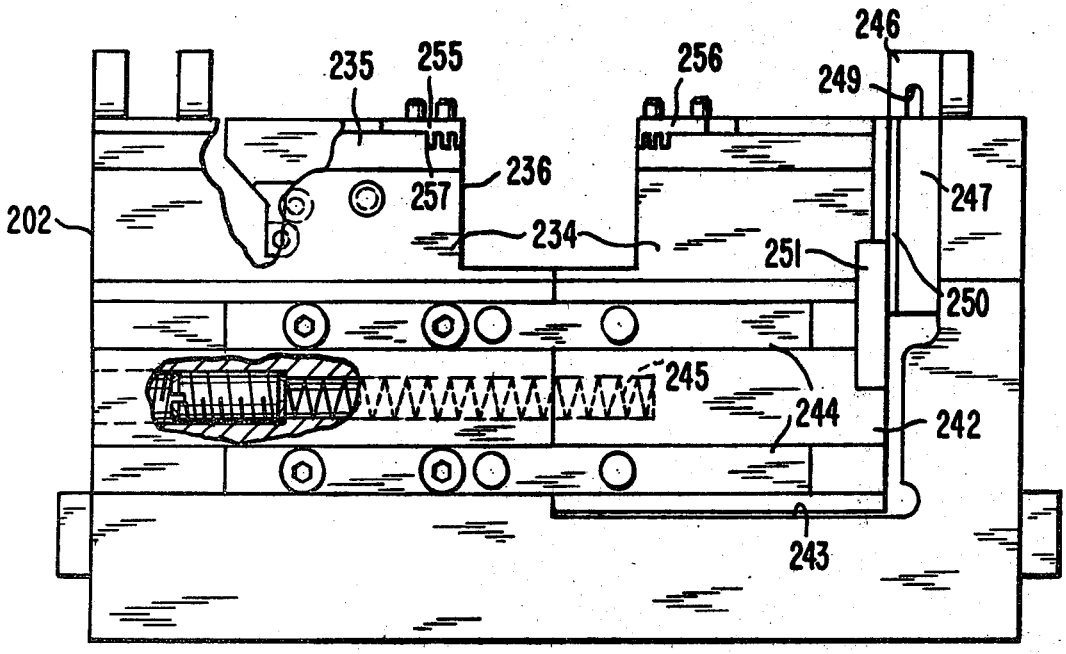
FIG. 17 is a top plan view, with a cover and other portions removed or broken away, of the holder and gripping mechanism of FIG. 14.

The holder 46 has means for gripping the stringer 62 within a longitudinal passage defined by channels 234 formed in the facing surfaces of the upper carriage 202 and cover 204. The channels 234 have enlarged portions 235 for receiving the coupling elements of the slide fastener stringer facing toward the rear of the holder 46. A vertical opening or slot 236 is formed through the rear center portion of the cover 204 as well as the upper carriage 202 for exposing a section of the stringer extending across the opening 236. The cover 214 has knuckles on the rear adjacent the opposite sides which are joined by pins 237 and 238 to knuckles on the upper carriage 202; the pins 237 and 238 being fixed by dowl pins 239 and 240 to the cover knuckles 204 for rotation therewith. A movable plate 242, FIG. 17, is positioned within a recess 243 in the upper right center portion of the carriage 202 extending to the rear thereof. A pair of slide guide bars 244 are fixably mounted in longitudinal grooves extending in the upper left surface portion of the carriage 202 and have right portions which slidingly extend within grooves formed in the upper surface of the plate 242 for guiding and retaining the plate 242 within the recess 243. The stringer receiving channel 234 extends across the rear portion of the plate 242. A compression spring 245 is held at its left end within a longitudinal bore in the right upper portion of the carriage 202 and extends at its right end into a recess in the plate 242 for biasing the plate 242 to the right as viewed in FIG. 17. A camming member 246, FIGS. 14 and 17, is pivotally mounted on the pin 238 and has an arm 247 which extends into a vertical slot in the carriage 202. A pin 248 mounted in the hinge pin 238 protudes from the hinge pin 238 and extends into a slot 249 formed in the camming member 246. A beveled camming surface 250 is formed on the left edge of the arm 247 for engaging a wear member 251 mounted on the right edge of the movable plate 242 when the arm 247 is in a raised position. The length of the slot 249 is selected so that the pin 248 engages one end of the slot to raise the arm 247 to force the moving plate 242 to the left as the cover 204 approaches its fully open position, and the pin 248 engages the opposite end of the slot 249 to lower the arm 247 and permit the spring 245 to move the plate 242 to the right when the cover reaches its fully closed position. The cover 204 has a front portion which extends downward in front of the carriage 202 and has a spring ball plunger located at 241 for engaging a detent (not shown) in the front of the carriage 202 to retain the cover 204 in the closed position. A pair of members 255 and 256 are mounted adjacent the opening 236 on the rear of the upper left portion of the carriage 202 and on the rear of the sliding plate 242, respectively. These members 255 and 256 border the opening 236 and have teeth 257 formed thereon and extending forward into the enlarged portion 235 of the channels 234 for engaging the coupling elements of the slide fastener stringer. A spring plate 258, FIG. 14, is mounted on the bottom side of the cover 204 and has a pair of arms 259 extending to the rear and downward over the channel 234 for engaging the stringer within the channel 234 of the carriage 202 to hold the stringer therein during the closing movement of the cover 204.

Dowl pins 259 and 260 are provided for accurately aligning parts of the carriage 202 together during the assembly thereof while a dowl pin 261 is provided for accurately aligning the track 207 during assembly.

A vertical bore (not shown) is formed into the bottom of the carriage 202 for receiving a plunger 263 extending through a hole in the table top 42 and track 207 from an air cylinder 265 mounted by a bracket 267 on the underside of the table top 42. The air cylinder 265 is controlled by a solenoid valve 285, FIG. 39, which is in the system control circuit 197 of FIGS. 33 and 34, to lock the holder 46 at its home position. A collar 269 is mounted on the plunger 263 for operating a switch 271, also shown in FIG. 37 as part of the system control circuit 197 of FIGS. 33 and 34, to sense the operation of the lock for the holder 46 at the home position.

Figure 16:
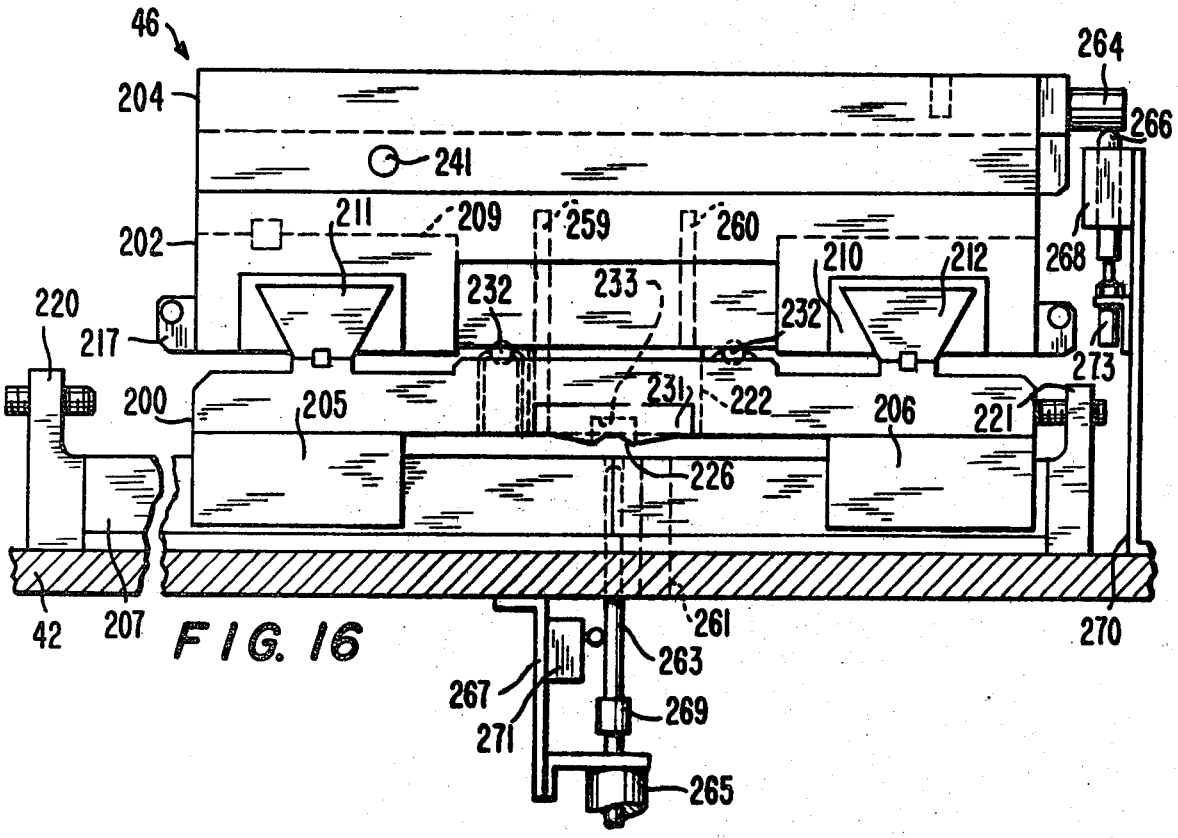
FIG. 16 is front elevational view of the movable holder and gripping mechanism of FIG. 14.
Figure 37:
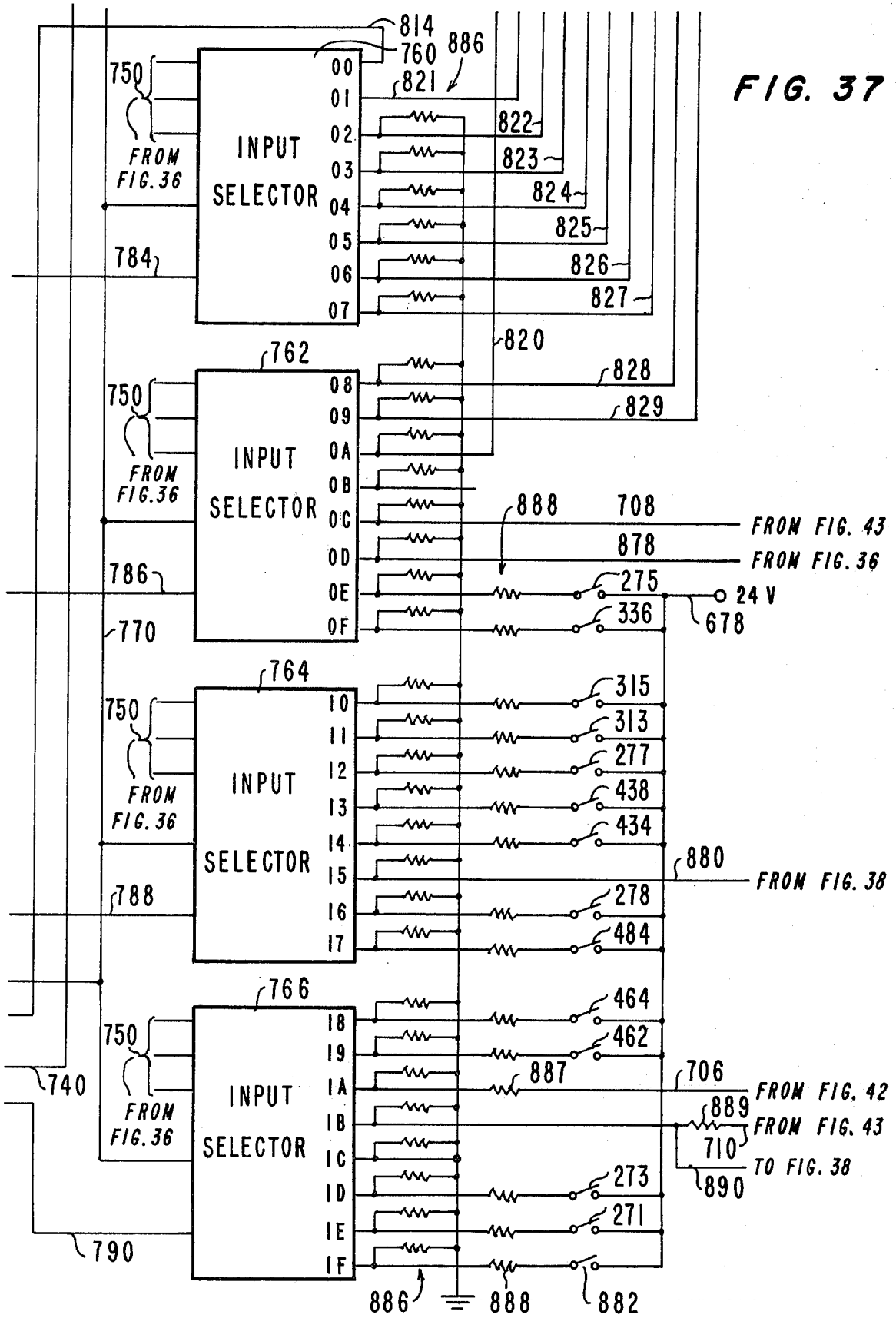
FIG. 37 is a detailed electrical diagram of an input circuit section of the system control circuitry of FIG. 34.

Referring to FIGS. 14, 15 and 16, the hinge pin 238 has an end cam portion 264 which extends to the right side from the holder 46 so that when the holder 46 is in the home position, i.e., to the right front as shown in FIG. 8, the camming portion 264 engages a switch operating member 266 slidably mounted in a block 268 supported by a bracket 270 on the table top 42. The bracket 270 also supports a switch 273 which is engaged by the operator 266. The cam 264 is shaped as shown in FIG. 15 so that when the cover 204 is in the closed position the operator 266 is depressed to operate the switch 273, and when the cover 204 is in the open position the camming portion 264 permits the operator 266 to move to a raised position under the bias of the switch 273 to render the switch 273 to its unoperated condition. The switch 273 is also shown in FIG. 37 as part of the system control circuit 197 of FIGS. 33 and 34. Referring to FIG. 9, switches 275, 277 and 278, also shown in FIG. 37 as part of the system control circuit 197, are mounted underneath the table top 42 and have respective arms 274, 276, and 279 protruding through openings in the table top 42 for being engaged by the rear of the holder 46, see arm 274 in FIGS. 21 and 22, to sense the positioning of the holder 46 at the gapping station 48, the welding or reinforcing-tape applying station 50, and the trimming station 52, respectively.

In operation of the holder 46, FIGS. 14–17, the cover 204 is raised to its open position while the holder 46 is locked by the plunger 263 at its home position. The camming arm 247 engages the member 251 pushing the slide plate 242 to the left as viewed in FIG. 17. The stringer 62 is positioned within the channel 234 across the upper left face of the carriage 202 and the upper face of the sliding plate 242 with the coupling elements in the enlarged portion 235 of the channel and the teeth 257 on the members 255 and 256 engaged with the head portions of the coupling elements of the slide fastener stringer.

The cover 204 is then closed. During the closing movement the camming arm 247 disengages the member 251 releasing the sliding plate 242 which is urged by the spring 245 to the right. This results in the slide fastener being placed under tension across the opening 236. Also during the closing movement of the cover 204, the spring arms 259 engage the stringer 62 to hold the stringer against the carriage 202 in the channel 234 until the cover is completely closed. The section of the slide fastener stringer extending across the opening 236 is fully exposed so that it may be operated on by the gapping mechanism 48, the welding mechanism 50, and the trimming mechanism 52. The closing of the cover 204 pivots the cam arm 264 to depress the operating member 266 which operates switch 273 to cause the control circuitry to retract the air cylinder 265 and plunger 263 to unlock the holder 46 and to permit the holder 46 to be moved.

The operator moves the holder 46 sequentially to the gapping station 48, to the welding station 50, to the trimming station 52, and back to its home position while operations are performed on the stringer section exposed in the opening 236. First, the operator pushes the upper carriage 202 to the gapping station 48; the lower carriage 200 is retained in front of the gapping station by the spring ball 227 engaging the detent member 231. Upon successful completion of a gapping cycle, the air cylinder 230 is operated to raise the spring plunger 229 in position to be engaged by the detent member 231. The carriage 202 is retracted and the holder 46 is moved along the rail 207 to the welding station 50; force by the operator overcoming the retaining force of the ball member 227 at the gapping station. When the holder approaches the welding station 50, a camming surface on the member 231 depresses the spring biased rod in the plunger 229 until the positive stop is engaged and the rod reaches the bore 233. The rod is moved into the bore by its spring bias to lock the lower carriage 200 in alignment with the welding station 52 where the upper carriage 202 is again advanced. After completion of a welding cycle, the plunger 229 is retracted and the carriage 202 is retracted from the welding station 50. The holder is moved to the trimming station 52; the spring ball member 228 positions the holder at the trimming station while the carriage 202 is advanced. After a trimming cycle, the holder 46 is returned to the home position, the holder 46 is locked by the plunger 263, the cover 204 is opened, and a selected length of stringer is pulled past the holder 46 to place the apparatus in condition for the next cycle.

Gapping or Element Removal Station 48

As shown in FIG. 18, the gapping mechanism 48 includes a base 280 mounted on the table 42 with an upper plate 282 supported on the base 280 by rear support members 284 and a forward shaft 286 which is threaded into an easily removable block secured to the upper plate 282. A slidable carriage 288 intermediate the upper supporting plate 282 and the base 280 is slidable on the shaft 286 and a pair of rear shafts 290 and 292, the shafts 286, 290 and 292 being arranged in a triangular arrangement. An air cylinder 294 is pivotally mounted on the common pivot junction at one ends of link pairs 293 and 295 (only one of each pair shown) which have their other ends pivotally connected to the front of the upper support plate 282 and the movable carriage member 288. A piston rod 296 of the air cylinder 294 is joined to the knee of a toggle linkage 298 connected between the upper support plate 282 and the movable carriage member 288. An upper pinching blade 300 is mounted by a block member 302 on the bottom of the movable carriage 288 while a lower blade 304 is mounted by a block 306 on the base 280 in alignment with the blade 300. The blades 300 and 304 have matching configurations which as shown in FIGS. 19 and 20 includes an element cutting portion 308 which at the left side angles rearward in a portion 310. The block 306 has an opening 309 which extends through the table top 42 to provide a passage for portions of elements cut from the slide fastener stringer. Magnetic-operated sensing switches 313 and 315 are adjustably mounted on the air cylinder 294 in position to be operated by a magnetic piston member 317 of the air cylinder 294 to sense the fully operated and unoperated position, respectively, of the gapping mechanism 48. The switches 313 and 315 are also shown in FIG. 37 as part of the system control circuit in FIGS. 33 and 34.

Figure 21:
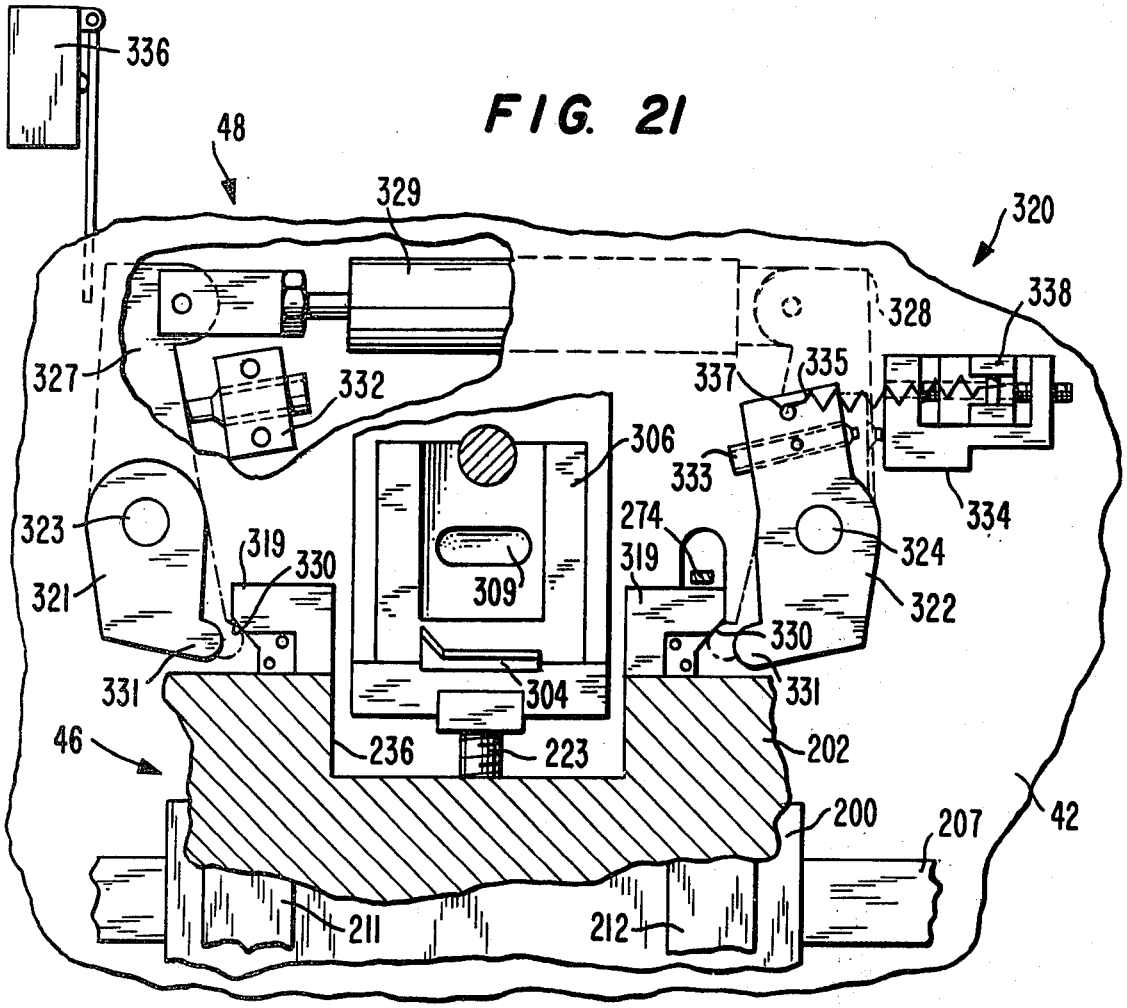
FIG. 21 is a plan view of a locking mechanism for locking the movable holder and gripping mechanism at the gapping mechanism of FIG. 18.
Figure 22:
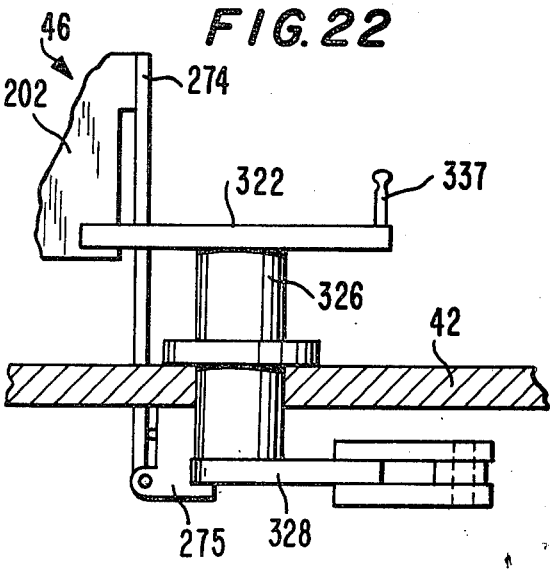
FIG. 22 is a side elevation view taken from the right of one member of the locking mechanism of FIG. 21.
Figure 23:
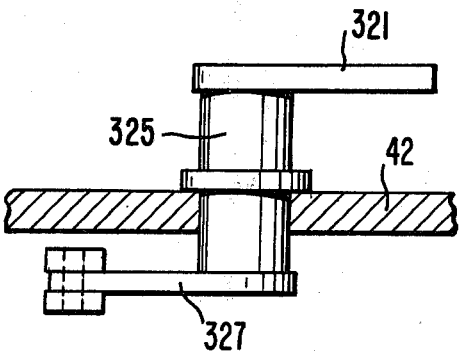
FIG. 23 is a side elevation taken from the left of another member of the locking mechanism of FIG. 21.

As shown in FIGS. 21, 22 and 23, the gapping station includes a locking mechanism indicated generally at 320. The sliding holder 46 includes a pair of positioning members 319 mounted on the upper carriage 202 within recesses formed at the rear on opposite sides of the central opening 236. Locking arms 321 and 322 are fixably mounted on upper ends of shafts 323 and 324 which extend through shaft housing 325 and 326 mounted in respective openings in the table top 42. The lower ends of the shafts 323 and 324 are fixed on one ends of respective levers 327 and 328 which extend toward the rear of the apparatus and have the other ends attached to an air cylinder 329 interposed between the levers 327 and 328. The housings 325 and 326 and shafts 323 and 324 extend above the table 42 to bring the locking arms 321 and 322 in alignment with the positioning members 319. The positioning members 319 have respective camming surface 330 formed at a 45 degree angle to the longitudinal and transverse directions of the apparatus with the surfaces 330 facing the outward toward the front of the apparatus. The arms 321 and 322 extend forward from the axis of rotation to the shafts 323 and 324 and have respective camming projections 331 for engaging the camming surfaces 330 of the holder 46. An adjustable stop 332 is mounted on the bottom side of the table 42 for engaging an inner edge of the lever 327 and an adjustable stop pin 333 is mounted in a rearward extending extension of the arm 322 for engaging a stop block 334 mounted on the upper side of the table 42. The arms 321 and 322 as well as the levers 327 and 328 are biased clockwise, as viewed in FIG. 21, by a tension spring 335 extending between a pin 337 on the rear extention of the arm 322 and an adjustable pin block 338 mounted in the block 334. A switch 336, also shown in FIG. 37, is mounted on the bottom side of the table top 42 and has an arm extending to be engaged by the outer edge of the lever 327 when the lever 327 rotates to a counter clockwise position.

When the movable holder 46 is moved to the gapping station to engage the stop 223, the head portions of the coupling elements 66 on the stringer 62 are aligned between the cutting edges of the blades 300 and 304. The air cylinder 329 is operated to rotate the arms 321 and 322 to the positions shown by the long and short dashed lines where the projections 331 engage the surfaces 330. In the rest position, i.e., when the arms 321 and 322 are pivoted apart as shown in FIG. 21, the lever 327 is pulled clockwise by the force of the spring 335 transmitted through the arm 322, shaft 324, lever 328 and air cylinder 329 to engage the stop 332 determining the open position of the locking arms 321 and 322. When the air cylinder 329 operates, the arm 322 first rotates clockwise until the stop screw 333 engages the block 334, and then the arm 321 rotates counterclockwise; thus the closed position of the arms 321 and 322 is determined by the stop screw 333 and block 334. Camming action between the projections 331 and surfaces 330 insure accurate and tight clamping of the holder 48.

Operation of the gapping mechanism then cuts the head portions of the elements 66 from the stringer 62 in the section of the stringer aligned with the cutting blades 300 and 304. The angle portion 310 of the cutting blades 300 and 304 cuts the element head portion at an angle at the leading edge of the section of stringer being gapped. Having the first element above the pin member 90, FIG. 4, cut at an angle towards the pin member 90 renders the pin member 90 easier to assemble through both of the sliders 82 and 84 when the slide fastener is separated. It is also noted that the forward edges of the blades 300 and 304 are formed at an angle or a bevel 312. This results in a pinching or forming of the beveled leading edges 314 and 316, FIG. 6, of the leg portions 70 and 72 remaining on the slide fastener stringer and in rounding of the pin structure 90 to make the pin 90 easier to insert through the sliders 82 and 84.

Welding Station 50

As shown in FIG. 1, an automatic tape dispenser 340 for the thermoplastic tape 76 is mounted on the bottom frame of the table 42. The dispenser is a conventional tape dispenser which has a spring biased arm with a roller engaging a loop in the tape 76 for rotating a roll of tape on an arbor to feed more tape when the loop size is too small. The tape 76 is a dual layer having an outer layer of clear nylon 6 and an inner layer of a clear blend of nylon 6 and nylon 6—6 containing from 25 to 30% by weight of the nylon 6—6 with the remaining portion being nylon 6. The film 76 is about 0.152 mm (6 mils) thick with the thickness divided equally between the outer cover layer and the inner adhesive layer.

Figure 24:
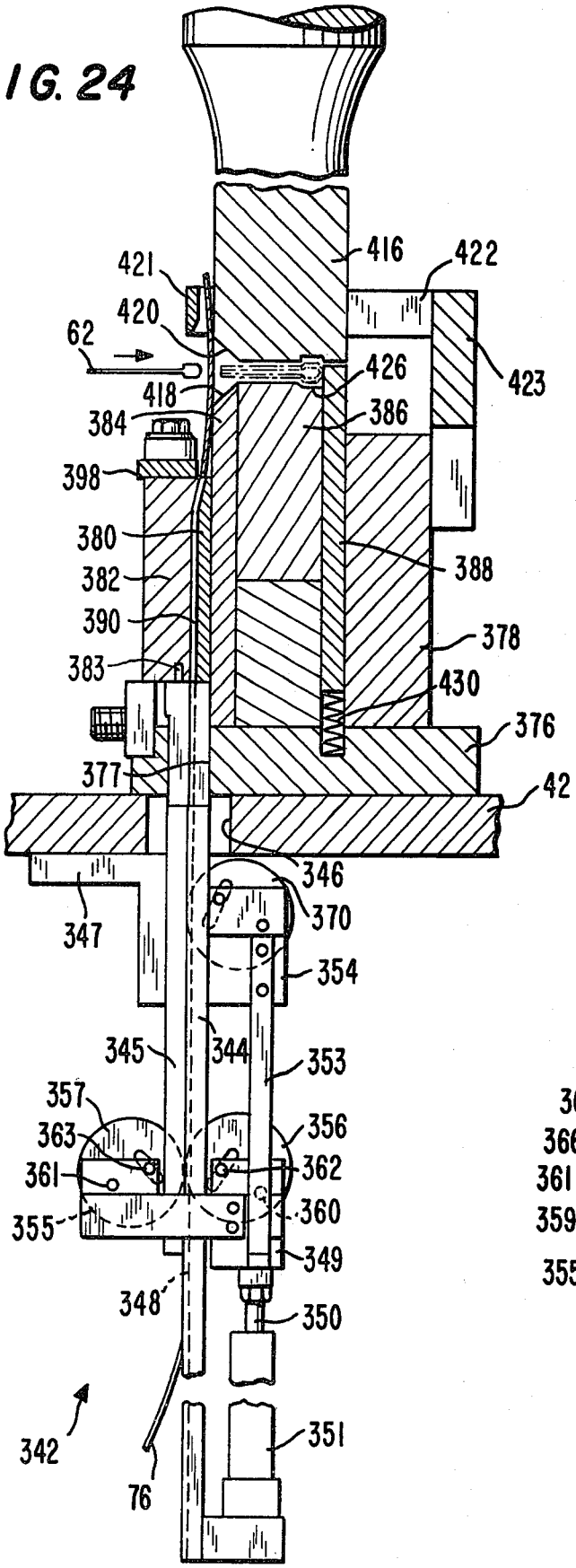
FIG. 24 is an elevational section view taken from the right of a reinforcing tape applying mechanism of the apparatus of FIG. 1.
Figure 25:
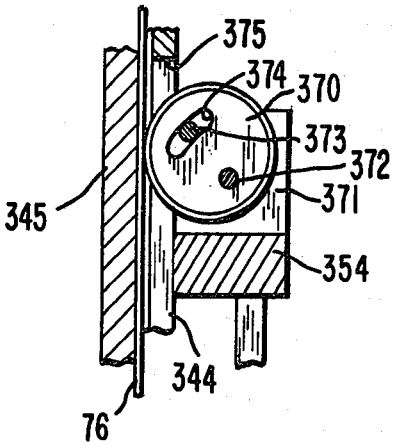
FIG. 25 is a section view of a stationary reinforcing tape gripping member of the tape applying mechanism of FIG. 24.
Figure 26:
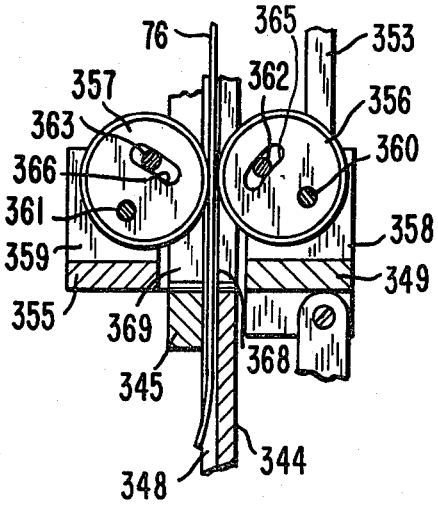
FIG. 26 is a section view of movable tape gripping members of the tape applying mechanism of FIG. 24.

A tape segment feeder, indicated generally at 342, is mounted underneath the table top 42 for receiving the leading end of the tape 76 from the dispenser 340. As shown in FIGS. 24, 25 and 26, the tape segment feeder 342 includes a pair of plates 344 and 345 secured together with the upper ends thereof extending through an opening 346 in the table top 42. A bracket 347 secures the plates 344 and 345 to the bottom side of the table top 42. A channel 348 is formed in the plate 344 for forming a passage between the plates 344 and 345 to pass the tape 76. A movable block 349 is mounted on the end of a piston rod 350 which extends from an air cylinder 351 mounted on the lower end of the plate 344. Slide guide bars 353 mounted on a stationary block 354 secured to the plate 344 extend in slots on opposite sides of the movable block 349 for guiding the block 349. A second movable block 355 has arms which extend around the plates 344 and 345 and are attached to the first movable block 349 so that the blocks 349 and 355 are mounted and movable together. Wheels 356 and 357 having rubber O-rings mounted in grooved surfaces around the periphery thereof are pivotally mounted within slots 358 and 359 of the respective movable members 349 and 355 by pins 360 and 361 which are eccentric relative to the center of the wheels 356 and 357. Pins 362 and 363 mounted in the members 349 and 355 extend through arcuate slots 365 and 366 formed in the wheels 356 and 357 for limiting pivotal movement of the wheels. The wheels are biased by gravity into slots 368 and 369 formed in the plates 344 and 345 for engaging the tape 76 on the opposite sides thereof extending in the channel 348 between the plates 344 and 345. The pins 362 and 363 and the slots 365 and 366 are selected to prevent the wheels 356 and 357 from pivoting about the pins 360 and 361 to pass over center and disengage the tape 76. A similar wheel 370 with a resilient facing is pivotally mounted by a pin 372 within a slot 371 of the stationary member 354. The pin 372 is eccentric to the center of the wheel 370 so that the wheel 370 is biased by gravity into a slot 375 through the plate 344 against the tape 76. A pin 373 mounted in the block 374 extends through an arcuate slot 374 in the wheel 370 to prevent pivoting of the wheel 370 over center which would disengage the wheel 370 from the tape 76.

A base 376 for an anvil and cutting portion of the welding station is mounted on top of the table 42 and has an opening 377 through which the upper ends of the plates 344 and 345 extend. A holding block 378 with a U-shaped horizontal cross section is mounted on top of the base 376 and extends upward with the opening of the U-cross section of the block 378 facing toward the front. Mounted on the front of the block 378 are a pair of members 380 and 382; the member 382 having bores receiving locating pins 383 mounted in the upper end of the plate 345. A vertical passageway 390 formed between the members 380 and 382 communicates with the upper end of the channel 348 in the plate 344 for receiving the tape 76. A front guide member 384, an anvil 386 and a rear slidable plate member 388 are contained within the U-opening of the block 378 behind the member 380, and have upper portions extending above the block 378.

Figure 27:
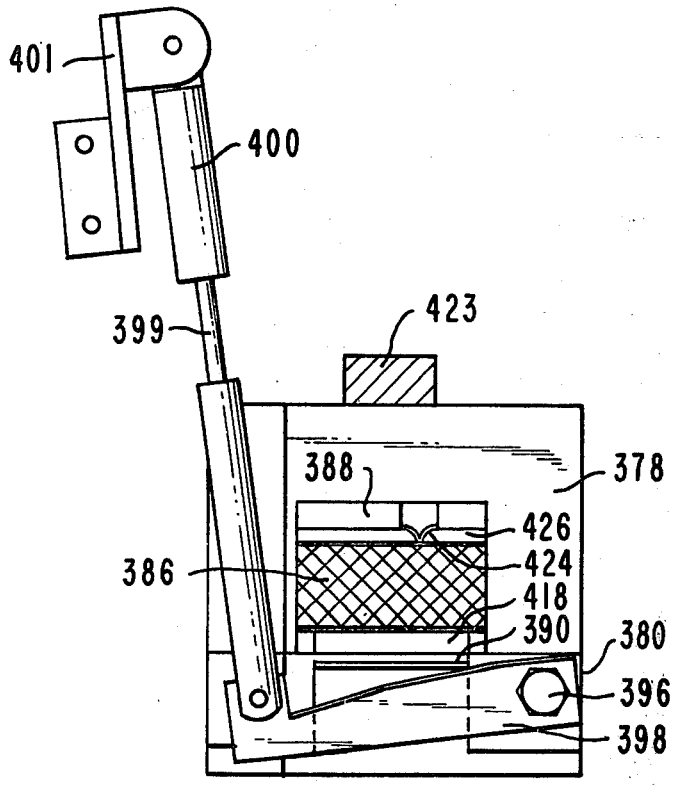
FIG. 27 is a plan view, partially in section, of a tape cutting and anvil portion of the tape applying mechanism of FIG. 24.

A cutting blade 398, shown in FIG. 27, is pivotally attached at one end by a pivot bolt 396 on top of the rear member 380. The other end of the cutting blade 398, is pivotally attached to an extension of a piston rod 399 extending from an air cylinder 400 pivotally mounted on a bracket 401 secured to the table top. The top front edge of the member 380 at the upper opening of the passageway 390 is formed to cooperate with the cutting edge of the knife blade 398 to cut the tape 76.

Figure 39:
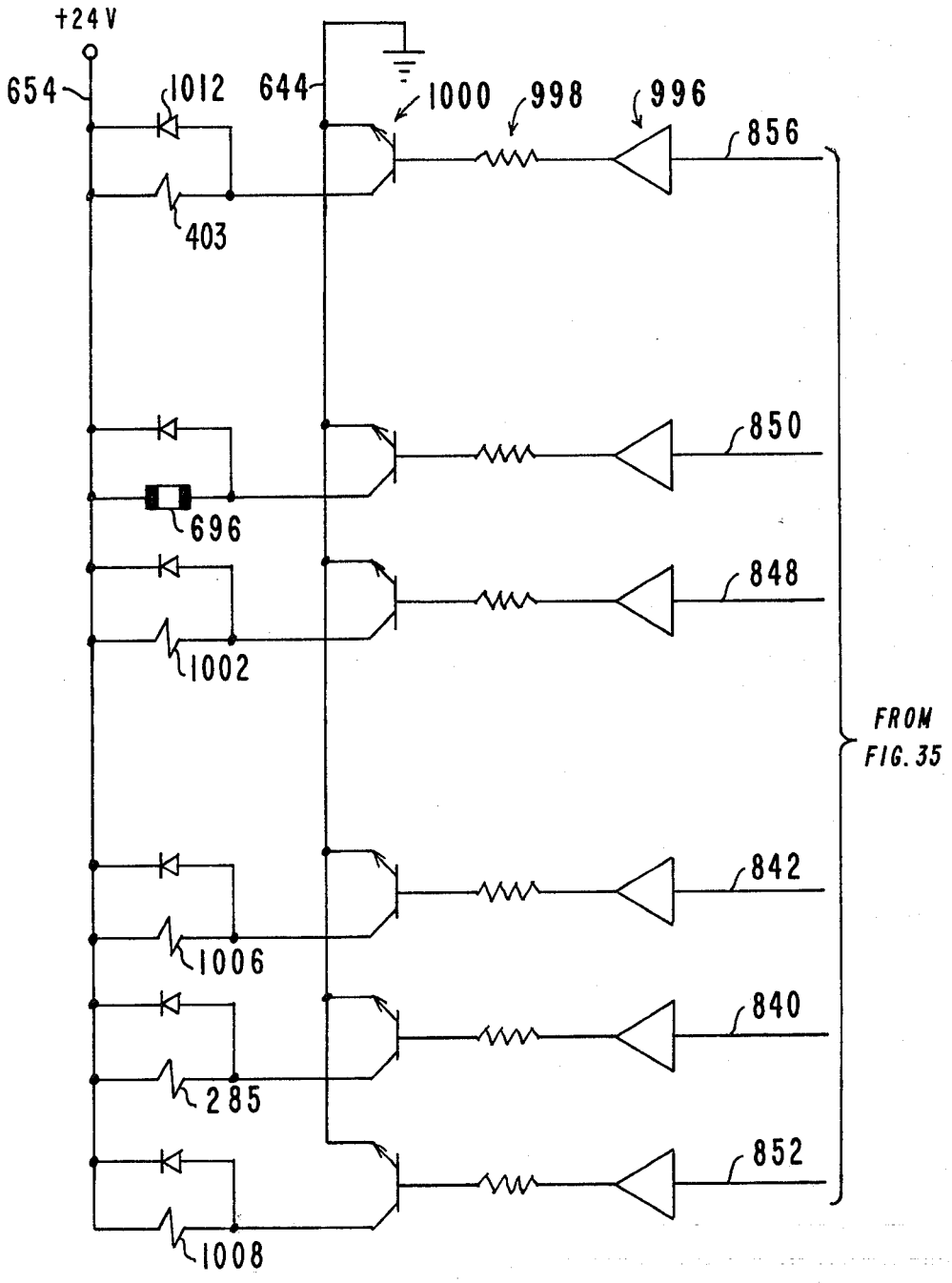
FIG. 39 is a detailed electrical diagram of a driver section of the system control circuits of FIG. 34.
Figure 47:
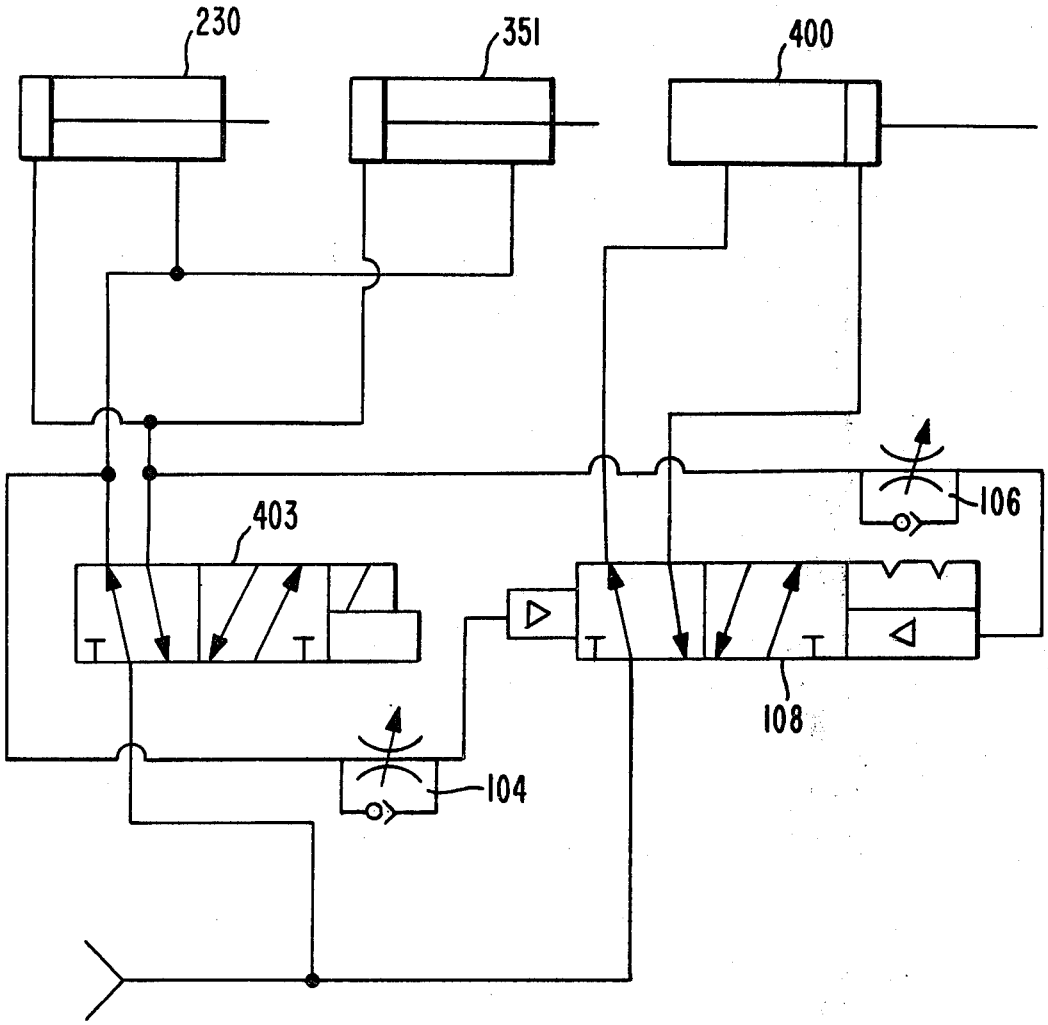
FIG. 47 is a diagram of a pneumatic control arrangement for the reinforcing tape applying mechanism of FIGS. 24 and 27.

Referring to FIG. 47, the air cylinders 230 and 351 operating the stop member 229 of FIG. 9 and reinforcing tape feeding mechanism 342 of FIG. 24 are connected in parallel to the outputs of a four way solenoid valve 403 which is also shown in the solenoid driver circuitry of FIG. 39. The outputs of the solenoid valve 403 are also connected by respective pneumatic delays 404 and 406 to the control inputs of a pneumatic controlled 4-way valve 408 which has its outputs connected to the respective advance and retract inputs of the air cylinder 400 operating the cutter 398 of FIG. 27.

Figure 28:
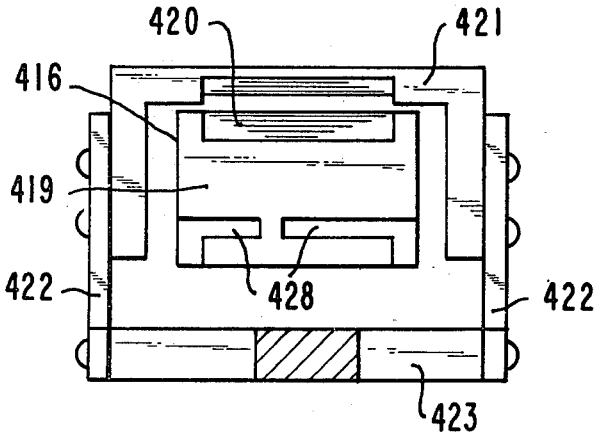
FIG. 28 is a bottom view, partially in section, of the welding horn tip and upper portion of the tape applying mechanism of FIG. 24.

As shown in FIG. 1, the welding station includes a conventional ultrasonic welding uni 414, such as model No. 490 from Branson Sonic Power Co., Danburg, Conn., which supports an ultrasonic horn 416, FIGS. 24 and 28, over the front member 384, the anvil 386 and the vertical sliding member 388. The guide member 384 has an upper central surface 418 which is sloped downwardly toward the front and the tip of horn 416 on its bottom forward edge has a central bevel surface 420 sloping upwardly toward the front so that the tape segment cut from the tape 76 is easily guided and folded over the stringer 62 as the stringer 62 is inserted between the horn tip 416 and the anvil 386. A guide 421 is adjustable positioned by arms 422 extending from a support 423 secured on the rear of the holding block 378 for holding the tape segment in position in front of the surfaces 418 and 420. The back sliding member 388 extends above the upper surface of the anvil 386 to a raised position next to the tip of horn 416 to form a backwall for engaging the folded edge of the tap segment and forcing the cut edges of the fastening elements on the slide fastener stringer firmly against the tape segment 76 at the wall 388. The back sliding member 388 is biased upward by a spring 430 so that the plate 388 slides downward as the horn tip 416 is lowered during welding of the thermoplastic tape section 76 onto the stringer 62. The upper surface of the anvil 386 is knurled while the bottom surface 419 of the horn tip as shown in FIG. 28 is flat. A scoring edge 424, FIG. 23, is mounted at the rear of the upper portion of the anvil 386 and extends slightly above the upper surface of the anvil 386 for forming the groove 77, FIG. 3, in the slide fastener stringer 62. A channel 426 is formed in the anvil 386 while a mating channel 428 is formed in the bottom of the horn tip 416 for accommodating the leg portions of the cut coupling elements and to firmly form the tape therearound to form the pin members 88 and 90, FIG. 4. The edge bordering the front of the channel 426 is beveled to keep the heels of the fastening elements from rotating when the horn is lowered.

A switch 433, FIGS. 1 and 38, and a switch 434, FIGS. 1 and 37 are positioned in the welding mechanism 414 to be operated by a conventional cam (not shown) on a ram member (not shown) of mechanism 414 when the horn tip 416 is at its lowermost position to sense operation of the welder 414 and at its raised position, respectively.

As shown in FIG. 9, the welding station 50 includes locking mechanism 432 identical to the locking mechanism 320 of the gapping station 48. A switch 438, shown only in FIG. 37 and similar to the switch 336 of the locking mechanism 320 of FIG. 21, is provided in the locking mechanism 432 to sense the locking of the holder 46 at the welding station.

In operation of the welding station, the air cylinders 230, FIG. 1, and 351, FIG. 24, are operated after the completion of a gapping cycle to raise the stop and lock member 229 FIG. 9 and aid in positioning the holder 46 and to operate the reinforcing tape feeder 342, FIG. 24. In the feeder 342, the operation of the air cylinder 351 advances the piston rod 350 to move the movable blocks 349 and 355. The wheels 356 and 357 engage the opposite sides of the reinforcing tape 76 and advance the tape upward within the channel 348 and the channel 390 to a raised position as shown in FIG. 24. It is noted that the upper end of the channel 390 is formed at an angle toward the front of the guide member 384 to insure that the tape 76 is disposed adjacent the guide member 384 and the front of the horn tip 416. The wheel 370 due to the upward force of the tape 76 pivots sufficiency away from the plate 345 to permit the tape 76 to slide upward. However the wheel 370 prevents retraction of the tape 76 due to a pinching action between the wheel 370 and plate 345 upon attempted downward movement of the tape 76.

After the tape 76 has been advanced to a raised position, the air cylinder 400, FIG. 27, is operated to retract the piston rod 399 and operate the cutting blade 398 to sever the segment of reinforcing tape extending above the cutting blade. The cutting blade 398 together with the guide 421, FIGS. 24 and 28, hold the severed segment of tape 76 in front of the beveled surfaces 418 and 420 of the guide member 384 and the horn tip 416.

The holder 46 is then advanced into the welding station. The section of slide fastener stringer 62 supported across the opening 236, FIG. 14, in the holder 46 engages the tape 76 which is forced into the opening between the horn tip 416 and the anvil 386. Movement of the stringer 62 wraps the severed segment of the tape 76 over the gapped edge of the stringer 62 and brings such wrapped edge into engagement with the rear wall 388. After locking of the holder 46 in the welding station, the ultrasonic welding mechanism 414, FIG. 1, is operated to lower the horn tip 416 and weld the severed segment of the tap 76 to both sides of the stringer 62. During the welding, the rule edge 424 forms the notch-like section 77, FIG. 3, on the stringer 62.

After completion of the welding, the locking mechanism 432 is released and the holder 46 is pulled from the welding station. The air cylinders 230, 351 and 400 are retracted to lower plunger 229, FIG. 9, to move the gripping members or wheels 356 and 357 downward, and to return the knife blade 398 to the open position. The wheel 370 grips the tape 76 to hold the tape 76 while the wheels 356 and 357 slide over the tape during the retraction of the air cylinder 351.

Trimming Station 52

The trimming mechanism 52, illustrated in FIGS. 1, 29, 30 and 31, includes a frame or support and an operating mechanism, similar to that of the gapping mechanism 48 shown in FIG. 18, including a base 440 and a carriage 442 slidably mounted on three shafts (only 444 shown in FIG. 29) for vertical movement. The moveable carriage 442 is operated by an air cylinder (not shown) and toggle linkage (not shown) similar to the gapping device 48.

However the trimming station 52 includes an anvil 446 mounted on the base 440, and first and second cutting members 448 and 450 mounted by a support block 452 on the carriage 442. The cutting member 448 has a cutting edge 454 for cooperating with an upper flat surface 456 of the anvil 446 to cut off excess tape 76 extending past the stringer tape 64, as shown in FIG. 4. The member 450 has a cutting edge 458 thereon to form the scoreline 78, FIG. 4, across the stringer 62. The front portion (left portion as viewed in FIG. 29) of the cutting edge 458 is formed to extend downward slightly less than the cutting edge 454 so as to prevent cutting completely through the stringer 62; this portion further forms the scoreline 78 so that the stringer may be easily cut. The rear portion (right portion as viewed in FIGS. 29 and 30) of the cutting edge 458 is bifurcated to cut out the portion of the stringer 62 at the notch 80, FIG. 4.

The trimming mechanism 52 is also provided with two switches 462 and 464, shown only in FIG. 37, which are substantially identical in structure and operation to the respective switches 313 and 315, FIG. 18, of the gapping mechanism.

A locking mechanism 482, as shown in FIG. 9 is associated with the trimming station 52. The locking mechanism 482 is substantially identical to the locking mechanism 320 described above in connection with the gapping station 48. A switch 484, shown only in FIG. 37 and similar to the switch 336 of the locking mechanism 320 of FIG. 21, is provided in the locking mechanism 482 to sense the locking of the welding station.

Figure 29:
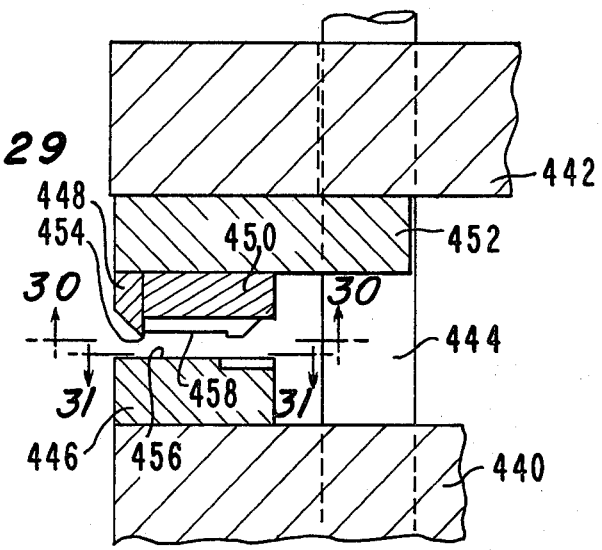
FIG. 29 is a side view taken from the right side of a portion of a tape trimming and scoring mechanism of the apparatus of FIG. 1.
Figure 30:
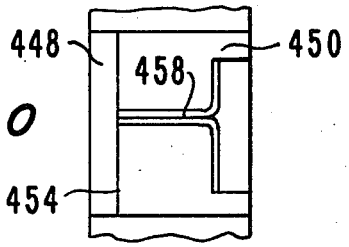
FIG. 30 is a bottom view of a trimming blade assembly in the mechanism of FIG. 29.
Figure 31:
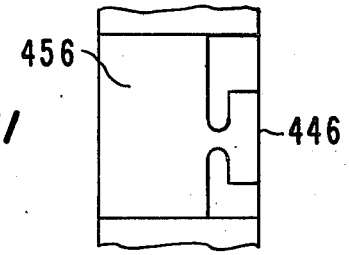
FIG. 31 is a top plan view of an anvil in the trimming mechanism of FIG. 29.

In operation of the trimming mechanism 52, the stringer section exposed in the holder 46 is moved to a position between the anvil 456 and the arrangement of cutting members 448 and 450, FIG. 29. The locking mechanism 482, FIG. 9, is operated to lock the holder 46 at the trimming station. Then the gapping mechanism is operated to cut off the excess length of the thermoplastic tape 76, FIG. 3, on the stringer 62 as well as complete the cutting of the notch 80. The locking mechanism 482 is released to permit The holder 46 to be moved back to its home position.

Stringer Length Pulling Mechanism 54

After the trimming station 52, the stringer 62 passes through a guide 490, FIG. 1, and through a slack takeup assembly which includes a pair of vertically elongated members 492 mounted through an opening in the table top 42 and extending above the table. Each of the members 492 has a vertical slot 494 extending to the upper and lower ends thereof and slidably receiving a shaft of a roller 498 under which the stringer 62 passes. The weight of the roller 498 and its shaft is less than the normal tension on the stringer 62 but is sufficient to pull up slack in the stringer 62 to the left of the holder 46 when the holder 46 is moved to the weld station 50 and the trim station 52.

Figure 12:
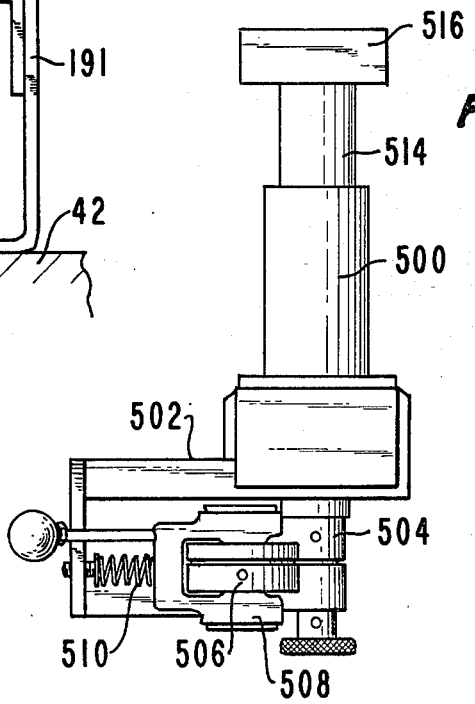
FIG. 12 is a top plan view of a mechanism for pulling and measuring a length of slide fastener stringer in the apparatus of FIG. 1.

Also at the station 54 after the slack take-up assembly, an electrical direct current motor 500, FIG. 12, is mounted by a support on the table top. A knurled stringer drive wheel 504 is connected to the shaft of the motor 500. A pressure roller 506 is mounted on a pivoted bracket 508 and biased by a spring 510 against the drive roller 504 to firmly grip the stringer 62 between the rollers 504 and 506. A tachometer 514 and a pulse generator 516, such as an apertured disc between a light source and a photodiode, are mounted on the rear end of the motor 500 and driven by the drive shaft of the motor 500. One suitable unit including the motor 500, tachometer 514 and the pulse generator 516 is available as model No. 235-2 from Introl Design Inc., Lockport, N.Y. The motor 500 is operated by the pull control circuit shown in FIGS. 33 and 40–44.

A temporary storage bin 512 is provided under the left end of the table top 42 for receiving the stringer 62 as it is pulled rapidly by the pulling mechanism 54.

In operation of the station 54, slack in the stringer 62 to the left of the holder 46 is taken up by the roller 498 moving downward under the force of gravity during the movement of the holder 46 to the welding station 50 and the trimming station 54. Upon return of the holder 46 to its home position as shown in FIGS. 1 and 8, the slack is removed from the stringer 62 and the roller 498 is again pulled to its upper position. The hinge top 204, FIG. 16, of the holder 46 is opened and the stringer 62 is released therefrom. The motor 500 is then operated to drive the drive wheel 504 and to pull a length of stringer 62 from the reel 150 placing the excess stringer after the pull wheel 504 in the temporary storage bin 512.

Stringer Takeup Mechanism 56

Figure 32:
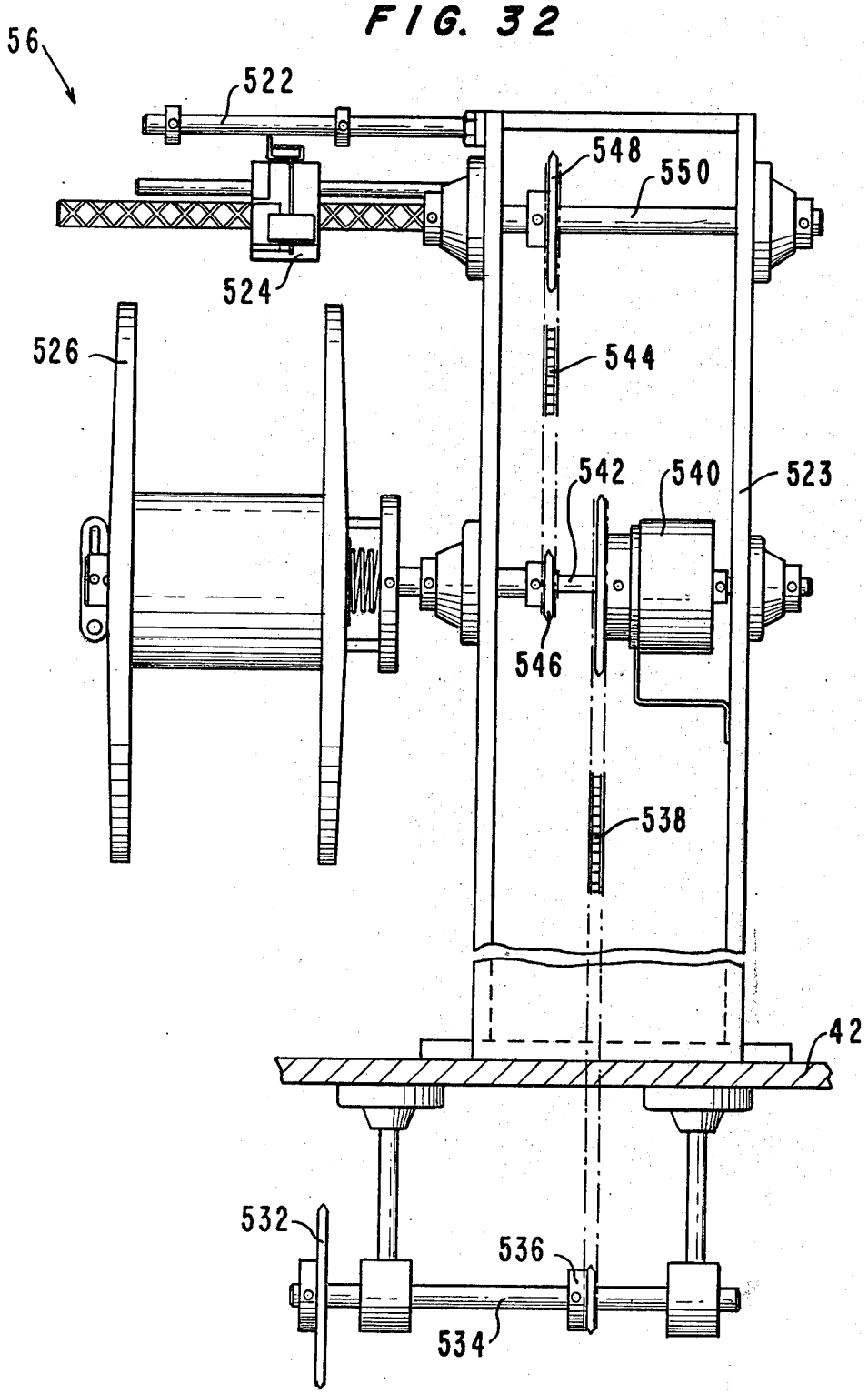
FIG. 32 is a side view taken from the left of a reeling mechanism of the apparatus of FIG. 1.

The take-up mechanism 56 as shown in FIG. 1 has a stringer tangle removing device 520 including a support with a plurality of pins mounted on the left end of the table top 42 and through which the stringer 62 passes from the temporary storage 512. An upper guide bar 522 extends from the top of a support 523 mounted on the rear left corner of the table 42 for directing the stringer 62 to a traversing guide 524 and to a reel 526. A chain 528 meshes with a gear 530, FIG. 10, mounted on the drive shaft 106 and with a gear 532, FIG. 32, fixedly mounted on a shaft 534 which is rotatably mounted on the underside of the table 42. A gear 536 on the shaft 534 is coupled by a chain 538 to the input of an electrical magnetic clutch 540 which drives a shaft 542 rotatably mounted in the support 523. The shaft 542 extends in front of the support 523 and has conventional mounting means for releasably supporting the reel 526. The oscillating traveler 524 is driven by a chain 544 coupling a gear 546 on the shaft 542 with a gear 548 on a shaft 550 of the traveller mechanism for evenly distributing the stringer 62 on the reel 526 during take-up of the stringer. The clutch 540 is operated by the reel clutch control circuit 149 of FIGS. 33 and 45.

In operation of the stringer take-up mechanism 56, the reel 526 and oscillating traveller 524 are driven by the chain 528, chain 538 and chain 544 to take-up the stringer from the temporary storage bin 512. Clutch 540 slips when the tension on the stringer 62 reaches a set level thus stopping the rotating of the reel 526 when there is no more stringer within the temporary storage 512 to prevent the stringer 62 from being torn along its scorelines 78.

Gauge

A gauge 522, FIG. 1, for measuring the thickness of the reinforced portions on the stringer 62, i.e. the thickness of the portion of the stringer 62 where the thermoplastic tape 76, FIG. 3, is welded onto the tape 64, is hung on an arm 554 pivotally mounted on the bottom of the cabinet 58. A switch 556, also shown in FIG. 38, is positioned to be operated by the arm 554 when the gauge 552 is placed on the arm 554.

After a predetermined number of reinforcements have been made on the stringer 62, the apparatus is stopped and the gauge 552 is removed from the arm 554 and used to measure the thickness of a reinforced stringer tape portion. If the thickness is not proper, then adjustments are made to the apparatus so that the proper thickness will be made. After the measurement the gauge is again hung on the arm 554 operating the switch 556 to permit continued operation of the apparatus.

Electrical Control Circuit FIGS. 33–45

Figure 33:
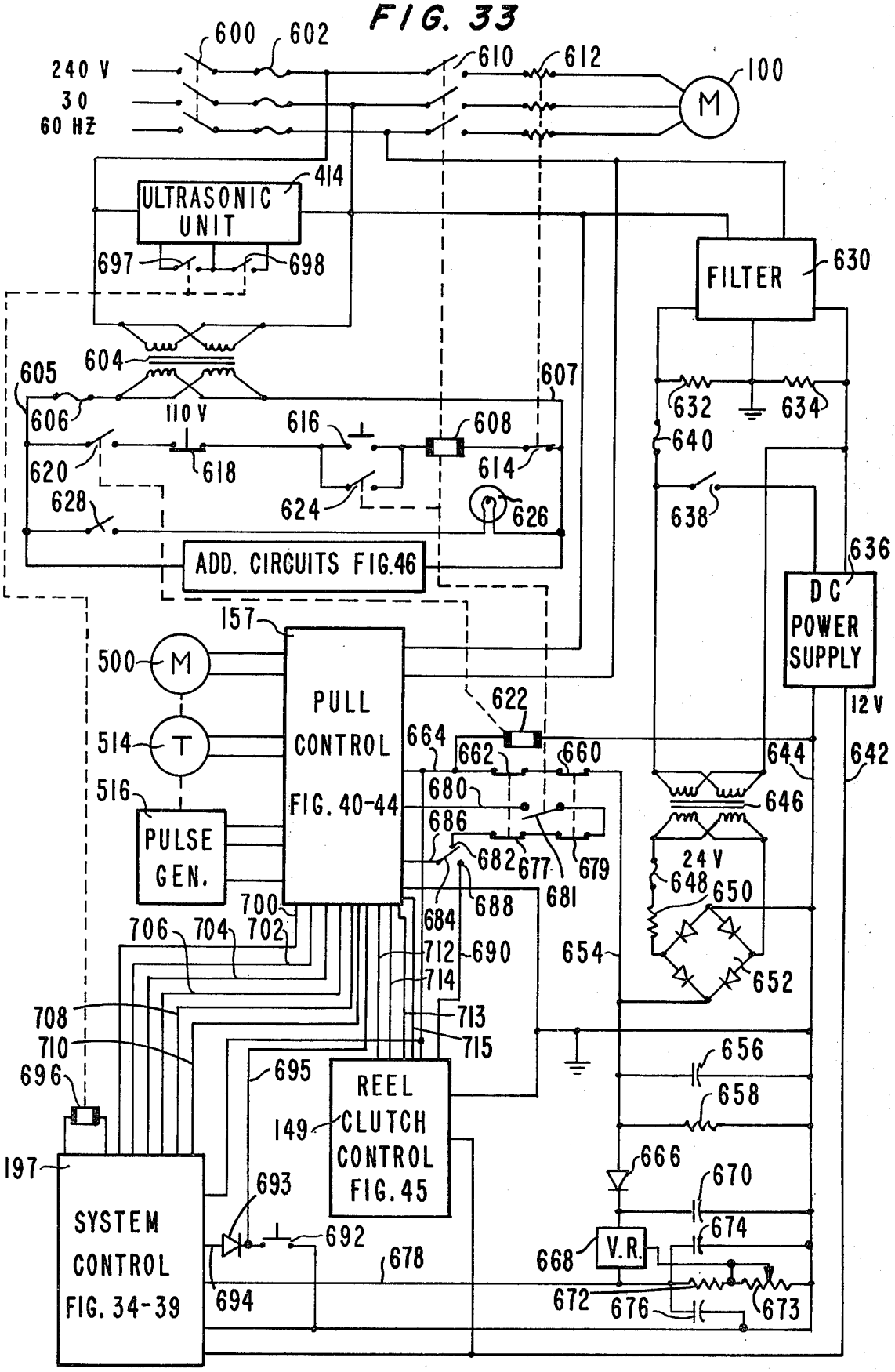
FIG. 33 is an electrical schematic of the overall electrical control circuitry of the apparatus of FIG. 1.

As illustrated in FIG. 33, the control circuit includes a power switch 600 and a set of fuses 602 for connecting the control circuit to a power source, such as 240 volt three-phase 60 hertz source. A transformer 604 has its primary winding connected across one phase of the power source and has its secondary winding connected in series with a fuse 606 across lines 605 and 607 and a control circuit including a control relay 608 for the motor 100. Contacts 610 of the relay 608 are connected in series with thermoprotective device 612 to the inputs of the motor 110. The device 612 has contacts 614 which open in the event of excess current through inputs of the motor 100. The winding of the relay 608 is connected in series with contacts 614, normally open start switch 616, normally closed stop switch 618, contacts 620 of an emergency stop relay 622 and the fuse 606 across the secondary winding of the transformer 604. The relay 608 includes holding contacts 624 connected across the start switch 616. A suitable lamp 626 for illuminating the worker area of the apparatus is connected in series with a switch 628 across the lines 605 and 607 along with additional circuity shown in FIG. 46.

In the additional circuitry of FIG. 46, the power inputs of the control unit 201 are connected across the lines 605 and 607 while the photoelectric scanner 203 is connected to the sensor circuit 201. The circuit unit 201 and the scanner unit 203 are conventional units wherein a light emitting diode of the scanner is energized by an aternating current of a selected frequency, and electrical signals generated by a light responsive transistor of the scanner are filtered to detect reflected light modulated at the selected frequency. Additionally the tape splicing unit 171 has a foot switch 625 connected in series with a solenoid valve 627 across lines 605 and 607 controlling an air cylinder ram (not shown). Heaters 631 in series with a thermostatic switch 633 of the splicing unit 171 are also connected across the lines 605 and 607.

A band pass filter 630, FIG. 33, suitable for filtering high frequency components and low frequency components from the 60 hertz signal is connected across another phase of the three-phase power lines. Resistors 632 and 634 are included in the circuit of the filter 630 and connected across the outputs thereof. The inputs of a DC power supply 636 are connected in series with a on-off switch 638 and a fuse 640 across the output of the filter 630; the power supply 636 is a conventional power supply for generating an output voltage, such as 12 volts, on output line 642 relative to common line 644 or ground suitable for operating electronic logic control circuits. Also, the primary winding of a stepdown transformer 646 is connected across the output of the filter 630. The secondary winding of the transformer 646 is connected by a fuse 648 and a limiting resistor 650 across the input of a bridge rectifier circuit 652 which has its negative output connected to the ground line 644 and its positive output connected to a line 654. A filter capacitance 656 and resistance 658 are connected in parallel between the line 654 and the line 644. First pairs of contacts of respective emergency-stop push button switches 660 and 662 are connected in series between the line 654 and a line 664 joined to inputs of the reel clutch control circuit 149, the pull control circuit 157 and the system control circuit 197. The relay winding 622 is connected between the line 664 and the ground line 644. The transformer 646 and rectifier 652 are selected to produce an output voltage, for example 24 volts, suitable for operating various relays and switches in the control system circuitry.

A diode 666 connects the line 654 to a junction between a input of a conventional voltage regulator unit 668 and one side of a capacitance 670 which has its other side connected to the ground line 644. The output of the regulator 668 on line 678 is connected across a parallel combination of (1) capacitances 674 and 676 conneed between the line 678 and ground line 644 and (2) a voltage divider formed by resistance 672 and variable resistance 673, the junction between resistances 672 and 673 being connected to a feedback control input of the voltage regulator 668. The line 678 is connected to the system control circuit 197. The voltage regulator is selected to generate a voltage, or example 24 volts, on line 678 for operating various sensing switches in the system control circuit 197.

Second pairs of contacts 677 and 679 of the respective emergency switches 660 and 662 are connected serially with a line 680, contacts 681 of the starting relay 608 and a normally closed contact 682 of a tension release switch which has a contact arm 684 joined by a line 686 to the pull control circuit 157. A normally open contact 688 of the tension release switch is connected to the reel clutch control circuit 149 by a line 690.

The system control circuit 197 is connected to a line 694 in series with a diode 693 and a normally open reset switch 692 connected to the ground 644. A line 695 connects the junction of the diode 693 and the switch 692 to the pull control circuit 157. Additionally the system control 197 includes a relay 696 having contacts 697 and 698 connected to the ultrasonic unit 414 for operating the ultrasonic unit which is connected across one phase of the 240-volt three-phase power input. Lines 700, 702, 704, 706, 708 and 710 connect the system control circuit 197 to the pull control circuit 157 while lines 712, 713, 714 and 715 connect the pull control circuit 157 to the reel clutch control circuit 149.

Figure 34:
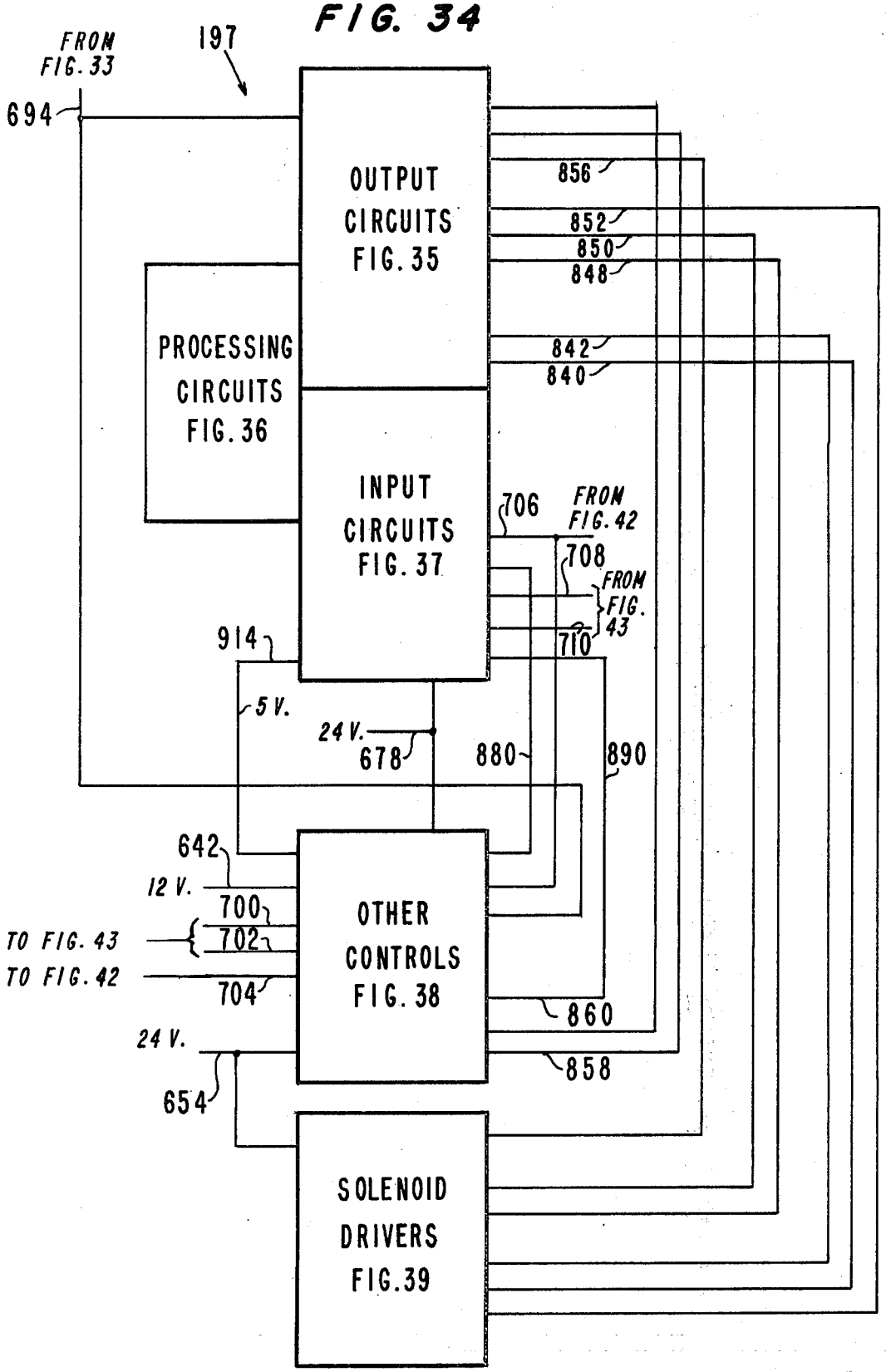
FIG. 34 is an electrical schematic of a system control portion of the circuitry of FIG. 33.

The system control circuit 197 is shown in detail in FIGS. 34–39 wherein FIG. 34 shows the overall system control circuit 179 and the arrangement and interconnection of the various circuits illustrated in FIGS. 35–39. The interconnections between the circuits in FIGS. 35, 36 and 37 can be shown by placing the sheets containing these circuits in the positions as shown in FIG. 34.

Figure 35:
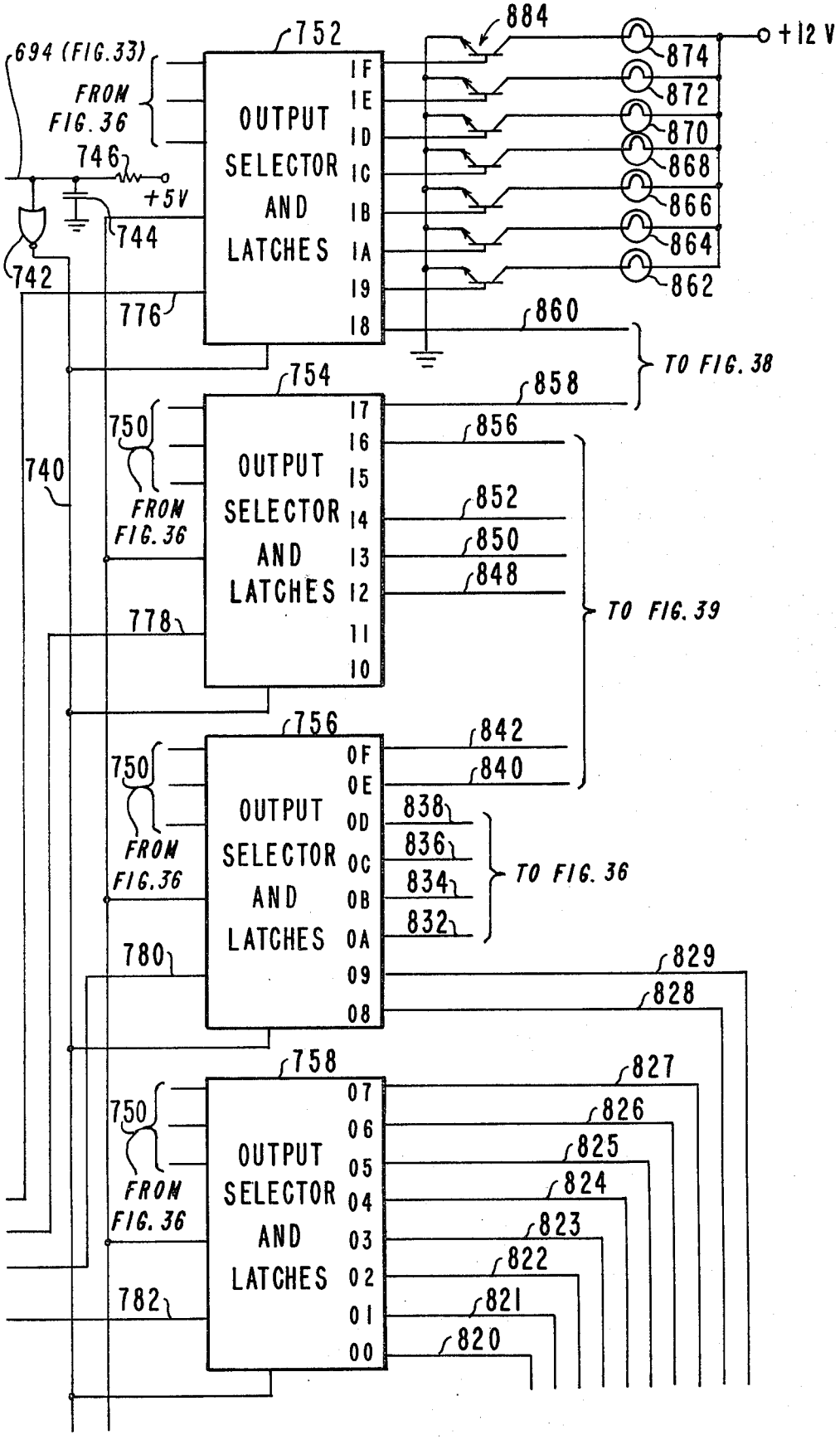
FIG. 35 is a detailed electrical diagram of an output circuit section of the system control circuitry of FIG. 34.
Figure 36:
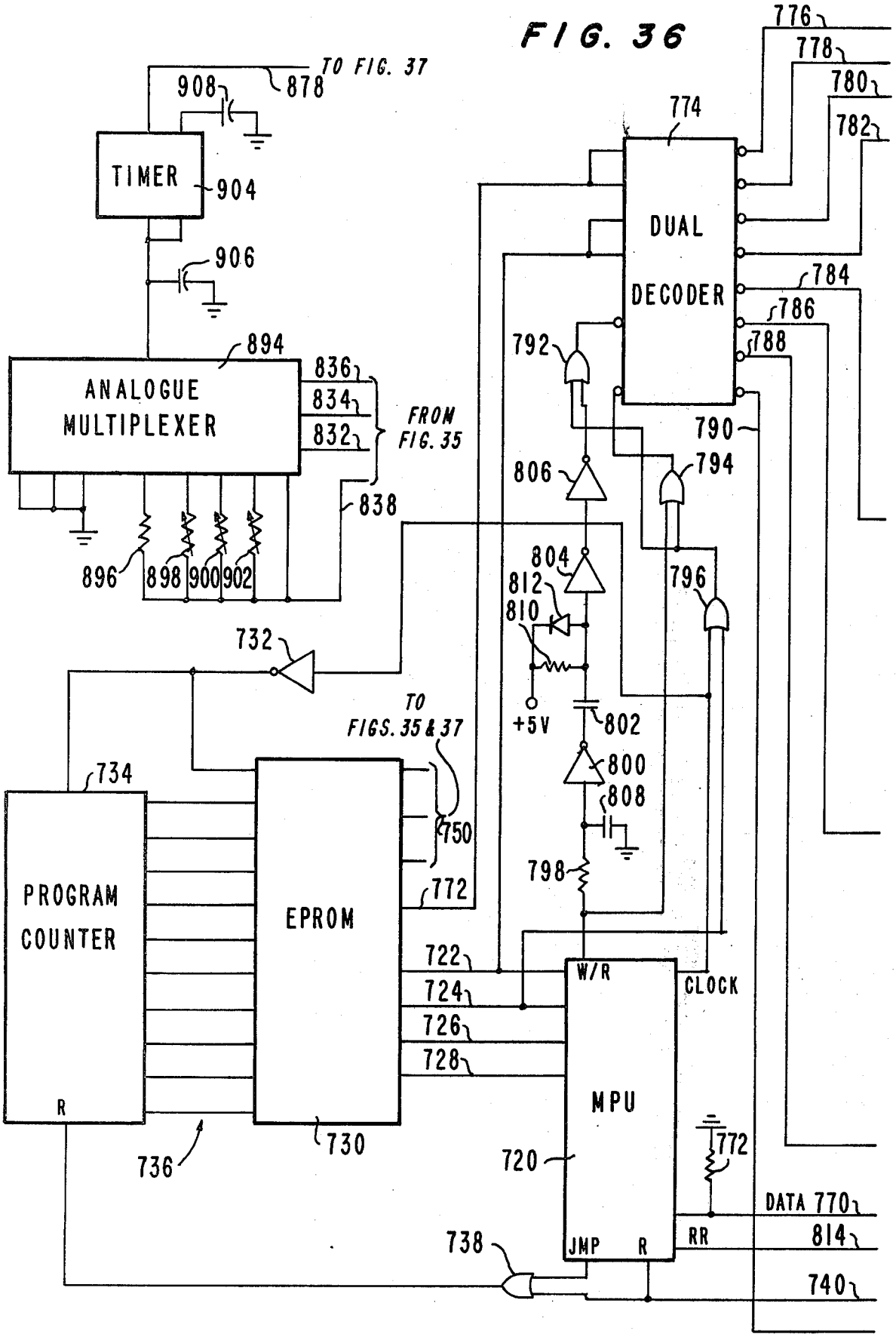
FIG. 36 is a detailed electrical diagram of another circuit section of the system control circuitry of FIG. 34.

In the processing circuits of FIG. 36, a microprocessor unit 720, such as Motorola model No. 14500, has its instruction inputs connected to lines 722, 724, 726 and 728 from the most significant outputs of an erasable programmable read only memory (EPROM) 730, such as National Semiconductor model No. 2716. The least significant address bit of the memory 730 is connected to the clock output of the microprocessor unit 720 by an inverter 732 while the next significant address bits are connected to outputs of a program counter 734, such as Motorola model No. 14040, by lines 736. The clock input of the counter 734 is also connected to the output of the inverter 732 while the reset input of the counter 734 is connected to the output of an orgate 738 which has one input connected to the JMP output of the microprocessor unit 720 and the other input connected to line 740 connected to the output of an inverter 742, FIG. 35, from line 694 from the reset switch 692 of FIG. 33; a capacitance 744 is connected between the line 694 and ground for filtering spurious signals, and a bias resistor 746 is connected between line 694 and a 5-volt source.

The three least significant bit outputs of the erasable programmable memory 730 on lines 750 are connected to address inputs of output selector and latch circuits 752, 754, 756 and 758 (FIG. 35) as well as to address inputs of input selector circuits 760, 762, 764 and 766 (FIG. 37). The output selector and latch units 752, 754, 756 and 758 and the input selector units 760, 762, 764 and 766 are conventional units, such as Motorola Model No. 14099 and Motorola Model No. 14512, respectively. The data inputs of the units 752, 754, 756 and 758 and the data outputs of the units 760, 762, 764 and 766 are connected to a single bit data line 770 joined to the data input-output of the microprocessor unit 720. This data line is biased by resistor 772 to ground. The fourth and fifth bit outputs of the memory 730 on lines 772 and 722 are connected to corresponding inputs of a dual decoder circuit 774, such as Motorola model No. 14556, which has its outputs on lines 776, 778, 780, 782, 784, 786, 788 and 790 connected to enable inputs of the respective output selector and latch units 752, 754, 756 and 758 and input selector units 760, 762, 764 and 766. The respective enabling inputs of the dual decoder 774 are connected to outputs of or-gates 792 and 794 which have one inputs connected to the output of an or-gate 796 which in turn has one input connected to the clock output of the microprocessor unit 720 and the other input connected to the sixth bit output of the memory 730. The other input of the gate 794 is connected to the write-read output of the microprocessor unit 720. A series circuit including a resistor 798, an inverter 800, a capacitance 802, an inverter 804 and an inverter 806 connect the write-read output of the microprocessor unit 720 to the other input of the or-gate 792. A capacitor 808 is connected between ground and the junction of the resistor 798 and inverter 800 for slightly delaying triggering of the gate 792 while a differentiating circuit is formed by the capacitance 802 and a parallel combination of a resistor 810 and diode 812 connected between the 5-volt source and the junction of the capacitance 802 to the inverter 804. The connections to the dual decoder 774 are selected to produce an output on one of the lines 776, 778, 780 and 782 in accordance with the address on lines 772 and 722 during a write signal from the microprocessor unit 720 and to produce an output on a selected one of the lines 784, 786, 788, 790 in accordance with the address on lines 772 and 722 when the write-read output of the microprocessor unit 720 is in the read mode.

An example of instruction codes and address codes (in hexadecimal) is set forth in tables 1 and 2 wherein the instructions at memory addresses 000 through 20F are set forth in table 1 and instructions at memory addresses 210 through 3CF are set forth in table 2; the remaining addresses of the memory 730 are set at FF (producing no operation of the microprocessor unit). Table 3 lists a summary of the operations of the microprocessor unit 720; a more complete description of the operation can be had by referring to the manufactures instructions.

In Tables 1 and 2, the first character of each set of four characters corresponds to the instruction set which is applied to the microprocessor unit 720; the second character is not used while the last two characters of each set of four characters is the address of the output selector and latch unit 752, 754, 756 and 758 or input selector unit 760, 762, 764 and 766 at which the operation is performed. The addresses are set forth in hexadecimal form at the output lines of the corresponding latch units 652, 654, 656, 658 and input selector units 760, 762, 764 and 766. For example, the second set of data (70–00) exclusive nors the first input of selector 760 on line 814 connected to the RR output of microprocessor unit 721 and the third instruction (A0-00) enables the inputting of data into the microprocessor unit.

Referring to FIGS. 35 and 37, the outputs of the output selector and latch units 752, 754, 756 and 758 are listed in the following table 4 while the inputs of the input selectors 760, 762, 764 and 766 are listed in the following table 5.

TABLE 1

| Program - 000 through 20F (hexadecimal) | | | | | | | |
|---|---|---|---|---|---|---|---|
| 00-00 | 70-00 | A0-00 | 20-01 | 40-02 | 40-03 | 40-04 | 40-05 |
| B0-00 | 80-09 | 20-01 | 40-02 | 40-03 | 30-04 | 30-05 | B0-00 |
| 80-09 | 20-01 | 30-02 | 30-03 | 40-04 | 30-05 | B0-00 | 80-09 |
| 10-01 | 40-02 | 30-03 | 30-04 | 40-05 | B0-00 | 80-09 | 10-01 |
| 30-02 | 30-03 | 40-04 | 40-04 | 50-09 | 30-1D | B0-00 | 90-01 |
| 90-02 | 80-03 | 80-04 | 80-05 | 80-0E | 90-09 | F0-30 | 20-01 |
| 30-02 | 30-03 | 30-04 | 30-05 | 00-00 | 30-1B | 30-1E | 40-1D |
| B0-00 | 90-02 | 80-01 | 90-1C | 90-1D | 90-1E | 90-1F | 20-01 |
| 40-02 | 30-03 | 30-04 | 30-05 | 30-1E | 30-1D | B0-00 | 80-02 |
| F0-01 | 10-01 | 40-02 | 30-03 | 30-04 | 30-05 | 00-00 | 30-1D |
| B0-00 | 90-03 | 90-04 | 90-05 | 90-0E | 00-00 | 90-0C | 90-0D |
| 00-00 | 00-00 | 20-1F | 30-10 | 30-0E | 30-01 | 40-02 | 40-03 |
| 40-04 | 40-05 | B0-00 | 90-01 | 80-02 | 80-0F | F0-00 | 10-0F |
| 40-01 | 30-02 | 40-03 | 40-04 | 40-05 | B0-00 | 80-01 | 80-19 |
| 00-00 | F0-00 | 10-1F | 30-01 | 30-02 | 40-03 | 40-04 | 40-05 |
| B0-00 | 80-08 | 10-0D | 20-01 | 30-02 | 30-03 | 40-04 | 40-05 |
| 50-08 | 40-05 | B0-00 | 90-01 | 90-02 | 80-03 | 80-12 | 80-0A |
| 80-0D | 90-08 | F0-00 | 20-0D | 00-00 | 40-01 | 40-02 | 30-03 |
| 40-04 | 40-05 | B0-00 | 90-12 | 80-01 | 00-00 | F0-00 | 00-00 |
| 10-10 | 30-01 | 40-02 | 30-03 | 40-04 | 40-05 | 40-06 | B0-00 |
| 90-01 | 80-02 | 80-06 | 90-0A | 90-0D | 00-00 | F0-00 | 00-00 |
| 10-06 | 30-10 | 30-01 | 40-02 | 30-03 | 40-04 | 40-05 | B0-00 |
| 80-02 | 90-0A | 90-0D | 90-06 | 80-07 | 80-1D | 90-0F | 90-19 |
| F0-00 | 10-0D | 30-11 | 40-01 | 40-02 | 30-03 | 40-04 | 40-05 |
| B0-00 | 90-01 | 90-03 | 80-04 | 90-0F | 90-06 | 90-0A | 90-0D |
| 90-19 | 00-00 | 80-16 | 00-00 | F0-00 | 10-12 | 40-1F | 40-01 |
| 40-02 | 40-03 | 30-04 | 40-05 | B0-00 | 80-01 | 80-0F | 90-12 |
| F0-00 | 10-13 | 30-01 | 40-02 | 40-03 | 30-04 | 40-05 | B0-00 |
| 90-01 | 80-02 | 80-1A | 00-00 | F0-00 | 10-1F | 40-01 | 30-02 |
| 40-03 | 30-04 | 40-05 | B0-00 | 80-01 | 80-13 | 80-0B | 80-0D |
| 20-0D | 30-14 | 30-01 | 30-02 | 40-03 | 30-04 | 40-05 | B0-00 |
| 90-02 | 80-03 | 80-07 | 80-1E | 90-0F | 90-1A | 90-0B | 90-0D |
| 90-13 | 90-16 | 10-15 | 30-01 | 30-02 | 40-03 | 30-04 | 40-05 |

TABLE 2

| Program - 210 through 3CF (hexadecimal) | | | | | | | |
|---|---|---|---|---|---|---|---|
| B0-00 | 90-01 | 80-03 | 90-13 | 10-14 | 40-0D | 40-01 | 30-02 |
| 30-03 | 30-04 | 40-05 | B0-00 | 90-01 | 90-02 | 90-03 | 90-04 |
| 80-05 | 90-0F | 90-1A | 90-0B | 90-0D | 00-00 | 90-16 | F0-17 |
| 10-16 | 30-18 | 40-1F | 40-01 | 40-02 | 40-03 | 40-04 | 30-05 |
| B0-00 | 80-0F | 80-01 | 10-17 | 30-01 | 40-02 | 40-03 | 40-04 |
| 30-05 | B0-00 | 90-01 | 80-02 | 80-1B | 00-00 | F0-00 | 10-1F |
| 40-01 | 30-02 | 40-03 | 40-04 | 30-05 | B0-00 | 80-08 | 10-0D |
| 30-01 | 40-02 | 30-03 | 40-04 | 30-05 | 50-08 | 30-05 | B0-00 |
| 80-01 | 80-02 | 90-03 | 80-14 | 80-0A | 80-0D | 90-08 | 00-00 |
| F0-00 | 20-0D | 50-19 | 30-01 | 30-02 | 40-03 | 40-04 | 30-05 |
| B0-00 | 90-01 | 90-02 | 80-03 | 90-14 | 00-00 | F0-00 | 20-0D |
| 40-06 | 30-18 | 40-01 | 40-02 | 30-03 | 40-04 | 30-05 | B0-00 |
| 80-01 | 80-06 | 90-0A | 90-0D | F0-22 | 20-0D | 30-06 | 30-18 |
| 40-01 | 40-02 | 30-03 | 40-04 | 30-05 | B0-00 | 80-02 | 90-0A |
| 90-0D | 90-06 | 80-07 | 80-1F | 90-0F | 90-1B | 00-00 | 10-0D |
| 30-18 | 40-01 | 40-02 | 30-03 | 40-04 | 30-05 | B0-00 | 80-01 |
| 80-02 | 90-06 | 90-0A | 90-0D | 90-1B | 90-0F | 00-00 | 10-07 |
| 30-01 | 30-02 | 30-03 | 40-04 | 30-05 | B0-00 | 90-01 | 90-02 |
| 90-03 | 80-04 | 90-07 | F0-25 | 20-0C | 40-07 | 30-01 | 30-02 |
| 30-03 | 40-04 | 30-05 | B0-00 | 80-18 | 90-02 | 90-03 | 80-04 |

TABLE 2-continued

| Program - 210 through 3CF (hexadecimal) | | | | | | | |
|---|---|---|---|---|---|---|---|
| 90-18 | 20-07 | 30-0C | 30-01 | 30-02 | 30-03 | 40-04 | 30-05 |
| B0-00 | 80-00 | 10-01 | 40-02 | 40-03 | 30-04 | 30-05 | 50-0A |
| 30-1D | 40-1F | 40-1A | B0-00 | 90-01 | 80-02 | 90-03 | 80-04 |
| 80-0E | 80-1C | 90-00 | F0-27 | 10-1F | 40-1D | 30-1E | 40-01 |
| 30-02 | 40-03 | 30-04 | 30-05 | B0-00 | 80-01 | 80-17 | 20-01 |
| 30-02 | 30-03 | 30-04 | 30-05 | 40-0D | 40-1B | 40-1F | B0-00 |
| 90-0D | 90-0C | 90-03 | 10-01 | 30-02 | 40-03 | 30-04 | 30-05 |
| 40-1B | B0-00 | 80-0C | 80-0D | 90-01 | 80-03 | 90-17 | C0-00 |

TABLE 3

| Operations of MPU 720 | | |
|---|---|---|
| Hexadecimal | Binary | Action |
| 0 | 0000 | No Operation |
| 1 | 0001 | Load Data |
| 2 | 0010 | Load Complement Data |
| 3 | 0011 | AND Data |
| 4 | 0100 | AND Complement Data |
| 5 | 0101 | OR Data |
| 6 | 0110 | OR Complement |
| 7 | 0111 | Exclusive NOR Data |
| 8 | 1000 | Write |
| 9 | 1001 | Write Complement |
| A | 1010 | Input enable |
| B | 1011 | Output enable |
| C | 1100 | Jump |
| D | 1101 | Return |
| E | 1110 | Skip |
| F | 1111 | No operation |

TABLE 4

| OUTPUTS OF UNITS 752, 754, 756 and 758 | |
|---|---|
| Address | Connected to |
| 00 | Line 820 to input 0A |
| 01 | Line 821 to input 01 |
| 02 | Line 822 to input 02 |
| 03 | Line 823 to input 03 |
| 04 | Line 824 to input 04 |
| 05 | Line 825 to input 05 |
| 06 | Line 826 to input 06 |
| 07 | Line 827 to input 07 |
| 08 | Line 828 to input 08 |
| 09 | Line 829 to input 09 |
| 0A | Time delay address line 832 |
| 0B | Time delay address line 834 |
| 0C | Time delay address line 836 |
| 0D | Time delay start line 838 |
| 0E | Home clamp control line 840 |
| 0F | Clamp control line 842 |
| 10 | (not used) |
| 11 | (not used) |
| 12 | Gap solenoid control line 848 |
| 13 | Weld start relay control line 850 |
| 14 | Trim solenoid control line 852 |
| 15 | (not used) |
| 16 | Weld station control line 856 |
| 17 | Start stringer drive line 858 |
| 18 | Counter pulse line 860 |
| 19 | Start gap lamp 862 |
| 1A | Start weld lamp 864 |
| 1B | Start trim lamp 866 |
| 1C | Start stringer drive lamp 868 |
| 1D | Bad gap lamp 870 |
| 1E | Bad weld lamp 872 |
| 1F | Bad trim lamp 874 |

TABLE 5

| Inputs of units 760, 762, 764 and 766 | |
|---|---|
| Address | Connected to |
| 00 | RR of MPU 720 |
| 01 | Line 821 from output 01 |
| 02 | Line 822 from output 02 |

TABLE 5-continued

| Inputs of units 760, 762, 764 and 766 | |
|---|---|
| Address | Connected to |
| 03 | Line 823 from output 03 |
| 04 | Line 824 from output 04 |
| 05 | Line 825 from output 05 |
| 06 | Line 826 from output 06 |
| 07 | Line 827 from output 07 |
| 08 | Line 828 from output 08 |
| 09 | Line 829 from output 09 |
| 0A | Line 820 from output 00 |
| 0B | (not used) |
| 0C | Short splice line 708 |
| 0D | Time delay line 878 |
| 0E | Gap position switch 275 |
| 0F | Gap clamp switch 336 |
| 10 | Gap cylinder switch 315 |
| 11 | Good gap switch 313 |
| 12 | Weld position switch 277 |
| 13 | Weld clamp switch 438 |
| 14 | Weld cylinder switch 434 |
| 15 | Good weld line 880 |
| 16 | Trim position switch 278 |
| 17 | Trim clamp switch 484 |
| 18 | Trim cylinder switch 464 |
| 19 | Good trim switch 462 |
| 1A | End batch line 706 |
| 1B | Feed stopped line 710 |
| 1C | (not used) |
| 1D | Holder home switch 273 |
| 1E | Holder home clamp switch 271 |
| 1F | Foot switch 882 |

The outputs 00, 01, 02, 03, 04, 05, 06, 07, 08, and 09 are connected by lines 820 through 829 with the respective inputs 0A, 01, 02, 03, 04, 05, 06, 07, 08 and 09 to produce temporary memory or storage of data to record the particular step of the process as well as other parameters in the program. The lamps 862, 864, 866, 868, 870, 872 and 874, mounted on the front panel of the electrical box 58 (FIG. 1) are driven by respective transistors 884 connected to outputs 19 through 1F. The inputs 02 through 1F of input selector units 760, 762, 764 and 766 are biased by respective resistors 886 connected to ground. Respective resistors 888 are connected in series between the inputs and the switches 275, 336, 315, 313, 277, 438, 434, 278, 484, 464, 462, 273, 271 and 882 for reducing the voltage supplied to the switches to a level suitable for the selector units; the switches are operated by the regulated 24 volt source on line 678. Similar voltage dropping and protecting resistors 887 and 889 are connected in series with the lines 706 and 710 to the inputs of the selector unit 766. The servo stop signal on line 710 after passing through the resistance 889 is applied to line 890 which is connected to the additional control circuitry in FIG. 38.

The time delay address lines 832, 834 and 836 from the output selector and latch unit 756 in FIG. 35 are connected to address inputs of an analogue multiplexer unit 894 in FIG. 36; the least significant bit of the address being on line 832. The analogue multiplexer 894 is a conventional unit such as Motorola model number 14051. The time delay start line 838 is connected to one ends of resistors 896, 898, 900 and 902 which have their other ends connected to respective inputs of the multiplexor unit 894. A 555-timer unit 904 has its input connected to the output of the multiplexer 894 with the output of the timer 904 connected to the time delay line 878 which is connected to the input OD of input selector unit 762. The values of the resistors 896, 898, 900 and 902 as well as the value of capacitor 906 connected between ground and the input of timer 904 and capacitor 908 connected between ground and the timer 904 are selected to produce delay signals on line 878 in accordance with desired delays in the program or operation of the apparatus.

In the circuitry of FIG. 38, a voltage regulator 910 has its input connected to the 12-volt line 642 and filter capacitance 912 while the output of the voltage regulator is connected to a line 914 connected to one side of filter capacitances 916 and 918 which have their other side connected to ground. The voltage regulator 910 is a conventional regulator designed to produce a 5-volt supply voltage on line 914 for operating the electronic units in FIGS. 34–38.

The sensing switch 433 in the welder unit 414 for sensing when the welding head has reached the lowermost position is connected between the 24-volt regulated voltage line 678 and a voltage divider network including resistor 920 and potentiometers 922 and 924 to the input of a voltage sensor 926; a filter capacitance 928 being connected across the input of the voltage sensor 926. The voltage sensor 926 is a conventional circuit unit such as type L489C which generates an output when the input reaches a predetermined voltage. The output of the voltage sensor is applied by an inverter 930 and resistance 932 to the line 880 which indicates that a good weld has been made.

The batch end count signal on line 706 is applied through a voltage divider including resistors 934 and 936 to series coupled amplifiers 938 and 940 which apply the signal through a resistor 942 to the base of a transistor 944 connected in series with a guage test indicator lamp 946 across the 12-volt supply voltage on line 642. The guage switch 556 is connected between the line 678 and a voltage divider including resistors 948 and 950, connected to one side of a filter capacitance 952 which has its other side connected to ground, and a potentiometer 954 to the inputs of a 555 timer unit 956. The operation of the timer is set by the capacitances 958 and 960 connected from the inputs to ground as well as the other resistances and capacitances in the input and a capacitor 962 connected to the timer to produce a suitable delayed output, for example 10 seconds. The output of the timer 956 is connected to the input of a one shot or monostable multivibrator circuit 964 which has its output connected by an inverter 966 to the base of a transistor 968 which is connected in series between the ground or common line and reset batch signal line 704. The timer 956 with its associated capacitors and resistances is selected to delay the signal on line 704 for a time ordinarily needed to measure the thickness of the stringer 62 with the tapes 76 thereon (FIG. 3).

The splice detector switch 193 has one side connected to the voltage line 678 and the other side connected to a voltage dividing and filtering circuit 970 which in turn is connected by an inverter 972 to the base of a transistor 974 having its emitter and collector connected between the ground line and line 702. The line 890 is connected by an inverter 976 and diode 978 to the junction between inverter 972 and the voltage divider circuit 970. The anode of the diode 978 is connected to the input of the inverter 972 to prevent an output signal on line 702 when a splice inhibit signal or feed stopped signal is present on line 890 from line 710, FIG. 37. This splice inhibit signal prevents the generation of a splice signal on line 702 while the stringer pulling mechanism 54 is not operating.

The count increment pulse signal on line 860 is applied to the input of a one-shot or monostable multivibrator circuit 980 which has its output connected by an amplifier 987 to the base of a transistor 984 connected in series with the operating coil of a counter 986 across the 24-volt voltage supply on line 654. The counter 986 is an electrical mechanical counter for counting the total number of successful stringers produced in a given roll of stringer.

The line 858 on which the start stringer drive signal is produced is connected to the input of a one shot or monostable multivibrator circuit 988 which has its output connected by an amplifier 990 to the base of a transistor 992 having its emitter and collector connected between the ground line and the line 700. The one shot 988 is designed to convert the start signal drive signal produced by the logic circuitry of FIG. 35 into a suitable pulse for initiating operation of the pull control circuit of FIGS. 40–44.

The reset line 694 from the reset switch 692 of FIG. 33 is connected by an amplifier 994 to inputs of the one shot circuits 964, 980 and 988 for causing the generation of signals to reset the electronic circuitry to an initial condition.

The driving circuits responding to the signals on lines 840, 842, 848, 850, 852, and 856 from the output selector and latch units 754 and 756 in FIG. 35 are illustrated in FIG. 39. Each of these lines is connected by a respective amplifier of the amplifiers indicated generally at 996 and a respective resistor of the resistors indicated generally at 998 to the base of a respective transistor of the transistors indicated generally at 1000. Each of the transistors 1000 has its emitter connected to the ground line and its collector connected in series with a solenoid valve or relay and the unregulated 24-volt power line 654. Thus, the line 856 controls the solenoid valve 403 which operates the weld station pnuematic control of FIG. 47, the line 850 controls the welding relay 696 which operates the welding mechanism 414 (FIG. 1), the line 848 controls a solenoid valve 1002 which operates the gapping air cylinder 294 (FIG. 18) and piston rod 296, the line 842 controls a solenoid valve 1006 which operates the air cylinders in the clamping mechanisms 320, 432, and 482 for the gapping, welding and trimming stations (see air cylinder 329, FIG. 21), the line 840 controls the solenoid valve 285 which controls the air cylinder 265 and plunger 263, (FIG. 16) for clamping the holder 46 in the home position, and the line 852 controls a solenoid valve 1008 which operates the trimming mechanism 52 (FIG. 1). Diodes 1012 are connected across the respective, solenoids 403, 1002, 1006, 285, and 1008, and relay 696 for providing a current path during deenergization of the respective solenoid or relay.

Figures 33, 40:
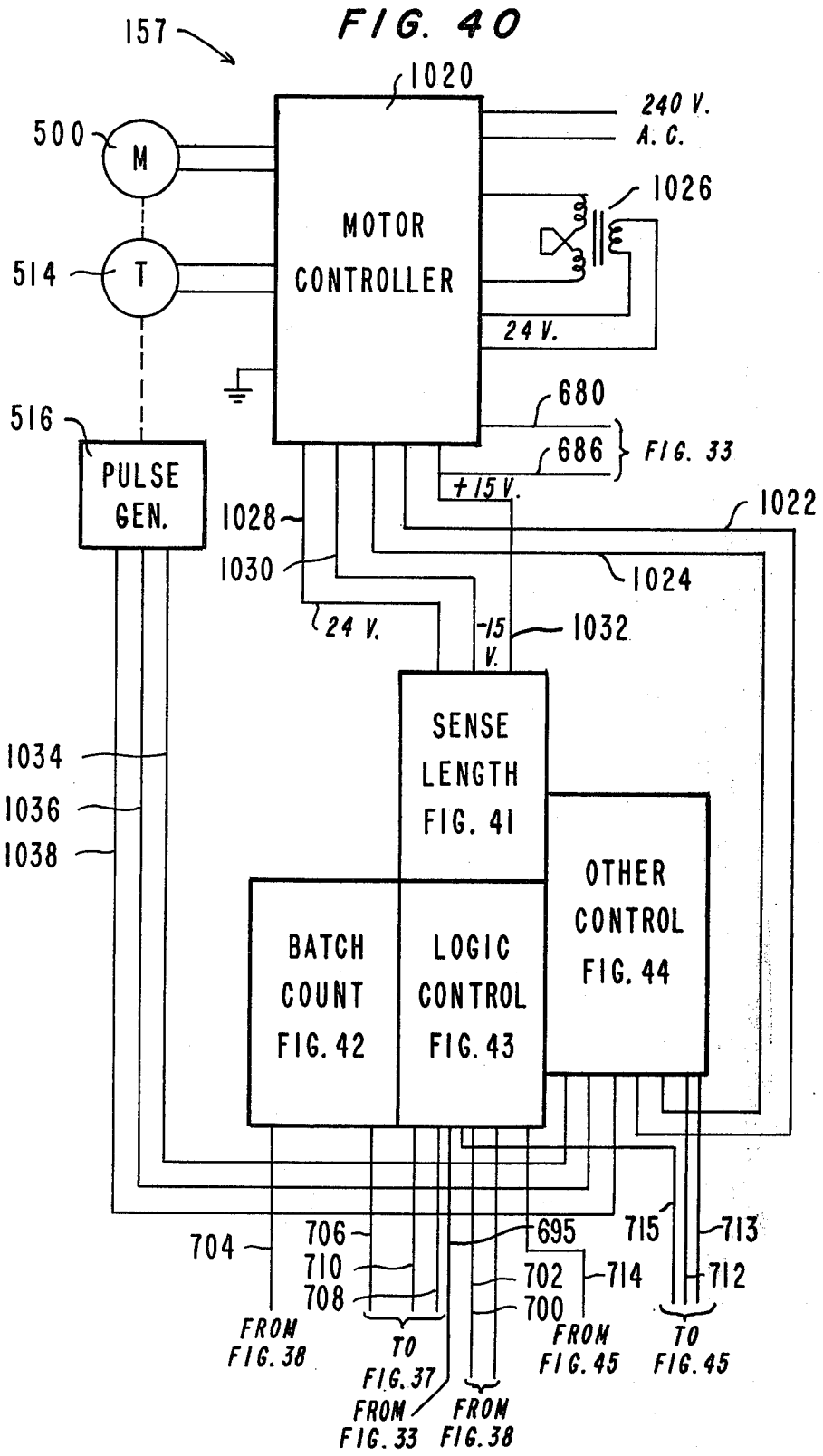
FIG. 40 is an electrical schematic of a length and pulling portion of the control circuitry of FIG. 33.

The pull control circuit 157 of the electronic control circuitry of FIG. 33 is illustrated in FIGS. 40–44 wherein FIG. 40 shows the overall pull control circuit 157. This circuit includes a motor controller 1020, such as Model No. 121 from Introl Design Inc., 4830 Thrall Road, Lockport, New York, as well a stringer length sensing circuit shown in FIG. 41, a batch counting circuit shown in FIG. 42, a logic control circuit shown in FIG. 43 and other control circuitry shown in FIG. 44. The motor controller 1020 is powered by one phase of the 240 volt AC input power and operates the DC motor 500. The operation of the motor controller 1020 and the motor 500 is controlled by input signals on lines 1022 and 1024 from the control circuits of FIG. 44. Normally, when the motor 500 is stopped, an alternating current on line 1024 locks the motor, and when rotating, the speed is controlled by the magnitude of the signal on line 1022. The tachometer 514 is connected to inputs of the motor controller which utilizes the output of the tachometer 514 as a feedback control for controlling the speed of the motor 500. In a normally unoperated condition or when the motor 500 is stopped, the signal on line 1024 is alternating to produce slightly forward and back movement of the motor 500; the frequency and relative magnitudes of the opposite polarity halves of the alternating current are determined by signals from the pulse generator 516 on lines 1034, 1036 and 1038 connected to circuitry the of FIG. 44 as described more fully hereafter. The energization of the motor 500 by an alternating current from motor controller 1020 serves to lock the motor and prevent free rotation of the motor 500 and the shaft which drives the stringer pulling wheel 504 (FIG. 1) except for a slight oscillation of the motor 500. The line 680 from the tension release switch 684 (FIG. 33) and emergency switches 660 and 662 is connected to an input of the motor controller 1020 for operating the motor controller to remove the energization applied to the motor 500; this allows the motor 500 to be freely rotated so that the stringer 62 (FIG. 1) can be freely pulled through the stringer length pulling mechanism 54. A step down transformer 1026 is connected to the motor controller 1020 for providing a suitable stepped down voltage which can be rectified by the motor controller circuit 1020 to operate the motor 500. The motor controller 1020 also contains power supply circuits for generating a 24 volt power supply on line 1020, a −15 volt power supply on line 1030 and a +15 volt power supply on line 1032 which are used to energize the circuits of FIGS. 41–44.

The interconnections between the circuits of FIGS. 41, 42, 43 and 44 can be seen by arranging these circuits as illustrated in FIG. 40.

Figure 41:
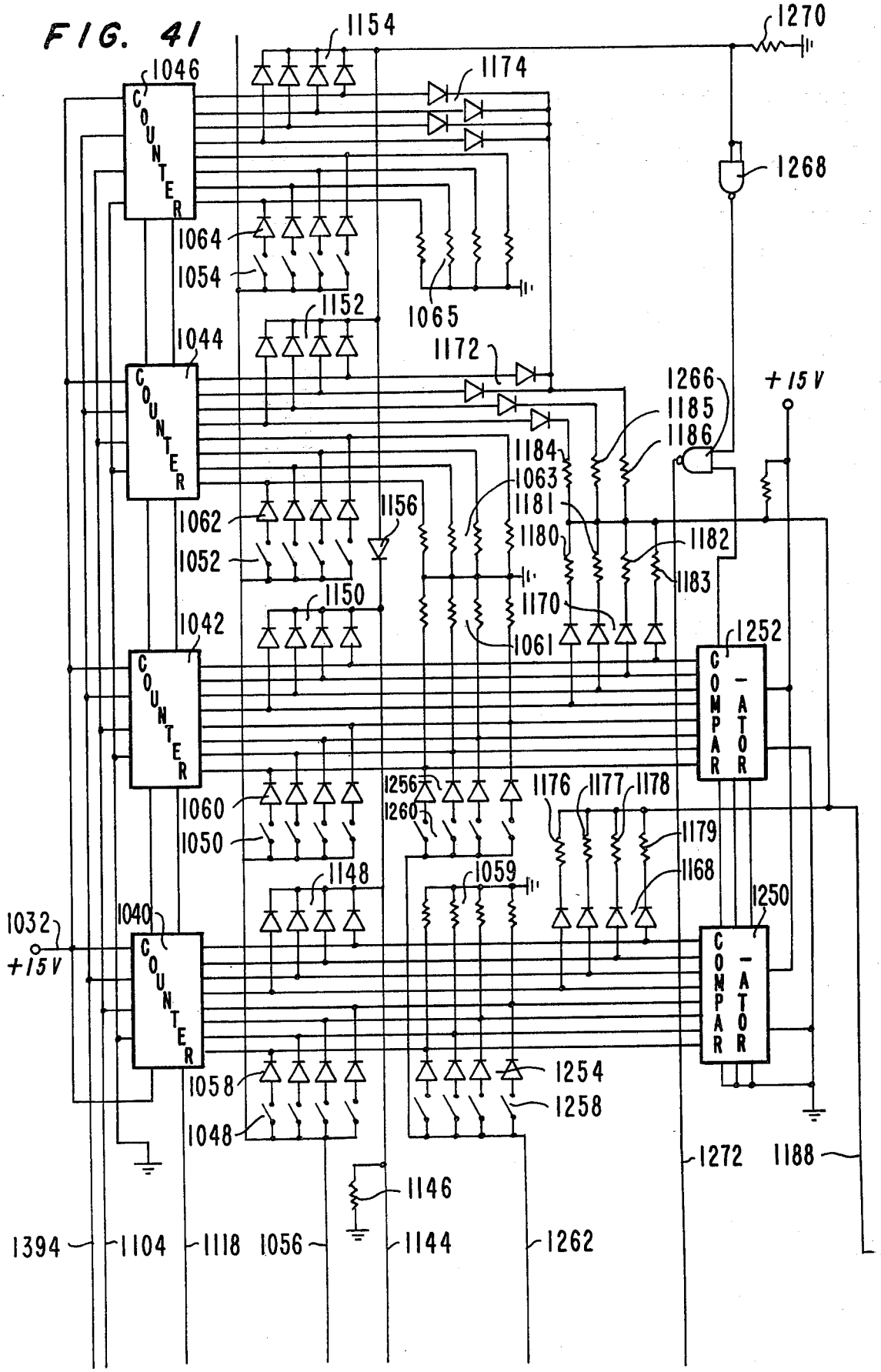
FIG. 41 is a detailed electrical diagram of a length sensing section of the circuitry of FIG. 40.

In the circuit of FIG. 41, four BCD presettable up-down counters 1040, 1042, 1044 and 1046, such as type MM74C192N, are connected in a cascade arrangement. Thumb wheel binary decade switches 1048, 1050, 1052 and 1054 have one sides thereof connected to a line 1056 and have their other sides connected by respective sets of diodes 1058, 1060, 1062 and 1064 to the respective jam inputs of the counters 1040, 1042, 1044 and 1046, which inputs are biased by respective sets of resistors 1059, 1061, 1063 and 1065 connected to ground. The line 1056 is caused to go high when an input pulse is received on the start stringer line 700 of FIG. 43 by means of a series circuit including resistor 1066, nand-gate 1068, capacitor 1070, nand-gate 1072, nand-gate 1074, nand-gate 1076, nand-gate 1078, inverter 1080 and transistor 1082. In this circuit, a resistor 1084 is connected between the +15 volt supply and the junction between the resistor 1066 and the input of the gate 1068 for biasing the input positive while a capacitor 1086 is connected between this junction and ground for filtering spurious signals. The other input of the gate 1068 is connected to a line 1088 which is normally high when the pull mechanism is stopped. A resistor 1090 is connected between the +15 volt source and the junction between the capacitor 1070 and both inputs of nand-gate 1072 for forming a differentiator circuit to produce a pulse output on nand-gate 1072 which is applied to one input of the nand-gate 1074. The other input of the nand-gate 1074 is connected by a delay capacitance 1092 to the ground and is also connected by a resistor 1094 to the output of a nand-gate 1096 which is interconnected with a nand-gate 1098 to form a monostable multivibrator; the output of the nand-gate 1096 is normally high in the absence of a signal on line 714 indicating that the reel 150 (FIG. 1) is empty. The nand-gate 1078 has one input connected to the output of the nand-gate 1074 by the interposed nand-gate 1076 and has its other input connected to the output of the nand-gate 1100 which is interconnected with a nand-gate 1102 to form a bistable multivibrator circuit; the output of the nand-gate 1100 is normally high in the absence of a splice signal on line 702 occurring when the count in the counters 1040, 1042, 1044 and 1046 is within a predetermined distance from the end of their count. The base of the transistor 1082 is connected by the inverter 1080 to the output of the nand-gate 1078 while the emitter of the transistor 1082 is connected to the line 1056 and the collector is connected to the 15 volt voltage source. Thus the line 1056 will be driven high or positive upon receipt of a positive signal on line 700 in the absence of a stored splice signal, a stored end of reel signal, or a signal indicating the count is still in progress.

Figure 43:
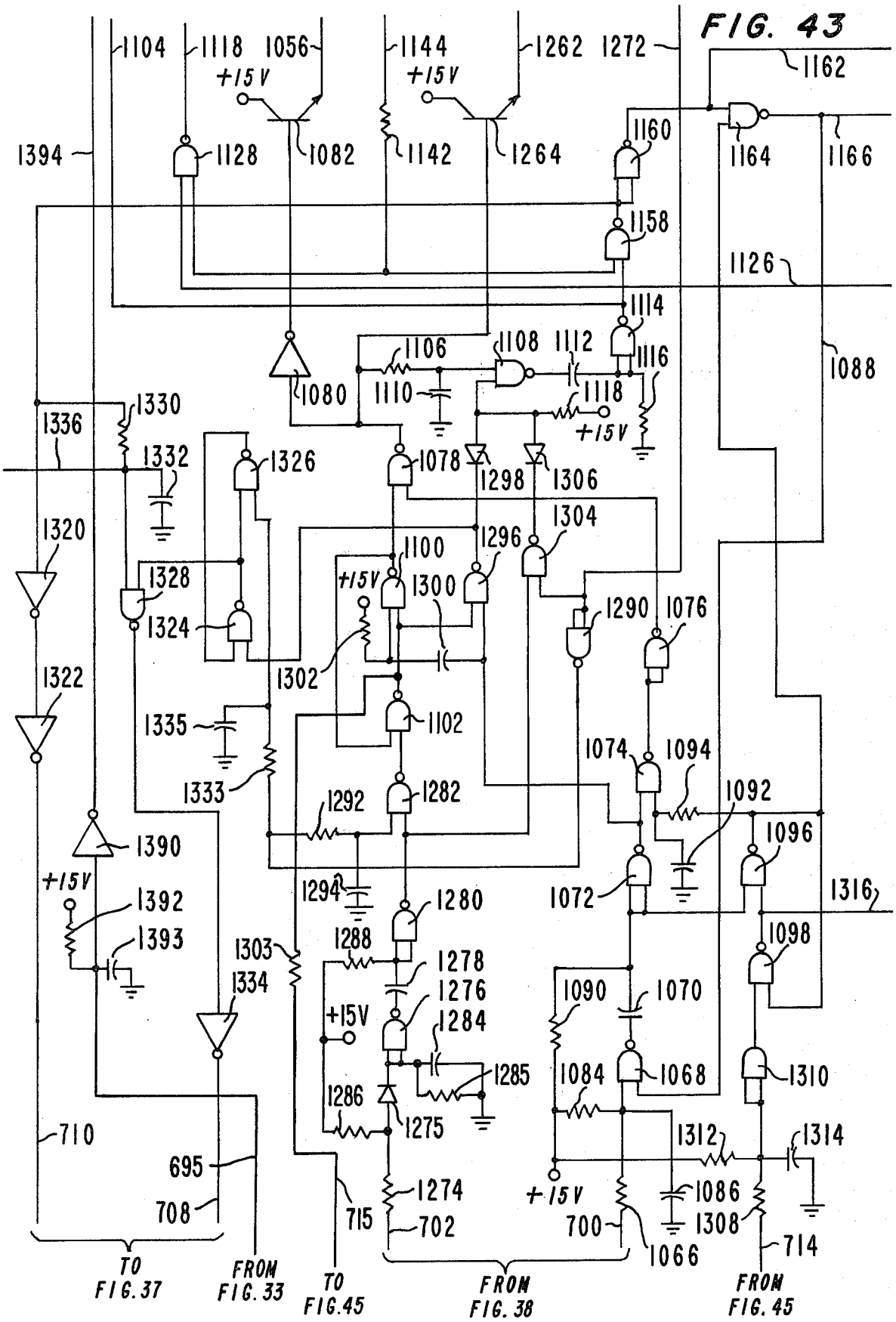
FIG. 43 is a detailed electrical diagram of a logic control section of the length measuring and pulling circuitry of FIG. 40.

Preset enable inputs of the counters 1040, 1042, 1044 and 1046 of FIG. 41 are connected to a line 1104 which causes the count represented by the signals on the jam inputs on the counters to be loaded into the counters. The output of the nand-gate 1078, FIG. 43, is connected to the line 1104 by a series circuit including a delay circuit having a resistor 1106 connected between the nand-gate 1078 and one input of a nand-gate 1108 with a capacitor 1110 connected from ground to the junction between the resistor 1106 and the nand-gate 1108, and a differentiating circuit including a capacitance 1112 connected between the output of the nand-gate 1108 and both inputs of a nand-gate 1114 with a resistance 1116 connected from ground to the inputs of the nand-gate 1114 which has its output connected to the line 1104. The other input of the nand-gate 1108 is normally biased high by a resistor 1118 connected to the 15-volt source. Thus with the feed of the stringer stopped and in the absence of both a stored splice signal and an end of reel signal, the setting of the thumb wheel switches 1048, 1050, 1052 and 1054 of FIG. 41 will be stored in the counters 1040, 1042, 1044 and 1046 upon the receipt of a start stringer drive signal on line 700 of FIG. 43.

Figure 44:
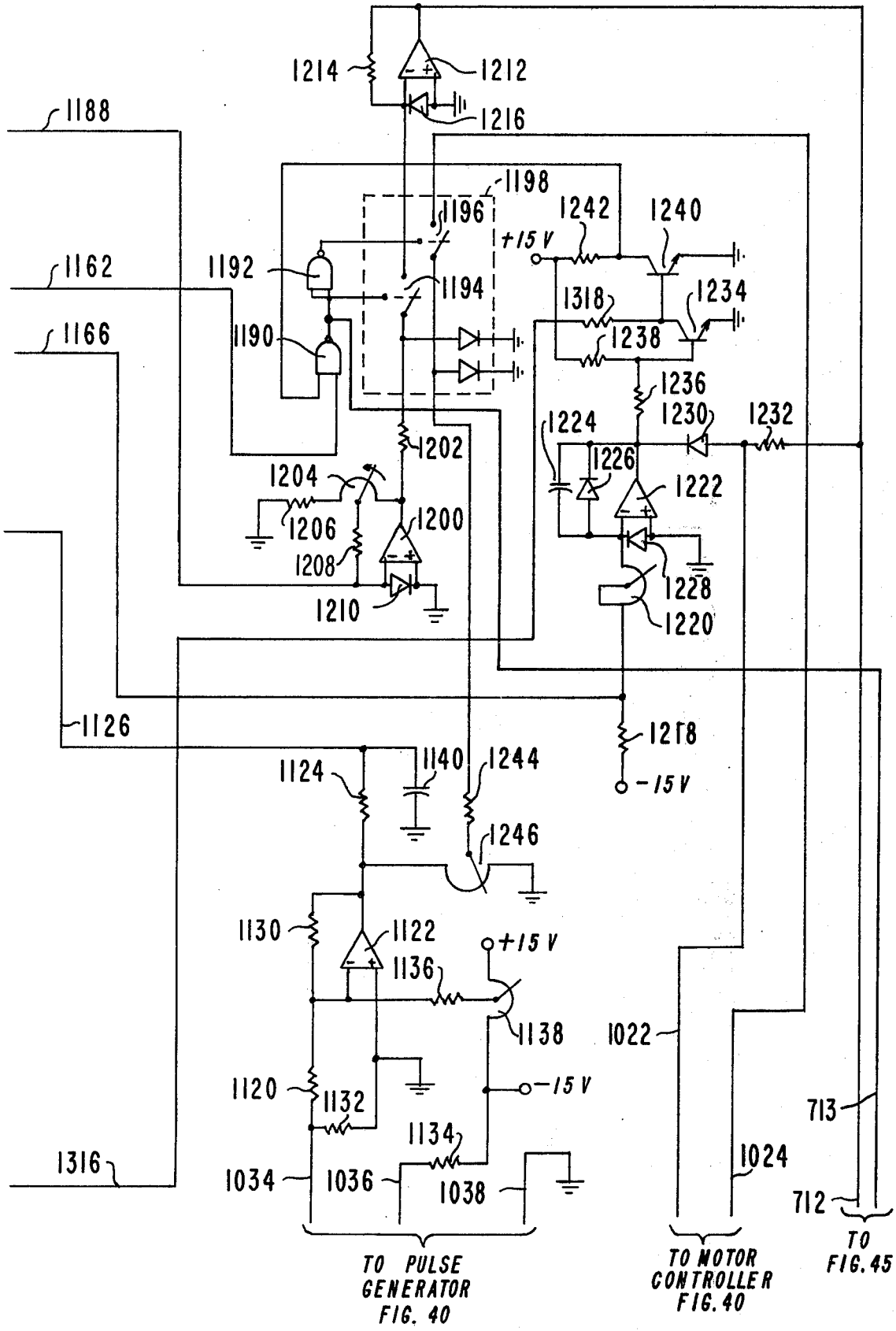
FIG. 44 is a detailed electrical diagram of some other control circuits in the length measuring and pulling circuitry of FIG. 40.

The down counting or clocking input of the least significant counter 1040 is connected to a line 1118 which in turn is connected to the pulse input line 1034, FIG. 44, by means of a series circuit including a resistor 1120,, an operational amplifier 1122, a resistor 1124, line 1126 to one input of a nand-gate 1128 which has its output connected to the line 1118. In this circuit, the operational amplifier 1122 has its non-inverting input connected to ground with a feedback resistance 1130 connected between its output and its inverting input to which the resistance 1120 is connected. A bias resistance 1132 is connected between the line 1034 and the ground. A voltage output line 1036 for the pulse generator is connected by protective resistance 1134 to the minus 15-volt power source. In the pulse generator the lines 1034 and 1036, for example, are connected to a photodiode which senses light passing through slots in a disc driven by the motor 500. The inverting input of the amplifier 1122 is also connected by a resistance 1136 to the slider of a potentiometer 1138 which is connected between the plus and minus 15 volt sources to set the zero level for the pulse input on line 1034. The line 1126 is connected by a capacitance 1140 to ground to filter spurious signals. In FIG. 43 the second input of the nand-gate 1128 is connected by a resistance 1142 to a line 1144 which is biased by a resistance 1146 (FIG. 41) connected to ground. The line 1144 is connected to the cathodes of sets of four diodes 1148, 1150, 1152 and 1154 which have their anodes connected to the respective outputs of the counters 1040, 1042, 1044 and 1046; a diode 1156 being interposed between the common junction of the diodes 1150 and 1154 and the line 1144 to isolate the cathodes of the sets of diodes 1152 and 1154 from the outputs of the counters 1040 and 1042. Thus the pulses on line 1034 are applied to count down the counters 1040, 1042, 1044 and 1046 until zero count at which time further signals on line 1034 are prevented from passing to the counter input on line 1118.

The line 1144 is also used to control the operation of the motor controller circuit. The resistor 1142 of FIG. 43 also connects the line 1144 to one input of a nand-gate 1158 which has its other input coupled to the normally low output of nand-gate 1114 on line 1104. The output of the nand-gate 1158 is coupled to both inputs of a nand-gate 1160 which has its output connected to line 1162 as well as to one input of a nand-gate 1164 which has its output connected to line 1166; the other input of the nand-gate 1164 being connected to the output of nand-gate 1096 of the flipflop storing the end of reel signal. Referring to FIG. 41, the outputs of the counters 1040, 1042, 1044 and 1046 are coupled by respective sets of four diodes 1168, 1170, 1172 and 1174 and weighted resistors 1176, 1177, 1178, 1179, 1180, 1181, 1182, 1183, 1184, 1185 and 1186 to a line 1188; the outputs of the six most significant bits of the counters 1044 and 1046 being coupled to the resistance 1186 which has the smallest value. The resistance 1176 has the largest value and is connected to the least significant output of the first counter 1040 while the other resistances 1177 through 1185 have decreasing values so that the resistances connected to more significant outputs contribute more current to the line 1188. Thus the line 1188 will have a stepped decreasing current therein as the count in the counters 1040, 1042, 1044 and 1046 approaches zero. As shown in FIG. 44, the line 1162 is connected to one input of a nand-gate 1190 which has its output connected to line 713 and to both inputs of a nand-gate 1192. The outputs of the nand-gates 1190 and 1192 are connected to respective switches 1194 and 1196 in a dualelectronic switch 1198, for example type IH5019-CPA. The line 1188 is connected to the inverting input of an operational amplifier 1200 which has its output connected by resistance 1202 to one side of the switch 1194. A potentiometer 1204 has one side connected to the output of the amplifier 1200 and its other side connected by resistance 1206 to ground with a slider of the potentiometer 1204 connected by a resistance 1208 to the noninverting input of amplifier 1200 for setting the gain of the amplifier. A protective diode 1210 is connected across the inputs of the amplifier 1200 which also has its non-inverting input connected to ground. The other side of the switch 1194 is connected by an inverting operational amplifier 1212 to line 712. The amplifier 1212 includes a feedback resistance 1214 and a protective diode 1216. The line 1166 is biased by a resistance 1218 connected to the minus 15-volt voltage supply and is connected to a ramp generator including a potentiometer 1220 connected in series with the noninverting input of an operational amplifier 1222 having a capacitance 1224 coupled between its output and noninverting input. Diodes 1226 and 1228 are coupled from the respective output and noninverting input to the inverting input. The output of the amplifier 1222 is also connected to the cathode of a diode 1230 which has its anode connected to the output line 1022. The junction of the line 1022 and the diode 1230 is connected by a resistance 1232 to the line 712. A transistor 1234 has its base connected to the output of the amplifier 1222 by a resistance 1236, the base being biased by a resistance 1238 connected to the plus 15-volt supply. The collector of the transistor 1234 is connected to the base of a transistor 1240 which has its emitter connected to ground in common with the emitter of the transistor 1234. A load resistance 1242 is connected between the collector of a transistor 1240 and the 15-volt power supply with the junction of the resistance 1242 and transistor 1240 being coupled to the second input of the nand-gate 1190.

In operation of the circuitry of FIG. 44, the line 1162 goes high and the line 1166 goes low after the count in the thumb wheel switches 1048, 1050, 1052 and 1054 is loaded into the counters 1040, 1042, 1044 and 1046. Also the line 1188 conducts its highest level of current at the initiation of the stringer feed cycle. The switch 1194 is closed and the switch 1196 is opened passing the signal on line 1188 to the line 712. The ramp generator 1222 is triggered into operation to generate an initially increasing output which line 1022 follows; the line 1022 receiving is energization through resistance 1232 from line 712 but being limited by the diode 1230 to the output of the amplifier 1222. This ramp voltage on line 1022 causes the motor controller 1020 (FIG. 40) to slowly increase the speed of the motor 500. As the count in the counters of FIG. 41 approach a low level, the signal on line 1188 decreases which produces a decreasing output through amplifiers 1200 and 1212 on line 712. This results also in a decrease in the signal on line 1022 due to the blocking of the output from amplifier 1222 by diode 1230 to bring about a gradual slow down of the motor 500. Once zero count is reached by the counters of FIG. 41, the line 1162 goes low causing the switch 1194 to open to deenergize the lines 712 and 1022 while the line 1166 goes high to reset the ramp generator circuit. During operation of the motor, the transistor 1240 is normally nonconductive causing the second input of the nand-gate 1190 to be high except when an end of reel signal is received.

The switch 1196 is connected between the line 1024 and a resistance 1244 which is connected at its other end to an arm of a potentiometer 1246 coupled across the output of the amplifier 1122 and ground. Thus when the switch 1196 closes, the signals from the pulse generator on line 1034 are applied to line 1024; such signals on line 1024 being alternating to lock the motor.

For sensing when the stringer advance has come within a predetermined distance from the end of the length of the stringer, there are included in FIG. 41 a pair of comparitors 1250 and 1252, such as type MM74C85N which have one set of inputs connected to the outputs of the respective counters 1040 and 1042 and have their second sets of inputs connected by sets of diodes 1254 and 1256 to one side of respective binary decade thumb wheel switches 1258 and 1260 which have their other sides connected in common to a line 1262. The diodes 1254 and 1256 also connect the switches 1258 and 1260 to the respective inputs of the counters 1040 and 1042. The line 1262 is connected to the emitter of a transistor 1264 (FIG. 43) which has its base connected to the output of nand-gate 1078 and its collector connected to the 15 volt power source; thus the line 1262 is energized except when the line 1056 is pulsed to load the count of switches 1048, 1050, 1052 and 1054 into the counters 1040, 1042, 1044 and 1046. The comparitors 1250 and 1252 are cascaded in a conventional manner with one output of the comparitor 1252 connected to an input of a nand-gate 1266; the output of comparitor 1252 being selected to produce a low when the count from the outputs of the counters 1040 and 1042 is higher than the reading from the switches 1258 and 1260. The other input of the nand-gate 1266 is connected to the output of a nand-gate 1268 which has both inputs connected to the cathodes of diodes 1152 and 1154 which are biased toward ground by a resistance 1270. A line 1272 connected to the output of the nand-gate 1266 remains high as long as the count in the counters 1040, 1042, 1044 and 1046 is greater than the setting of the switches 1258 and 1260. For example, the count in the counters 1040, 1042, 1044 and 1046 can be set at 9999 (corresponding to 999.9 inches) while the thumb wheel switches 1258 and 1260 may be set at 99 (corresponding to 9.9 inches) and the line 1272 remains high until the count in the counters 1040, 1042, 1044 and 1046 is counted down by the pulses on line 1118 to 99. The setting of the switches 1258 and 1260 is set at a corresponding length measurement which is a little less than the distance between the splice detector 188 (FIG. 1) and the home position of the holder 46.

The splice signal input line 702 in FIG. 43 is connected by a series circuit including a resistance 1274, a diode 1275, nand-gate 1276, a capacitance 1278, a nand-gate 1280 and a nand-gate 1282 to one input of the nand-gate 1102 in the multivibrator storing the splice signal. In this circuit, the cathode of the diode 1275 is connected to both inputs of the nandgate 1276 which are also connected by a parallel capacitance 1284 and resistance 1285 to ground. The anode of the diode 1275 is biased by a resistance 1286 connected to the 15 volt voltage supply. The resistance 1285 and the capacitance 1284 are selected so that the splice signal multivibrator is not triggered by a spurious signal during the opening of the contacts 193 (FIGS. 38 and 46). The capacitance 1278 forms a differentiator circuit between the output of the nand-gate 1276 and both inputs of the nand-gate 1280 which are biased by a resistance 1288 also connected to the 15 volt voltage supply. The line 1272 which has the comparitor signal thereon is connected by a nand-gate 1290 and a resistance 1292 to the second input of the nand-gate 1282; this input being delayed and filtered by capacitance 1294 connected to ground. The nand-gate 1282 will be enabled to pass the splice signal to nand-gate 1102 only after the line 1272 has gone low indicating that the count in the counters of FIG. 41 is equal to or less than the setting of switches 1258 and 1260. In this condition the circuit will be permitted to finish the normal advancing cycle of the stringer. However upon the next start signal on line 700, the nand-gate 1078 is disabled by the output of nand-gate 1100 to prevent the line 1056 from being energized and to maintain the line 1262 energized. The output of the nand-gate 1102 is connected to one input of a nand-gate 1296 which has its other input connected to the output of the nand-gate 1072 for receiving the start signal from line 700. The output of the nand-gate 1296 is coupled by a diode 1298 to the second input of the nand-gate 1108 which drives the load line 1104. Thus the next start signal on line 700 will load the setting of the switches 1258 and 1260 (FIG. 41) into the counters 1040 and 1042 to initiate a cycle which advances a stringer only a short distance to move the splice in the stringer just past the holder 46 (FIG. 1). The output of the nand-gate 1072 is coupled by a capacitor 1300 to a second input of the nand-gate 1100 which is biased by a resistance 1302 to thus form a differentiator circuit to reset the nand-gates 1100 and 1102 upon the trailing edge of the next start signal on line 700.

The output of nand-gate 1102 is connected by a resistance 1303 to line 715 to produce a signal on line 715 that the next section of stringer will have a splice.

The output of the nand-gate 1280 is connected to one input of a nand-gate 1304 which has its other input connected to the line 1272. The output of the nand-gate 1304 is coupled by a diode 1306 to the second input of the nand-gate 1108 which drives the load line 1104. If a splice signal occurs on line 702 prior to the advancement of the stringer to within a predetermined distance of the end of its advancement, i.e., before the count in the counters of FIG. 41 drops below the setting of the switches 1258 and 1260, the load line 1104 is pulsed to reset the counters to the setting of the thumb wheel switches 1258 and 1260. This results in the stopping of a feed cycle just after the splice has passed the holder 46 (FIG. 1).

Line 714 of FIG. 43, on which a end of reel signal is received, is connected by a series circuit including a resistance 1308 and a nand-gate 1310 to one input of the nand-gate 1098 of the multivibrator storing the end of reel signal. In this circuit, both inputs of the nand-gate 1310 are connected to the resistance 1308 and are biased by a resistance 1312 connected to the 15 volt supply and filtered by a capacitor 1314 connected to ground. The output of the nand-gate 1098 is connected to a line 1316 which is coupled by a resistance 1318 in FIG. 44 to the base of the transistor 1240. When the nand-gate 1096 and 1098 receive the end of reel signal, the nand-gate 1164 is rendered inoperative to cause the line 1166 to go high and the line 1316 to go high. Normally the line 1316 is low which renders the transistor 1240 nonconductive to hold the second input of the nand-gate 1190 high. Upon the end of the reel signal the base of the transistor 1240 is no longer held low by the line 1316 and the output of the ramp generator formed by amplifier 1222 controls the base of the transistor 1240 through transistor 1234. When the line 1166 goes high upon the receipt of the end of reel signal, the output of the amplifier 1222 ramps toward a low which brings about a decreasing signal on the line 1022 to slow the motor 500 (FIG. 12) driving the stringer advance. When the output of the amplifier 1222 reaches a zero voltage the transistor 1234 becomes nonconductive rendering the transistor 1240 conductive which drives the output of the nand-gate 1190 positive to open switch 1194 and close switch 1196. This energizes the line 1024 with an alternating signal locking the motor. A signal indicating that the motor is stopped is generated on line 713 when the output of gate 1190 goes high. It is noted that the position gain potentiometer 1246 is set so that the output of amplifier 1122 is insufficient to drive the nand-gate 1128 to maintain the present count in the counters of FIG. 41.

The junction of the capacitor 1070 of FIG. 43 with the inputs of the nand-gate 1072 is connected to an input of the nand-gate 1096 for resetting the nand-gates 1096 and 1098 upon a subsequent start signal on line 700. This subsequent start signal is blocked by nand-gate 1074 by means of the output of nand-gate 1096 to avoid resetting the counters of FIG. 41. After a new reel has been installed and spliced to the end of the stringer from the old reel and a start signal received on line 700, the line 1166 goes low and the line 1316 goes low to start the motor and continue the count down of the counters.

The output of the nand-gate 1158 is coupled by a pair of inverters 1320 and 1322 to the line 710. When the counters of FIG. 41 reach zero count, the zero output on line 1144 drives the output of nand-gate 1158 high which produces a high signal on line 710 indicating that the feed of the stringer has stopped.

The output of the nand-gate 1296 is connected to one input of a nand-gate 1324 which is interconnected with a nand-gate 1326 in a bistable multivibrator circuit for storing a signal indicating that a stringer of incorrect length has been produced. The output of nand-gate 1324 is connected to an input of a nand-gate 1328 which has its other input connected by resistor 1330 to the output of the nand-gate 1158 and connected by delay capacitance 1332 to ground. The output of the nand-gate 1328 is connected by an inverter 1334 to the line 708 to produce a high output signal on line 708 at the termination of a cycle to indicate that a stringer of incorrect length has been produced. The output of nand-gate 1290 is connected by a resistance 1333 to one input of nand-gate 1326 for resetting the nand-gates 1324 and 1326 upon the next cycle when the counters of FIG. 41 are loaded from switches 1048, 1050, 1052 and 1054. A filter capacitor 1335 is connected between ground and the one input of the gate 1326.

Figure 42:
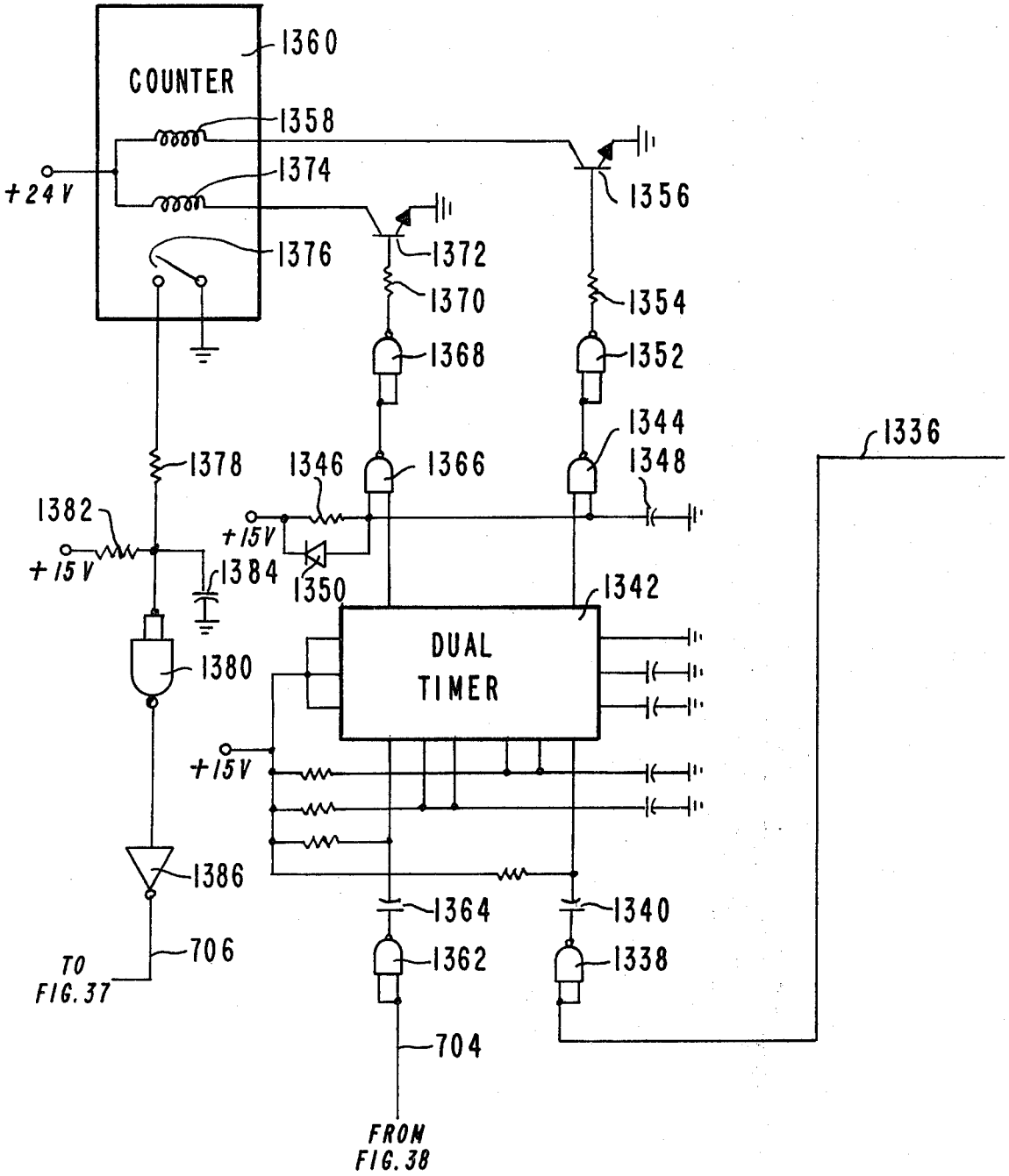
FIG. 42 is a detailed electrical diagram of a batch counting section of the circuitry of FIG. 40.

The junction of the resistance 1330 with the input of the nand-gate 1328 is also connected to a line 1336 which, as shown in FIG. 42, is coupled by a nand-gate 1338 and a differentiating capacitance 1340 to the input of one stage of a dual timer unit such as a type 556 dual timer 1342 which has suitable bias and delay resistances and capacitances connected thereto in a conventional manner. The output of this stage of the timer 1342 is connected to one input of a nand-gate 1344 which has its other input biased by a resistance 1346 connected to the 15-volt source and a capacitance 1348 connected to ground for initally pulsing the nand-gate 1344 upon application of power. A diode 1350 is connected across the resistance 1344 for discharging the capacitance 1348 upon a power loss. The output of the nand-gate 1344 is connected to both inputs of a nand-gate 1352 which has its output connected by resistance 1354 to the base of a transistor 1356 having an emitter-collector circuit connected in series with the count down coil 1358 of a mechanical counter 1360; the coil 1358 and transistor 1356 being coupled across the 24-volt source. The line 704 is connected by a nand-gate 1362 and a differentiating capacitance 1364 to the second stage of the dual timer 1342. The output of the second stage is connected to one input of a nand-gate 1366 which has its other input connected to the junction between resistor 1346 and capacitance 1348 and has its output connected by means of a nand-gate 1368 and resistance 1370 to the base of a transistor 1372. The emitter-collector circuit of the transistor 1372 is connected in series with a setting coil 1374 of the counter 1360. The counter 1360 is a conventional counter which has means such as dials (not shown) for selecting a setting of the counter to which the counter is set by operation of the setting coil 1374. The counter 1360 also contains a switch 1376 which is closed when the count of the counter 1360 is greater than zero and which is open when the count equals zero. One side of the switch 1376 is connected to ground while the other side of the switch is connected by a resistance 1378 to both inputs of a nand-gate 1380; these inputs being biased by resistance 1382 to the 15-volt source and filtered by capacitance 1384 connected to ground. The output of the nand-gate 1380 is connected by an inverter 1386 to line 706 which goes high when the number of pulses on line 1336 have stepped the counter 1360 down to zero to indicate that the thickness of the reinforcements being produced upon the stringer ends must be tested by the guage 552 (FIG. 1).

In FIG. 43, an inverter 1390 which has its input connected to the reset signal line 695. This input is biased by a resistor 1392 connected to the 15 volt source and is connected by a capacitance 1394 to ground so that the input of the inverter 1390 will be initially zero when the power is applied. The output of the inverter 1390 is coupled to a line 1394 which is connected to reset inputs of the counters 1040, 1042, 1044 and 1046 of the circuit in FIG. 41 to set the count in the counters at zero when voltage is initially applied or upon a reset signal on line 695.

Figure 45:
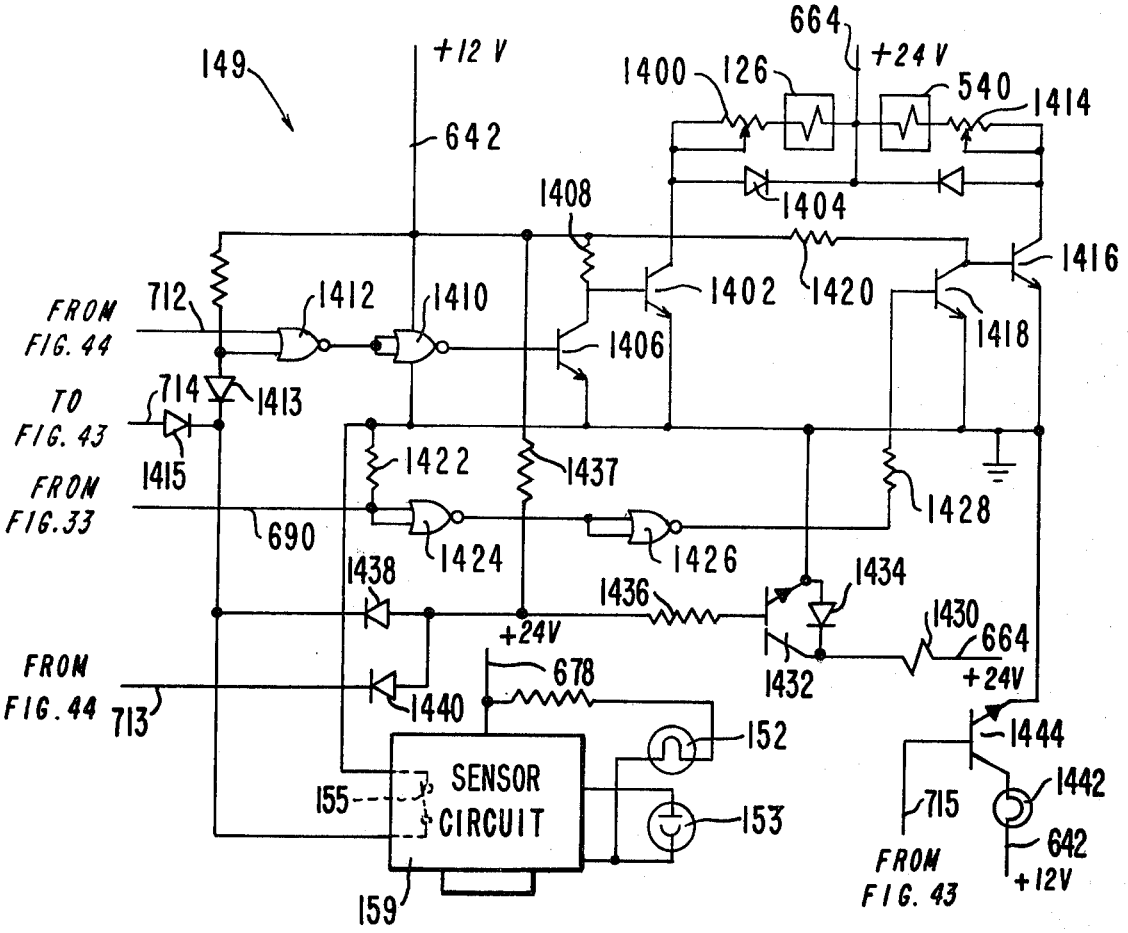
FIG. 45 is a detailed electrical diagram of a reel clutch control section of the circuit of FIG. 33.

In the reel clutch control circuit 149 as shown in FIG. 45, the magnetic clutch 126 is connected in a series circuit including the solenoid of the clutch 126, a variable resistance 1400 and the emitter-collector circuit of a transistor 1402 connected across the 24-volt power source 664. A diode 1404 is connected across the resistance 1400 and the solenoid of the clutch 126 for providing a return path for induced current when the coil 126 is deenergized. The base of the transistor 1402 is connected to the junction between the collector of a transistor 1406 and a resistance 1408 which is connected at its other end to the 12-volt source 642. The emitter of the transistor 1406 is connected to ground while the base is driven by the output of a nor-gate 1410 which has both inputs connected to the output of a nor-gate 1412. One input of the nor-gate 1412 is connected to line 712 while the other input is connected by a diode 1413 to one side of the end of reel switch 155 which has its other end connected to ground. The switch 155 is part of the conventional sensing circuit unit 159 which is connected to the lamp 152 and the photoelectric cell 153. The unit 159 is similar to the unit 201 of FIG. 46 but is a different model designed to operate on a different power voltage from the 24-volt line 678. The line 712 goes high during the pulling of the stringer tape by the pulling mechanism 54 to render the transistor 1402 nonconductive and deenergize the clutch 126. When the end of reel switch 155 opens in response to the end of the chain passing the end of reel sensing mechanism, the nor-gate 1412 is disabled by one input of nor-gate 1412 going high preventing the clutch from being energized when the stringer pulling mechanism stops. If the switch 155 remains closed, the clutch 126 is again energized at the end of a pulling cycle by line 712 going low.

The line 714 is connected by a diode 1415 to the junction of the diode 1413 and switch 155 for applying an end of reel signal to the circuit of FIG. 43.

The clutch 540 is connected in series with a variable resistance 1414 and the collector-emitter circuit of a transistor 1416 across the 24-volt source. A transistor 1418 has its collector connected by a resistance 1420 to the 12-volt source and to the base of the transistor 1416 with the emitter of the transistor 1418 being grounded to drive the transistor 1416. The line 690, connected to the normally open contact 688 of the torque release switch in FIG. 33 and normally biased by resistance 1422 connected to ground, is connected by nor-gates 1424 and 1426 and resistance 1428 to the base of the transistor 1418. Thus the clutch 540 is normally energized to drive the take-up reel 526 (FIG. 1) except when the switch 684 (FIG. 33) is operated.

A solenoid valve 1430 for operating the clamping air cylinder 169, FIG. 1, is connected in series with a transistor 1432 between the voltage line 664 and ground. A diode 1434 is connected across the transistor 1432 for protecting the transistor against inductive voltage when the solenoid valve is deenergized. The base of the transistor 1432 is connected by a resistance 1436 to the anodes of diodes 1438 and 1440. The cathode of diode 1438 is connected to the junction between the diode 1413 and switch 155, while the cathode of diode 1440 is connected to the feed motor stopped signal line 713. The solenoid valve 1430 is normally energized to hold the clamp member 167, FIG. 1, in a raised position. If both (1) the switch 155 is open indicating the reel 150 has run out of slide fastener stringer and (2) the line 713 indicates the pulling mechanism 54 has stopped, then the solenoid valve 1430 is deenergized to lower the clamp member 167 and clamp the slide fastener stringer 62.

A splice jog indicating lamp 1442 mounted in the face of the box 58, FIG. 1, is connected in series with a transistor 1444 across the 12 volt power source lines. The base of the transistor 1444 is connected to the line 715 to be operated when a splice signal is present on line 715.

In the operation of the control circuitry of FIGS. 33-45, the system control circuit 197 cycles through the steps in the memory 730 as recorded in tables 1 and 2. During an initial power-up portion of the operation, signals produced by the delay of the capacitance 744 (FIG. 35) on line 740 sets all of the latches in the units 752, 754, 756 and 758 to zero as well as setting the program counter 734 (FIG. 36) to zero. Similarly the counters 1040, 1042, 1044 and 1046 (FIG. 4) are reset to zero by means of a signal on line 1394 produced by the charging delay of the capacitance 1393 (FIG. 43). The system control circuitry then cycles continuously through all the steps in the memory 730 at a rate of about 100 cycles per second, i.e., the program counter is stepped at a rate of 100 kilohertz. The circuitry has 32 possible different states (states 0 through 31) as represented by the outputs 01, 02, 03, 04, and 05 on lines 821, 822, 823, 824 and 825 of FIG. 35.; however states 12, 15, and 31 are not used. In addition some of the temporary storage outputs 06, 07, 08 and 09 (lines 826, 827, 828 and 829) are sometimes used in place of states. When the circuit changes to a state one or more operations are usually performed and then a condition or conditions must be sensed before the circuit will proceed onto the next state and perform further operations.

State 0. This state occurs when power is initially applied to the circuit. Temporary storage output 09 (line 829) is rendered high. All of the cylinders are off. The operator moves the holder 46 to the home position. The closing of home position switch 273 (FIGS. 9 and 37) and the high state of output 09 are sensed to move to state 28.

State 28. When the circuit changes to state 28, output OE of latch unit 756 (FIG. 35) is driven high to operate solenoid 285 (FIG. 39) which operates cylinder 235 (FIG. 16) and the plunger 263 locking the holder 46 in the home position. Temporary storage output 09 is changed to low if this output is high. When both the home clamp switch 271 (FIGS. 16 and 37) and the home position switch 273 are sensed as being closed, the circuit then proceeds to state 30.

State 30.

A. When the circuit changes to state 30 from state 28 no operations are performed.

B. When the circuit changes to state 30 from state 27 the output 17 and line 858 are returned to their low condition while outputs OC and OD on lines 838 and 836 are rendered high to operate the timer 904 (FIG. 36) for a period (about 10 seconds). In the event that the timer operates prior to a feed stop signal on line 710 and the foot switch 882 is unoperated, the circuit goes to state 26.

If a feed stop signal on line 710 is present along with home clamp switch 271 being closed and the home position switch 273 being unoperated indicating that the cover 204 is open, the circuit proceeds to state 29 to begin another cycle of operation.

State 29. Any of the lamps 868, 870, 872 and 874 (FIG. 35) which may be on are turned off. While in this state it is expected that the operator will properly position the stringer within the holder 46 and close the cover 204 (FIG. 16). If the switch 273 (FIGS. 9 and 37) is closed indicating that the holder cover 204 is closed, the circuit proceeds to state 1.

State 1. Output OE goes low releasing the plunger locking the holder 46 in position. Outputs OD on line 838 and OC on line 836 are rendered low to reset the timer 904. The conditions of switches 275 (FIGS. 9 and 37), 315 (FIGS. 18 and 37) and 882 are sensed; if the switch 275 indicates that the holder 46 is in the gapping station 48, if the switch 315 indicates that the gapping cylinder 294 is retracted, and if the foot switch 882 is unoperated, the circuit proceeds to state 2.

State 2. Output OF and line 842 (FIGS. 35 and 39) go high operating the solenoid 1006 which operates the clamping mechanism 320 (FIGS. 9 and 21) to lock the holder 46 in the gapping station 48. Switch 336 (FIGS. 21 and 37) is operated when the clamping is completed to permit advancement to state 3.

State 3. Start gap lamp 862 (FIG. 35) is turned on. Switch 882 is sensed and if closed, the circuit changes to state 4.

State 4. Output 12 and line 848 go high operating solenoid valve 1002 to advance the piston rod 296 of the air cylinder 294 (FIG. 18) and operate the gapping mechanism. Additionally lines 832 and 838 to the analogue multiplexer 894 (FIG. 36) go high and the timer 904 is operated to produce a low on line 878 after a duration corresponding to the normal duration that it takes the gapping mechanism to produce a gap and operate the switch 313. If the switch 313 operates before the output of the timer 904 goes low, the circuit proceeds to state 8. However if the timing signal terminates without the operation of switch 313, the circuit proceeds to state 5.

State 5. Output 12 and gap cylinder control line 848 are driven low to deactuate the gapping cylinder and raise the carriage 288 of the gapping mechanism. When the switch 315 is operated indicating that the carriage 288 has raised to its upper position, the circuit proceeds to either state 6 or state 7 depending upon the condition of temporary storage latch output 06; the circuit proceeding to state 6 if the output 06 is low and proceeding to state 7 if the output 06 is high.

State 6. The temporary storage output 06 is rendered high to indicate the circuit has tried once to produce a gap but has failed on the first try. Also the time delay operating signals are removed from lines 832 and to reset the timer 904 of FIG. 36. Then the circuit proceeds back to state 4 to try another operation of the gapping mechanism.

State 7. After having failed to produce an acceptable gap on the second try, the time delay operating signals are turned off. The temporary storage output 06 is returned to its low state. The temporary storage output 07 is rendered high and the lamp 870 is operated to indicate that a bad gap has been produced. The line 842 goes low to deactivate the clamping mechanism 320 for the gapping station. Lamp 862 is turned off. The circuit then changes back to state 28 when the home position switch 273 is operated by the operator returning the holder to the home position. The stringer in the holder is repositioned by moving the stringer to one side of its present position by a short distance during a repeat of states 30 and 29. Then States 1, 2, 3 and 4 are repeated.

State 8. The temporary storage output 06 is rendered low if it is not already low. The time delay outputs on lines 832 and 838 are rendered low to terminate operation of the timer. The start gap lamp 862 is turned off. Line 856 is driven by output 16 high in order to energize solenoid valve 403 (FIGS. 39 and 47) and operate the reinforcing tape feed mechanism 342 (FIG. 24) as well as the cutter 398 (FIG. 27). The locking mechanism 320 for the gapping station 48 is released. The operator may then move the holder to the ultrasonic station. It is noted that the gapping cylinder 294 remains operated to insure that all of the pinched off head portions of the elements are removed when the holder is withdrawn from the gapping station. Upon sensing that the weld position switch 277 (FIGS. 9 and 37) has been operated and that the foot switch 882 is open, the circuit proceeds to state 9.

State 9. Output OF and line 842 (FIG. 35) go high to operate the solenoid valve 1006 (FIG. 39) and the weld clamping mechanism 432 (FIG. 9) Also the output 12 and gap solenoid control line 848 go low to release the gapping cylinder 294. When the weld clamp switch 438 (FIG. 37) closes to indicate that the clamping mechanism 432 has operated, the circuit changes to state 10.

State 10. The start weld indicator lamp 864 (FIG. 35) is turned on by output 1A going high. The condition of the foot switch 882 is sensed and when this switch closes, the circuit proceeds to state 11.

State 11. Output 13 and line 850 (FIG. 35) go high which operate the start relay 696 (FIG. 39) for the ultrasonic welding mechanism 414 (FIGS. 1 and 8). Outputs OB and OD on lines 834 and 838 go high to operate timer 904. The circuit advances to either state 13 or state 14 depending upon whether the good weld indicating switch 433 (FIGS. 1 and 38) remains open or closes before line 878 from the timer 904 goes low. In the event the switch 433 remains open when line 878 goes low indicating that the welder has failed to produce a good weld, the circuit proceeds to state 13 upon the sensing of the weld cylinder return switch 434 (FIGS. 8 and 37) closing. If the switch 433 closes indicating that a good weld has been produced, the circuit changes to state 14.

State 13. Temporary storage output 07 on line 827 goes high. The start weld lamp 864 is turned off by output 1A going low and the bad weld indicator lamp 872 is turned on by the output 1E going high. The clamping mechanism 432 at the ultrasonic station is released by output OF going low. The time delay is turned off by outputs OB and OD going low. Both the welder operating line 850 and the weld station control line 856 go low. Temporary storage output 09 is rendered high which causes the circuit to change to state 28 upon home position switch 273 being closed requiring that the states between state 28 and state 11 be repeated.

State 14. The welder operating line 850 is rendered low. Upon the cylinder return pulse produced by switch 434 and the timer output on line 878 going low, the circuit changes to state 16.

State 16. Output OF and line 842 (FIG. 35) go low to release the weld clamping mechanism 432. Weld start lamp 864 is turned off. Output OB and OD on lines 834 and 838 go low to reset the timer. Output 16 and line 856 go low to release the air cylinders 230, 351 and 400 (FIGS. 1, 24, 27 and 47). Upon sensing that the foot switch 882 is in the unoperated condition, sensing that the trim cylinder switch 464 (FIG. 37) is open indicating the trimming mechanism is in its unoperated condition, and sensing that the trim position switch 278 has operated in response to the holder 46 being positioned at the trimming station 52, the circuit proceeds to state 17.

State 17. Output OF and clamp control line 842 (FIG. 35) are rendered high to operate solenoid valve 1006 (FIG. 39) and the trimming clamp mechanism 482 (FIG. 8). When switch 484 (FIG. 37) operates indicating that the holder 46 has been locked in the trimming station 52, the circuit changes to state 18.

State 18. Start trim cycle indicator lamp 862 (FIG. 35) is turned on by output 19 going high. When footswitch 882 is sensed in the operated condition, the circuit changes to state 19.

State 19. Output 14 and trim solenoid control line 852 (FIG. 35) go high operating solenoid valve 1008 and the cylinder (not shown) controlling the trimming mechanism 52. Also the timer 904 (FIG. 36) is operated by outputs OA and OD being rendered high. The period for operation of the timer 904 is selected by the output OA and corresponds to the normal time required for the trimming mechanism 52 to produce an acceptable trimming operation. When either the time period expires or good trim indicator switch 462 (FIG. 37) operates, the circuit proceeds to state 20.

State 20. Output 14 and line 852 go low to release the trimming cylinder and return the carriage 442 (FIG. 29) to the raised position. If the time period expires before the operation of the switch 462, the circuit proceeds to either state 21 or state 22 when the trim cylinder switch 464 is closed indicating that the carriage 442 has returned to the raised position; the circuit proceeds to state 21 if temporary storage output 06 is low and proceeds to state 22 if the temporary storage output 06 is high. If the switch 462 operates before the termination of the time period, the circuit proceeds to state 23 when the switch 464 operates.

State 21. Temporary storage output 06 is rendered high. Time delay lines 832 and 838 from outputs OA and OD go low to reset the timer 904. Upon the restoration of the high output on line 878 of the timer 904, the circuit proceeds to state 19 to repeat the trimming cycle.

State 22. The time delay start line 838 and the temporary storage output 06 are rendered low. The temporary storage output 07 goes high. Start trim cycle lamp 866 is turned off while bad trim indicator lamp 874 (FIG. 35) is turned on. Output OF and line 842 go low to release the locking mechanism 482. Temporary storage output 09 goes high causing state 28 when home position switch 273 closes to require that the cycle be repeated from the beginning for a new section of stringer slightly displaced from the present section.

State 23. Temporary storage output 06 and time delay start output OD are rendered low. The start trim lamp 866 is turned off. The line 842 is made to go low to release the locking mechanism 482 (FIG. 8). If the temporary storage output 07 is high, the circuit goes to state 24. If temporary storage output 07 is low and short splice indicator line 708 is low, the circuit proceeds to state 25. If the short splice indicator line 708 is high, if the temporary storage output 07 is low, if the foot switch 882 is unoperated, if the home position switch 273 is operated and if the end of batch line 706 is low, the circuit goes to state 26.

State 24. Temporary storage output 07 is rendered low. Temporary storage output 09 goes high and when the holder home switch 273 operates, the circuit goes to state 28. In this condition the operator must do another cycle after repositioning the stringer so that a new reinforcement and gapping cycle will be completed adjacent to the defectively trimmed reinforcement.

State 25. A pulse is generated on output 18 and line 860 (FIGS. 35 and 38) to advance the count in the counter 986 indicating that an acceptable stringer has been produced. When the home position switch 273 is operated and if the end of batch line 706 is low, the circuit proceeds to state 26.

In the event that the batch count line 706 is high, the gauge test lamp 946 (FIG. 38) is turned on and the circuit is prevented from advancing to state 26. The operator must remove the guage 552 (FIG. 1) so that the switch 556 (FIGS. 1 and 38) is operated for a period of time corresponding to the duration set by the timer 956. A signal then produced on line 704 will reset the batch counter 1360 (FIG. 42) causing the line 706 to go low and permit the circuit to advance to state 26.

State 26. Output OE and line 840 are rendered high to operate the plunger 263 (FIGS. 9 and 16) to lock the holder 46 in the home position. Start stringer drive lamp 868 is turned on. In the event that the timer 904 is operated, the timer is turned off. The circuit will proceed to state 27 if the foot switch 882 is operated, if the switch 273 indicates that the cover 204 of the holder 46 is open, and if the locking mechanism switch 271 indicates that the holder is locked in the home position.

State 27. Output 17 and line 858 go high which causes the one-shot 988 (FIG. 38) to produce a pulse on the start stringer drive line 700. When line 710 goes low indicating that the stringer pulling mechanism 54 is operating, the circuit goes to state 30.

Inasmuch as the present invention is subject to many variations, modifications and changes in detail, it is intended that all material in the foregoing specification and in the accompanying drawings should be interpreted in an illustrative and not in a limiting sense.

What is claimed is:

1. A method of gapping and reinforcing a selected section of a slide fastener stringer comprising the steps of aligning the selected section relative to a holder;

gripping, by means of the holder, the slide fastener stringer on opposite ends of the selected section leaving the selected section exposed;

producing relative movement between the holder and a fastener element gapping mechanism to align the selected section with the gapping mechanism;

operating the gapping mechanism after the first producing movement step to remove head portions of slide fastener elements in the selected section;

producing relative movement between the holder and a reinforcing tape segment applying mechanism to align the selected section with the reinforcing tape segment applying mechanism; and operating the reinforcement tape segment applying mechanism after the second producing movement step to secure a segment of reinforcing tape on the selected section of slide fastener stringer.

2. A method as claimed in claim 1 including the step of forming of a score line across the secured segment of reinforcing tape and the slide fastener stringer.

3. A method as claimed in claim 1 further including the steps of producing relative movement between the holder and a trimming mechanism to align the selected section with the trimming mechanism; and operating the trimming mechanism after the third producing movement step to trim portions of the tape segment extending past the stringer.

4. A method as claimed in claim 3 wherein the trimming step also includes the cutting of a notch in the edge of the reinforced portion of stringer at the gapped section thereof.

5. A method as claimed in claims 1, 2 or 3 wherein the holder is moved during the producing movement steps along a rail which extends in front of the mechanisms.

6. A method as claimed in claim 3 wherein the producing movement steps include moving a lower carriage of the holder along a dove-tail rail which extends in front of the gapping mechanism, reinforcing tape segment applying mechanism and trimming mechanism, and moving an upper carriage slideably mounted on the lower carriage relative to the lower carriage and transverse the rail toward the respective mechanisms; and including the further step of preventing operation of a subsequent mechanism in the event of a defective operation of one of said mechanisms.

7. A method as claimed in claim 1 or 3 including the steps of locking the holder at the respective mechanisms after the respective producing movement steps but prior to the operating steps for the respective mechanisms.

8. A method as claimed in claim 1 wherein the second producing movement step and the operating the tape applying mechanism step include the steps of folding a segment of thermoplastic tape over one edge of the gapped section of slide fastener stringer, and ultrasonically welding the thermoplastic tape to the slide fastener stringer.

9. A method as claimed in claim 8 including the further steps of advancing a leading segment of a continuous thermoplastic tape in front of a gap between a welder tip and an anvil during the second producing movement step, engaging the leading edge of the selected section of slide fastener stringer against an intermediate portion of the leading segment of tape during the second producing movement step, cutting the leading segment from the continuous tape to form the tape segment, and said folding step including the advancement of the holder after the cutting step to move the stringer into the gap between the welder tip and the anvil to thus fold the segment of tape over the slide fastener stringer.

10. A method as claimed in claim 1 including sensing a defective operation of the gapping mechanism, and preventing movement of the holder to the tape segment applying mechanism in response to the sensing of a defective gapping operation so that another section of the stringer must be selected and gapped.

11. A method as claimed in claim 3 including the steps of sensing the operation of the gapping mechanism to determine if there is a failure to remove the head portions of the fastener elements, preventing movement of the holder to the tape applying mechanism if the first sensing step determines a failure, sensing the operation of the tape applying mechanism to determine a defective operation in the securing of the tape segment, and preventing movement of the holder to the trimming mechanism if the second sensing step determines a defective operation.

12. A method as claimed in claim 11 including counting the number of reinforcements made on a continuous stringer, sensing the operation of the trimming mechanism during the operation of the trimming mechanism to determine if a trimming operation is performed properly, and bypassing the counting step for one cycle in the event that defective operation of the gapping mechanism, tape applying mechanism, or trimming mechanism is sensed.

13. A method as claimed in claim 1 including the step of advancing the stringer after the operation of the tape applying mechanism.

14. A method as claimed in claim 13 including sensing a splice in the slide fastener stringer during the advancing of the slide fastener stringer;

terminating operation of the advancing step to position the splice adjacent to the holder in the event that the splice occurs spaced from the normal stopping point of the stringer; and in the event the splice occurs after the normal stopping point of the slide fastener stringer, permitting the advancing step to proceed and resetting the advancing mechanism so that the advancing step terminates just past the splice during a subsequent advancing step.

* * * * *